United States Patent [19]

Takada et al.

[11] Patent Number: 4,753,870

[45] Date of Patent: Jun. 28, 1988

[54] LIGHT-SENSITIVE SILVER HALIDE PHOTOGRAPHIC MATERIAL

[75] Inventors: Shun Takada; Toyoki Nishijima, both of Odawara; Kaoru Onodera, Sagamihara, all of Japan

[73] Assignee: Konishiroku Photo Industry Co., Ltd., Tokyo, Japan

[21] Appl. No.: 7,800

[22] Filed: Jan. 28, 1987

[30] Foreign Application Priority Data

Jan. 28, 1986 [JP] Japan ..... 61-16184

[51] Int. Cl.[4] ..... G03C 1/02; G03C 7/26; G03C 7/32; G03C 7/38

[52] U.S. Cl. ..... 430/546; 430/558; 430/636

[58] Field of Search ..... 430/636, 546, 558, 387

[56] References Cited

U.S. PATENT DOCUMENTS

| | | | |
|---|---|---|---|
| 3,963,499 | 6/1976 | Shiba et al. | 430/636 |
| 4,211,836 | 7/1980 | Yoneyama et al. | 430/546 |
| 4,275,145 | 6/1981 | Mikami | 430/546 |
| 4,562,146 | 12/1985 | Masuda et al. | 430/546 |
| 4,624,903 | 11/1986 | Simons | 430/636 |
| 4,639,413 | 1/1987 | Kawagishi et al. | 430/546 |

*Primary Examiner*—Paul R. Michl
*Assistant Examiner*—Mark R. Buscher
*Attorney, Agent, or Firm*—Finnegan, Henderson, Farabow, Garrett & Dunner

[57] ABSTRACT

A light-sensitive silver halide photographic material having a support and at least one silver halide emulsion layer on the support. At least one layer of the silver halide emulsion layer contains a compound of the Formula I wherein Z represents a group of non-metallic atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent; and a compound represented by formula 1

$R^1(O)_nSO_3M$ wherein $R^1$ represents an alkyl group; M represents a hydrogen atom or a cation and n is 0 or 1.

14 Claims, No Drawings

LIGHT-SENSITIVE SILVER HALIDE PHOTOGRAPHIC MATERIAL

FIELD OF THE INVENTION

This invention relates to a light-sensitive silver halide photographic material. More particularly, it relates to a light-sensitive silver halide photographic material having good dispersion stability of magenta couplers, giving stable dye images against heat or light, also having good gradation at the toe portion, and further having prevented the generation of stain.

BACKGROUND OF THE INVENTION

It has been well known that dye images are produced by subjecting a light-sensitive silver halide color photographic material to imagewise exposure to effect color development, whereby an oxidized product of an aromatic primary amine type color developing agent couples with a coupler to form dyes including, for example, indophenol, indoaniline, indamine, azomethine, phenoxadine, phenadine and other dyes similar to these. In such a photographic system, generally employed is a color reproduction system utilizing the subtractive color process, in which used is a color photographic material comprising blue-sensitive, green-sensitive and red-sensitive silver halide emulsion layers containing couplers each having the relationship of complementary color, namely, couplers which color-develop in yellow, magenta and cyan, respectively.

The coupler used for formation of yellow color images includes, for example, acetoanilide type couplers, and, as the coupler for formation of magenta color images, for example, pyrazolone, pyrazolobenzimidazole, pyrazolotriazole or indazolone type couplers are known, and further, as the coupler for formation of cyan color images, for example, phenol or naphthol type couplers are generally used.

The dye images thus obtained are desired not to undergo any color change or color-fading even when exposed to light for a long period of time or preserved under the conditions of high temperature and high humidity. Also desired are those in which non-image portions of a color photographic material may not yellow by light, moisture or heat.

However, in the case of magenta couplers, yellow stain (or Y-stain) by light, at a non-image portion and color-fading by light, at a dye image portion are very largely caused as compared with those in the case of yellow couplers or cyan couplers, to often raise problems.

The coupler widely used for formation of magenta dye includes, for example, 1,2-pyrazol-5-on type couplers. It has been a serious problem that the magenta couplers of 1,2-pyrazol-5-on type have a secondary absorption at the vicinity of 430 nm in addition to a primary absorption at the vicinity of 550 nm, and therefore various studies have been made to solve such a problem.

A magenta coupler having an anilino group at the 3-position of the 1,2-pyrazol-5-on type coupler, which is small in the above-mentioned secondary absorption, is useful for obtaining, in particular, a color image for printing. This art is disclosed, for example, in U.S. Pat. No. 2,343,703, British Pat. No. 1,059,994, etc.

However, the above magenta couplers have a disadvantage that they are extremely poor in the image stability, in particular, the fastness to light of dye images, to suffer from Y-stain at a non-image portion.

As a means for decreasing the secondary absorption at the vicinity of 430 nm of the above magenta coupler, there have been proposed magenta couplers including, for example, pyrazolobenzimidazoles disclosed in British Pat. No. 1,047,612, indazolones disclosed in U.S. Pat. No. 3,770,447, and pyrazolotriazoles disclosed in U.S. Pat. No. 3,725,067, British Pat. Nos. 1,252,418 and 1,334,515, Japanese Unexamined Patent Publications Nos. 162548/1984 and 171956/1984, etc. The dyes formed through these couplers shows extremely smaller secondary absorption at the vicinity of 430 nm than the dyes formed through the 1,2-pyrazol-5-on type coupler do, and thus, they are desirable from the viewpoint of the color reproducibility, and also they are advantageous in that they are desirably very little liable to generation of Y-stain at a non-image portion against light, heat and humidity.

However, in general, the azomethine dye to be formed through the magenta couplers of pyrazolotriazole type have very low fastness to light to seriously damage the performances of a color photographic material, in particular, a color photographic material for print, and therefore have not put into practical use in color photographic materials for print.

Japanese Unexamined Patent Publication also proposes a technique for improving the fastness to light of a magenta dye image obtained from 1H-pyrazolo-[3,2-C]-s-triazole type magenta coupler by using 1H-pyrazolo-[3,2-C]-s-triazole type magenta coupler in combination with a phenol type compound or a phenol ether type compound. However, even the above technique can not be said to be sufficient for preventing the color-fading of the above magenta dye image against light, and, moreover, has been recognized to have almost no capability to prevent the color-fading by light.

The above pyrazolotriazole type magenta coupler has also a tendency that the gradation may become soft particularly at the toe portion in the Density-Log Exposure Curve, as compared with the conventional 1,2-pyrazol-5-on type couplers.

For this reason, when applied in a color photographic material, the balance in the gradation at a red-sensitive layer, a green-sensitive layer and a blue-sensitive layer may be lost to make the magenta color liable to be conspicuous at the highlight portion. For this reason, in photographic materials for color print, the so-called highlight pink phenomenon may occur, in which, for example, the sky and the cloud look pinky, and also the snow looks not white but pinky. Eyes of a human can distinguish such delicate changes particularly at a low density portion and judge the finish of a color print to be undesirable.

Accordingly, in designing a color photographic material, enormous efforts are wasted to take the balance in the three layers particularly at the low density portion.

Thus, the phenomenon that the toe portion is made to have soft gradation by the above pyrazolotriazole type magenta coupler may cause an extreme decrease in the value of goods due to the highlight pink tendency, to give a defect that can be not overly said to be fatal.

There have been hitherto made various studies on the method for controlling the gradation of light-sensitive silver halide photographic materials.

For example, the methods generally used may include a method in which the amount of silver halide to be applied is increased or decreased, the amount of couplers to be applied is increased or decreased, and the proportion of the amount of silver halide to be applied, to the amount of couplers to be applied is varied; a method in which two or more kinds of silver halide emulsions having different grain size and sensitized by different methods are mixed, as disclosed, for example, in Japanese Unexamined Patent Publications Nos. 71320/1975, 44016/1978, 78831/1981, 58137/1982, 150841/1982, 178235/1982, 14829/1973, etc.; further, as a method generally used, a method in which conditions and additives are selected in the manner that the toe portion can be made hard when silver halide grains are chemically sensitized or color sensitized; and still further, a method in which a water soluble rhodium salt is added when silver halide grains are formed, as disclosed, for example, in Japanese Unexamined Patent Publications Nos. 11029/1977 and 18310/1977, British Pat. No. 1,535,016, U.S. Pat. No. 3,448,709, etc.

In these methods, however, not only the gradation at the toe portion is made hard as intended, but also the gradation at the shoulder portion is made hard, or the gradation may be made soft during the preservation with time lapse, or other photographic performances, for example, sensitivity, fog, exposure characteristics, etc. may be adversely affected. Thus, in the present state, there has not been found in the conventional techniques any effective means such that the gradation only at the toe portion is made hard without any influence to other performances.

On the other hand, a surface active agent is generally used when magenta couplers are dispersed in a silver halide emulsion layer. However, the above pyrazolotriazole type magenta coupler has very poor dispersion stability to adversely affect the photographic performances.

Under such circumstances, it has been sought after to give a light-sensitive silver halide photographic material utilizing the above-mentioned excellent properties of the pyrazolotriazole type magenta coupler, having good dispersion stability of the magenta coupler, and moreover improved in the image stability, the toe portion gradation and the stain.

SUMMARY OF THE INVENTION

This invention has been made taking account of the above problems, and a first object of this invention is to provide a light-sensitive silver halide photographic material having good dispersion stability of the magenta coupler, having excellent color reproducibility, and moreover remarkably improved in the fastness to light of a magenta dye image.

A second object of this invention is to provide a light-sensitive silver halide photographic material having solved the problem of the softness in the gradation at the toe portion, which is a defect of the above pyrazolotriazole type magenta coupler.

A third object of this invention is to provide a light-sensitive silver halide photographic material having prevented the generation of magenta stain (M-stain) at a non-image portion.

The above objects of this invention can be achieved by a light-sensitive silver halide photographic material having at least one silver halide emulsion layer on a support, wherein at least one layer of said silver halide emulsion layer contains a magenta coupler represented by General Formula (I) shown below and a compound represented by General Formula (1) shown below.

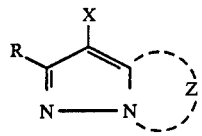

General Formula (I)

wherein Z represents a group of nonmetal atoms necessary for formation of a nitrogen-containing heterocyclic ring; said ring formed by Z may have a substituent; X represents a hydrogen atom or a substituent eliminable through the reaction with an oxidized product of a color developing agent; and R represents a hydrogen atom or a substituent.

General Formula (1)

$$R^1-(-O-)_n-SO_3M$$

wherein $R^1$ represents an alkyl group; M represents a hydrogen atom or a cation; and n represents 0 or 1.

DETAILED DESCRIPTION OF THE INVENTION

This invention will be described below in detail.

In the magenta coupler according to this invention, represented by General Formula (I);

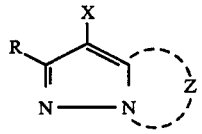

General Formula (I)

Z represents a group of nonmetal atoms necessary for formation of a nitrogen-containing heterocyclic ring; said ring formed by Z may have a substituent.

X represents a hydrogen atom or a substituent eliminable through the reaction with an oxidized product of a color developing agent.

And, R represents a hydrogen atom or a substituent.

The substituent represented by the above R may include, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyl group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The halogen atom may include, for example, a chlorine atom and a bromine atom. Particularly preferred is a chlorine atom.

The alkyl group represented by R may preferably be those having 1 to 32 carbon atoms; the alkenyl group and the alkynyl group, each having 2 to 32 carbon atoms; the cycloalkyl group and the cycloalkenyl group, each having 3 to 12 carbon atoms, particularly 5 to 7 carbon atoms. The alkyl group, the alkenyl group and the alkynyl group each may be of straight chain structure or branched structure.

Also, these alkyl group, alkenyl group, alkynyl group, cycloalkyl group and cycloalkenyl group each may have a substituent including, for example, an aryl, a cyano, a halogen atom, a heterocyclic ring, a cycloalkyl, a cycloalkenyl, a spiro compound residual group, a bridged hydrocarbon compound residual group, and besides these, those which are substituted through a carbonyl group such as an acyl, a carboxyl, a carbamoyl, an alkoxycarbonyl and an aryloxycarbonyl, and those which are substituted through a hetero atom {specifically, those which are substituted through an oxygen atom such as a hydroxyl, an alkoxy, an aryloxy, a heterocyclic oxy, a siloxy, an acyloxy and a carbamoyloxy, those which are substituted through a nitrogen atom such as a nitro, an amino (including a dialkylamino, etc.), a sulfamoylamino, an alkoxycarbonylamino, an aryloxycarbonylamino, an acylamino, a sulfonamide, an imide and a ureido, those which are substituted through a sulfur atom such as an alkylthio, an arylthio, a heterocyclic thio, a sulfonyl, a sulfinyl and a sulfamoyl and those which are substituted through a phosphorus atom such as phosphonyl, etc}.

More specifically, they include, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a tri-fluoromethyl group, a 1-ethoxytridecyl group, a 1-methoxyisopropyl group, an ethyl methanesulfonyl group, a methyl 2,4-di-t-amylfenoxy group, an anilino group, a 1-phenylisopropyl group, a 3-m-butanesulfonaminophenoxypropyl group, a 3-4'-{α-[4''(p-hydroxybenzenesulfonyl)phenoxy]-dodecanoylamino}phenylpropyl group, a 3-{4'-[α-(2'',4''-di-t-amylphenoxy)butanamide]phenyl}propyl group, a 4-[α-(o-chlorophenoxy)tetradecanamidophnoxy]propyl group, an allyl group, a cyclopentyl group, a cyclohexyl group, etc.

The aryl group repesented by R is preferably a phenyl group, and may have a substitutent (for example, an alkyl group, an alkoxy group, an acylamino group, etc.).

More specifically, it may include a phenyl group, a 4-t-butylphenyl group, a 2,4-di-t-amylphenyl group, a 4-tetradecanamidophenyl group, a hexadicycloxyphenyl group, a 4'-[α-(4''-t-butylphenoxy]tetradecanamido)phenyl group, etc.

The heterocyclic group represented by R is preferably one having 5- to 7-members, which may be substituted or condensated. More specifically, it may include a 2-furyl group, a 2-thienyl group, a 2-pyrimidinyl group, a 2-benzothiazolyl group, etc.

The acyl group represented by R may include, for example, alkylcarbonyl groups such as an acetyl group, a phenyl acetyl group, a dodecanoyl group and an α-2,4-di-t-amylphenoxybutanoyl group; arylcarbonyl groups such as a benzoyl group, a 3-pentadecyloxybenzoyl group and a p-chlorobenzoyl group; etc.

The sulfonyl group represented by R may include alkylsulfonyl groups such as a methylsulfonyl group and a dodecylsulfonyl group; arylsufonyl groups such as a benzenesulfonyl group and a p-toluenesulfonyl group; etc.

The sulfinyl group represented by R may include alkylsulfinyl groups such as an ethylsulfinyl group, an octylsulfinyl group and a 3-phenoxybutylsulfinyl group; arylsulfinyl groups such as a phenylsulfinyl group, a m-pentadecylphenylsulfinyl group; etc.

The phosphonyl group represented by R may include alkylsulfonyl groups such as a butyloctylphosphonyl group, alkoxyphosphonyl groups such as an octyloxyphosphonyl group, aryloxyphosphonyl groups such as a phenoxyphosphonyl group, arylphosphonyl groups such as a phenylphosphonyl group, etc.

The carbamoyl group represented by R may be substituted with an alkyl group, an aryl group (preferably, a phenyl group), etc., and may include, for example, an N-methylcarbamoyl group, an N,N-dibutylcarbamoyl group, an N-(ethyl 2-pentadecyloctyl)carbamoyl group, an N-ethyl-N-dodecylcarbamoyl group, an N-{3-(2,4-di-t-amylphenoxy)propyl}carbamoyl group, etc.

The sulfamoyl group represented by R may be substituted with an alkyl group, an aryl group (preferably a phenyl group), etc., and may include, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group, etc.

The spiro compound residual group represented by R may include, for example, spiro[3.3]heptan-1-yl, etc.

The bridged hydrocarbon compound residual group may include, for example, bicyclo[2.2.1]heptan-1-yl, tricyclo[3.3.1.1$^{3,7}$]decan-1-yl, 7,7-dimethyl-dibicyclo[2.2.1]heptan-1-yl, etc.

The alkoxy group represented by R may be further substituted with those mentioned as the substituents for the above alkyl group, and may include, for example, a methoxy group, a propoxy group, a 2-ethoxyethoxy group, a pentadecyloxy group, a 2-dodecyloxyethoxy group, a phenethyloxyethoxy group, etc.

The aryloxy group represented by R is preferably a phenyloxy, wherein the aryl nucleus may be further substituted with those mentioned as the substituents for the above aryl group, and may include, for example, a phenoxy group, a p-t-butylpohenoxy group, a m-pentadecylphenoxy group, etc.

The heterocyclic oxy group represented by R is preferably one having 5- to 7-members, wherein the heterocyclic ring may further have a substituent, and may include, for example, a 3,4,5,6-tetrahydropyranyl-2-oxy group, a 1-phenyltetrazole-5-oxy group, etc.

The siloxy group represented by R may further be substituted with an alkyl group, etc., and may include, for example, a trimethylsiloxy group, a triethylsiloxy group, a dimethylbutylsiloxy group, etc.

The acyloxy group represented by R may include, for example, an alkylcarbonyloxy group, an arylcarbonyloxy group, etc., and may further have a substitutent to include, specifically, an acetyloxy group, an α-chloroacetyloxy group, a benzoyloxy group, etc.

The carbamoyloxy group represented by R may be substituted with an alkyl group, an aryl group, etc., and may include, for example, an N-ethylcarbamoyloxy group, an N,N-diethylcarbamoyloxy group, an N-phenylcarbamoyloxy group, etc.

The amino group represented by R may be substituted with an alkyl group, an aryl group (preferably, a phenyl group), and may include, for example, an ethylamino group, an anilino group, a m-chloroanilino group, a 3-pentadecyloxycarbonylanilino group, a 2-chloro-5-hexadecanamidoanilino group, etc.

The acylamino group represented by R may include an alkylcarbonylamino group, an arylcarbonylamino group (preferably, a phenylcarbonylamino group), etc., and may further have a substituent to include, specifically, an acetoamide group, an α-ethylpropaneamide group, an N-phenylacetoamide group, a dodecanamide group, a 2,4-di-t-amylphenoxyacetoamide group, an α-3-t-butyl-4-hydroxyphenoxybutaneamide group, etc.

The sulfonamide group represented by R may include an alkylsulfonylamino group, an arylsulfonylamino group, and may further have a substituent. It specifically may include, a methylsulfonylamino group, a pentadecylsulfonylamino group, a benzenesulfonamide group, a p-toluensulfonamide, a 2-methoxy-5-t-amylbenzenesulfonamide group, etc.

The imide group represented by R may be of open chain structure or cyclic structure, or may have a substituent to include, for example, a succinimide group, a 3-heptadecylsuccinimide, a phthalimide group, a glutalimide group, etc.

The ureido group represented by R may be substituted with an alkyl group, an aryl group (preferably, a phenyl group), etc., and may include, for example, an N-ethylureido group, an N-ethyl-N-decylureido group, an N-phenylureido group, an N-p-tolylureido group, etc.

The sulfamoylamino group represented by R may be substituted with an alkyl group or an aryl group (preferably, a phenyl group), etc., and may include, for example, an N,N-dibutylsulfamoylamino group, an N-methylsulfamoylamino group, an N-phenylsulfamoylamino group, etc.

The alkoxycarbonylamino group represented by R may further have a substituent, and may include, for example, a methoxycarbonylamino group, a methoxyethoxycarbonylamino group, an octadecyloxycarbonylamino group, etc.

The aryloxycarbonylamino group represented by R may have a substituent, and may include, for example, a phenoxycarbonylamino group, a 4-methylphenoxycarbonylamino group, etc.

The alkoxycarbonyl group represented by R may further have a substituent, and may include, for example, a methoxycarbonyl group, a butyloxycarbonyl group, a dodecyloxycarbonyl group, an octadecyloxycarbonyl group, an ethoxymethoxycarbonyloxy group, a benzyloxycarbonyl group, etc.

The aryloxycarbonyl group represented by R may further have a substituent, and may include, for example, a phenoxycarbonyl group, a p-chlorophenoxycarbonyl group, an m-pentadecyloxyphenoxycarbonyl group, etc.

The alkylthio group represented by R may further have a substituent, and may include, for example, an ethylthio group, a dodecylthio group, an octadecylthio group, a phenethylthio group, a 3-phenoxypropylthio group, etc.

The arylthio group represented by R is preferably a phenylthio group which may further have a substituent, and may include, for example, a phenylthio group, a p-methoxyphenylthio group, a 2-t-octylphenylthio group, a 3-octadecylphenylthio group, a 2-carboxyphenylthio group, a p-acetoaminophenylthio group, etc.

The heterocyclic thio group represented by R is preferably a heterocyclic thio group of 5 to 7 members, and may further have a condensed ring or may have a substituent. It may include, for example, a 2-pyridylthio group, a 2-benzothiazolylthio group, a 2,4-diphenoxy-1,3,5-triazole-6-thio group, etc.

The substituent represented by X, which is eliminable through the reaction with an oxidized product of a color developing agent, may include, for example, a halogen atom (such as a chlorine atom, a bromine atom and a fluorine atom), and also groups which are substituted through a carbon atom, an oxygen atom, a sulfur atom or a nitrogen atom.

The groups which are substituted through a carbon atom may include a carboxyl group, and also, for example, a group represented by the general formula:

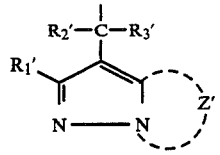

wherein R' is same as defined for the above R, Z' is same as defined for the above Z; and $R^{2'}$ and $R^{3'}$ each represent a hydrogen atom, an aryl group, an alkyl group or a heterocyclic group, a hydroxymethyl group and a triphenylmethyl group.

The groups which are substituted through an oxygen atom may include, for example, an alkoxy group, aryloxy group, heterocyclic oxy group, an acyloxy group, a sulfonyloxy group, an alkoxycarbonyloxy group, an aryloxycarbonyloxy group, an alkyloxaryloxy group, an alkoxyoxaryloxy group, etc.

The above alkoxy group may further have a substituent including, for example, an ethoxy group, a 2-phenoxyethoxy group, 2-cyanoethoxy group, a phenethyloxy group, a p-chlorobenzyloxy group, etc.

The above aryloxy group is preferably a phenoxy group, and the aryl group may further have a substituent. More specifically, it may include a phenoxy group, a 3-methylphenoxy group, a 3-dodecylphenoxy group, a 4-methanesulfonamidephenoxy group, a 4-[α-(3'-pentadecylphenoxy)butanamido]phenoxy group, a hexadecylcarbamoylmethoxy group, a 4-cyanophenoxy group, a 4-methanesulfonylphenoxy group, a 1-naphthyloxy group, a p-methoxyphenoxy group, etc.

The above heterocyclic oxy group is preferably a heterocyclic oxy group of 5 to 7 members, or may be of condensed ring, or may have a substituent. Specifically, it may include a 1-phenyltetrazolyloxy group, a 2-benzothiazolyloxy group, etc.

The above acyloxy group may include, for example, alkylcarbonyloxy groups such as an acetoxy group and butanoloxy group, and alkenylcarbonyloxy groups such as a cinnamoyloxy group, and arylcarbonyloxy groups such as a benzoyloxy group.

The above sulfonyloxy group may include, for example, a butanesulfonyloxy group and methanesulfonyloxy group.

The above alkoxycarbonyloxy group may include, for example, an ethoxycarbonyloxy group and a benzyloxycarbonyoxy group.

The above aryloxycarbonyloxy group may include a phenoxycarbonyloxy group, etc.

The above alkyloxalyloxy group may include, for example, a methyloxalyloxy group.

The above alkoxyoxalyloxy group may include an ethoxyoxalyloxy group, etc.

The group which is substituted through a sulfur atom may include, for example, an alkylthio group, an arylthio group, a heterocyclic thio group and an alkyloxythiocarbonylthio group.

The above alkylthio group may include a butylthio group, a 2-cyanoethylthio group, a phenethylthio group, a benzylthio group, etc.

The above arylthio group may include a phenylthio group, a 4-methanesulfonamidephenylthio group, a 4-dodecylphenethylthio group, a 4-nonafluoropentanamidephenythylthio group, a 4-carboxyphenylthio group, a 2-ethoxy-5-t-butylphenylthio group, etc.

The above heterocyclic thio group may include, for example, a 1-phenyl-1,2,3,4-tetrazolyl-5-thio group, a 2-benzothiazolylthio group, etc.

The above alkyloxythiocarbonylthio group may include a dodecyloxythiocarbonylthio group, etc.

The group which is substituted through a nitrogen atom may include, for example, a group represented by the general formula:

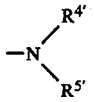

In this formula, $R^{4'}$ and $R^{5'}$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group, and $R^{4'}$ and $R^{5'}$ may be bonded to each other to form a heterocyclic ring, provided that $R^{4'}$ and $R^{5'}$ each are not a hydrogen atom at the same time.

The above alkyl group may be of straight chain or branched one, and is preferably one having 1 to 22 carbon atoms. Also, this alkyl group may have a substituent which may include, for example, an aryl group, an alkoxy group, an aryloxy group, an alkylthio group, an arylthio group, an alkylamino group, arylamino group, an acylamino group, a sulfonamide group, an imino group, an acyl group, an alkylsulfonyl group, an arylsulfonyl group, a carbamoyl group, a sulfamoyl group, an alkoxycarbonyl group, an alkyloxycarbonylamino group, an aryoxycarbonylamino group, a hydroxyl group, a carboxyl group, a cyano group and a halogen atom. The alkyl group may specifically include, for example, an ethyl group, an octyl group, a 2-ethylhexyl group and 2-chloroethyl group.

The aryl group represented by $R^{4'}$ or $R^{5'}$ is preferably one having 6 to 32 carbon atoms, in particular, a phenyl group and a naphthyl group, wherein the aryl group may have a substituent which may include those mentioned as the substituents for the alkyl group represented by the above $R^{4'}$ or $R^{5'}$. This aryl group may specifically include, for example, a phenyl group, a 1-naphthyl group and a 4-methylsulfonylphenyl group.

The heterocyclic group represented by $R^{4'}$ or $R^{5'}$ is preferably of 5 to 6 members, or may be of condensed ring, or may have a substituent. Specifically, it may include a 2-furyl group, a 2-quinolyl group, a 2-pyrimidyl group, a 2-benzothiazolyl group, a 2-pyridyl group, etc.

The sulfamoyl group represented by $R^{4'}$ or $R^{5'}$ may include an N-alkylsulfamoyl group, an N,N-dialkylsulfamoyl group, N-arylsulfamoyl group, an N,N-diarylsufamoyl group, etc., and the alkyl group and the aryl group of these may have the substituent mentioned for the above alkyl group and aryl group. The sulfamoyl group may specifically include, for example, an N,N-diehtylsulfamoyl group, an N-methylsulfamoyl group, N-dodecylsulfamoyl group and an N-p-tolylsulfamoyl group.

The carbamoyl group represented by $R^{4'}$ or $R^{5'}$ may include an N-alkylcarbamoyl group, an N,N-dialkylcarbamoyl group, an N-arylcarbamoyl group, an N,N-diarylcarbamoyl group, etc., and the alkyl group and the aryl group of these may have the substituent mentioned for the above alkyl group and aryl group. The carbamoyl group may specifically include, for example, an N,N-diethylcarbamoyl group, an N-methylcarbamoyl group, an N-dodecylcarbamoyl group, N-p-cyanophenylcarbamoyl group and N-p-tolylcarbamoyl group.

The acyl group represented by $R^{4'}$ or $R^{5'}$ may include, for example, an alkylcarbonyl group, an arylcarbonyl group and a heterocyclic carbonyl group, and the alkyl group, the aryl group and the heterocyclic group each may have a substituent. The acyl group may specifically include, for example, a hexafluorobutanoyl group, 2,3,4,5,6-pentafluorobenzoyl group, an acety group, a benzoyl group, a naphthoel group, a 2-furylcarbonyl group, etc.

The sulfonyl group represented by $R^{4'}$ or $R^{5'}$ may include an alkylsulfonyl group, an arylsulfonyl group and a heterocyclic sulfonyl group, and may have a substituent. Specifically, it may include, for example, an ethanesulfonyl group, a benzenesulfonyl group, an octanesulfonyl group, a naphthalenesulfonyl group, a p-chlorobenzenesulfonyl group, etc.

The aryloxycarbonyl group represented by $R^{4'}$ or $R^{5'}$ may have as a substituent those mentioned for the above aryl group. Specifically, it may include a phenoxycarbonyl group, etc.

The alkoxycarbonyl group represented by $R^{4'}$ or $R^{5'}$ may have the substituent mentioned for the above alkyl group, and specifically may include a methoxycarbonyl group, a dodecyloxycarbonyl group, a benzyloxycarbonyl group, etc.

The heterocyclic ring to be formed by bonding of $R^{4'}$ and $R^{5'}$ is preferably of 5 to 6 members, and may be saturated or unsaturated, may be aromatic or non-aromatic, or may be of a condensed ring. This heterocyclic ring may include, for example, an N-phthalimide group, an N-succinimide group, a 4-N-urazolyl group, a 1-N-hydantoinyl group, 3-N-2,4-dioxooxazolydinyl group, a 2N-1,1-dioxo-3-(2H)-oxo-1,2-benzthiazolyl group, a 1-pyrolyl group, a 1-pyrolidinyl group, a 1-pyrazolyl group, a 1-pyrazolydinyl group, a 1-pipelidinyl group, a 1-pyrolinyl group, a 1-imidazolyl group, a 1-imidazolinyl group, a 1-indolyl group, 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrrolidone group, a phthaladione group, a 2-oxo-1-piperidinyl group, etc., and these heterocyclic groups each may be substituted with an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imide group, a nitro group, a cyano group, a carboxyl group, a halogen atom, etc.

The nitrogen-containing heterocyclic ring to be formed by Z or Z' may include a pyrazole ring, an imidazole ring, a triazole ring, a tetrazole ring, etc., and the substituent which the above rings each may have include those mentioned for the above R.

When the substituents (for example, R, $R^1$ to $R^6$) on the heterocyclic rings in General Formula (I) and General Formulas (II) to (VIII) shown hereinbelow have a moiety of:

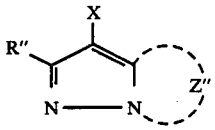

wherein R'', X and Z'' each have the same meaning as R, X, and Z in General Formula (I), a so-called bis-body type coupler is formed, which may be included in this invention as a matter of course. Also, on the rings formed by Z, Z', Z'' and the later-mentioned $Z^1$, other rings (for example, a cycloalkene of 5 to 7 members) may be further condensed. For instance, in General Formula (V), $R^5$ and $R^6$ may be, and, in General Formula (VI), $R^7$ and $R^8$ may be bonded to each other to form a ring (for example, a 5- to 7-membered cycloalkene, benzene).

The coupler represented by General Formula (I) may, more specifically, be represented, for example, by General Formulas (II) to (VII) shown below:

General Formula (II)

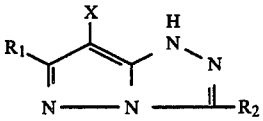

General Formula (III)

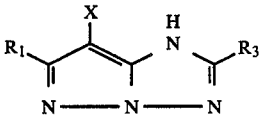

General Formula (IV)

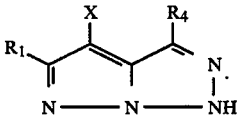

General Formula (V)

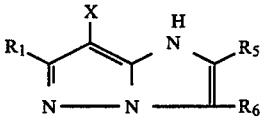

General Formula (VI)

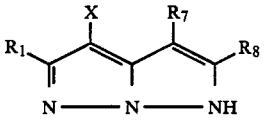

General Formula (VII)

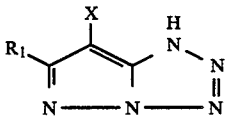

In the above General Formulas (II) to (VII), $R^1$ to $R^8$ and X each have the same meaning as R and X mentioned before.

Also, what is most preferable in General Formula (I) is one represented by General Formula (VIII) shown below:

General Formula (VIII)

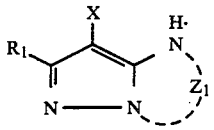

wherein $R^1$, X and $Z^1$ each have the same meaning as R, X and Z in General Formula (I).

Of the magenta couplers represented by the above General Formulas (II) to (VII), particularly preferred is the magenta coupler represented by General Formula (II).

As for the substituents on the heterocyclic rings in General Formula (I) to (VIII), it is preferable for R, in the case of General Formula (I), and for $R^1$, in the cases of General Formulas (II) to (VIII), to each satisfy the condition 1 shown below, and it is further preferable to satisfy the conditions 1 and 2 shown below, and it is particularly preferable to satisfy the conditions 1, 2 and 3 shown below:

Condition 1: A root atom directly bonded to the heterocyclic ring is a carbon atom.

Condition 2: Only one hydrogen atom is bonded to the above carbon atom, or not bonded thereto at all.

Condition 3: All of the bonds between the carbon atom and atoms adjoining thereto are in single bonding.

Substituents most preferable as the substituents R and $R^1$ in the above heterocyclic rings include those represented by the General Formula (IX) shown below:

General Formula (IX)

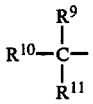

In the above formula, $R^9$, $R^{10}$ and $R^{11}$ each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclic thio group; and at least two of $R^9$, $R^{10}$ and $R^{11}$ are not hydrogen atoms.

Two substituents in the above $R^9$, $R^{10}$ and $R^{11}$, for example, $R^9$ and $R^{10}$, may be bonded to form a saturated or unsaturated ring (for example, a cycloalkane, a cycloalkene, a heterocyclic ring), or $R^{11}$ may be further bonded to this ring to form a residue of a bridged hydrocarbon compound.

The groups represented by $R^9$ to $R^{11}$ may have a substituent, and examples of the groups represented by $R^9$ to $R^{11}$ and the substituents these groups may have, may include the specific examples and the substituents mentioned for the group represented by R in General Formula (I).

Also, examples of the ring to be formed by bonding, for instance, of $R^9$ and $R^{10}$ and the residue of bridged hydrocarbon compound to be formed by $R^9$ to $R^{11}$, and also the substituents which this ring may have, may include the specific examples and the substituents mentioned for the cycloalkyl, the cycloalkenyl and the residue of heterocyclic bridged hydrocarbon compound which are represented by R in the above General Formula (I).

In General Formula (X), preferable are;

(i) the case where two of $R^9$ to $R^{11}$ are each an alkyl group; and (ii) the case where one of $R^9$ to $R^{11}$, for example, $R^{11}$ is a hydrogen atom, and the other two, $R^9$ and $R^{10}$ are bonded to form a cycloalkyl together with the carbon atoms at the root.

Further preferable in the case (i) is the case where two of $R^9$ to $R^{11}$ are each an alkyl group, and the other one is a hydrogen atom or an alkyl group.

Here, the alkyl and the cycloalkyl each may further have a substituent, and examples of the alkyl, the cycloalkyl and the substituents of these may include those for the alkyl, the cycloalkyl and the substituents of these which are represented by R in the above General Formula (I).

The substituents which the ring to be formed by Z in General Formula (I) and the ring to be formed by $Z^1$ in General Formula (VIII) may have, and the substituents $R^2$ to $R^8$ in General Formulas (II) to (VI), are preferably those represented by General Formula (X) shown below: General Formula (X)

$$-R^1-SO_2-R^2$$

wherein $R^1$ represents an alkylene group, $R^2$ represents an alkyl group, a cycloalkyl group or an aryl group.

The alkylene represented by $R^1$ preferably has 2 or more, and more preferably 3 to 6 carbon atoms at the straight chain portion, and may be of straight chain or branched structure. Also, this alkylene may have a substituent.

Examples of such substituent may include those shown as the substituents which the alkyl group when R in General Formula (I) may have.

Preferable substituents may include a phenyl.

Preferable examples for the alkylene represented by $R^1$ are shown below:

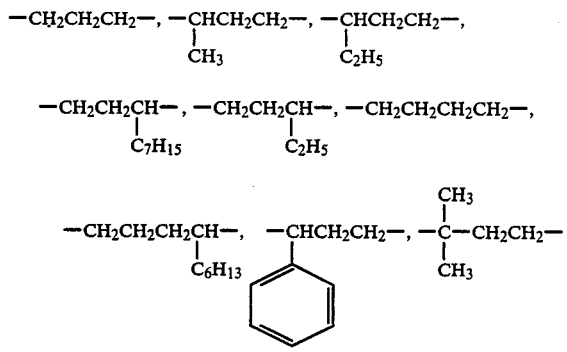

The alkyl group represented by $R^2$ may be of straight chain or branched structure. Specifically, it may include methyl, ethyl, propyl, iso-propyl, butyl, 2-ethylhexyl, octyl, dodecyl, tetradecyl, hexadecyl, octadecyl, 2-hexyldecyl, etc.

The cycloalkyl group represented by $R^2$ is preferably of 5 to 6 members, and may include, for example, a cyclohexyl group.

The alkyl group and the cycloalkyl group represented by $R^2$ may each have a substituent including, for example, those exemplified as the substituents for the above $R^1$.

The aryl group represented by $R^2$ may specifically include a phenyl group and a naphthyl group. The aryl group may have a substituent. Such a substituent may include, for example, a straight chain or branched alkyl group, and besides, those exemplified as the substituents for the above $R^1$.

Also, when there are two or more substituents, they may be the same or different substituents.

Particularly preferable in the compounds represented by General Formula (I) are those represented by General Formula (XI) shown below:

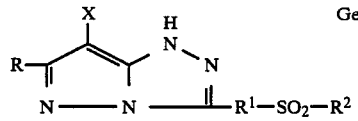

General Formula (XI)

wherein R and X each have the same meaning as R and X in General Formula (I), and $R^1$ and $R^2$ each have the same meaning as $R^1$ and $R^2$ in General Formula (X).

Specific examples of the compounds used in this invention are shown below:

1

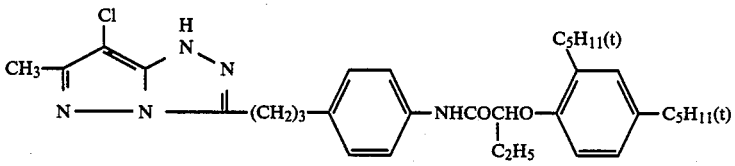

2

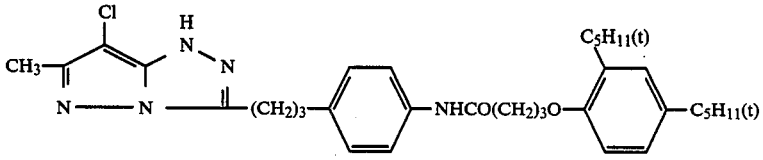

-continued
3
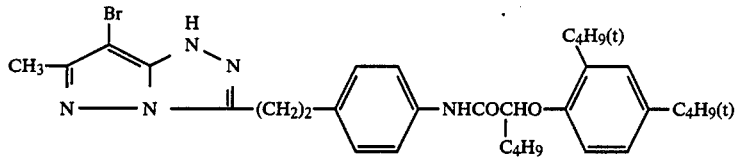
4
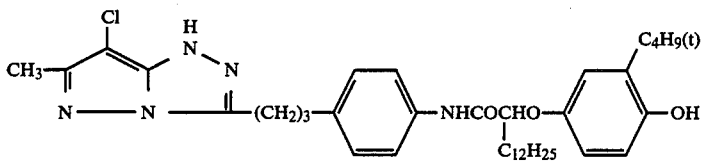
5
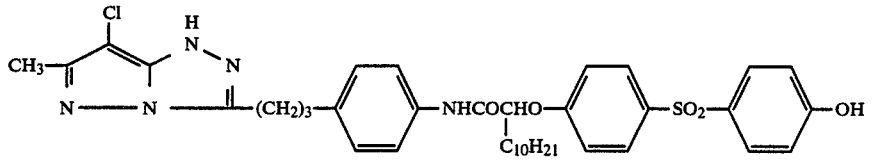
6
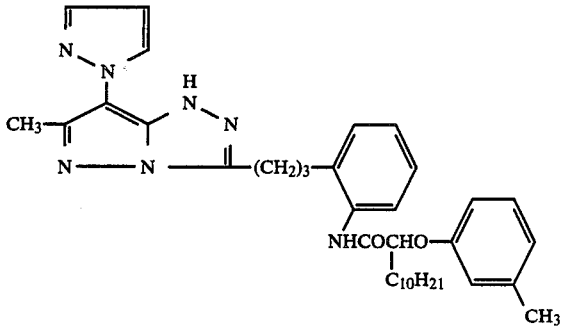
7
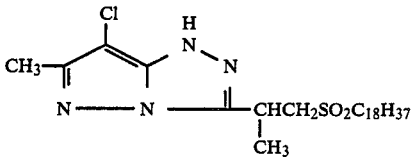
8
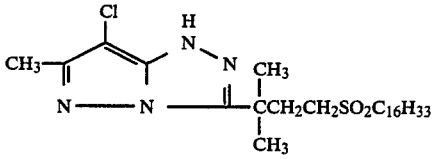
9
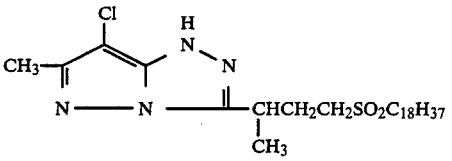
10
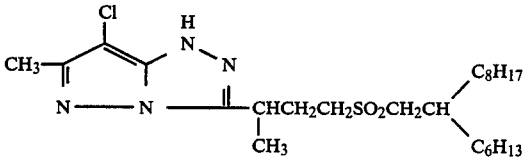
11
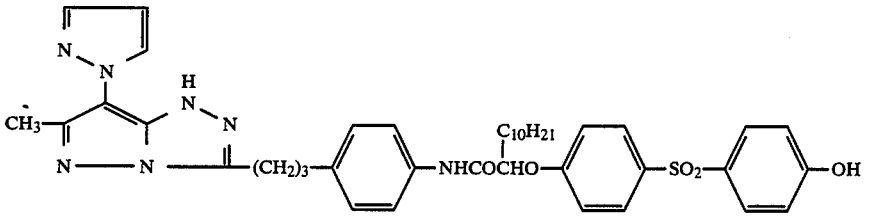
12
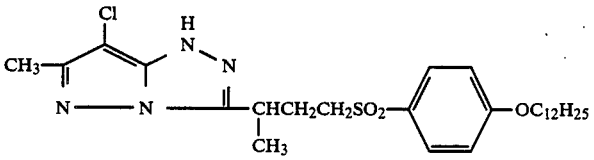

-continued
13
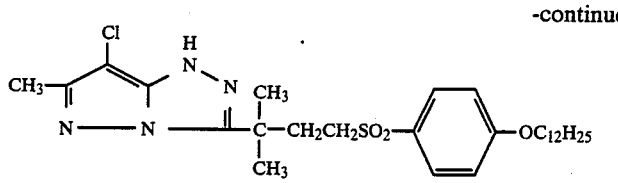
14
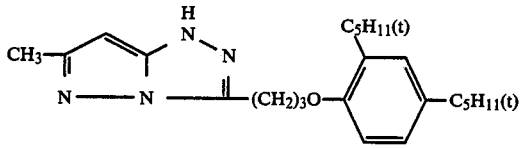
15
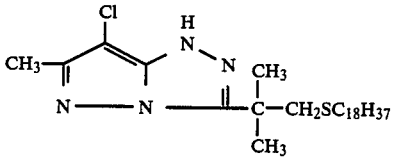
16
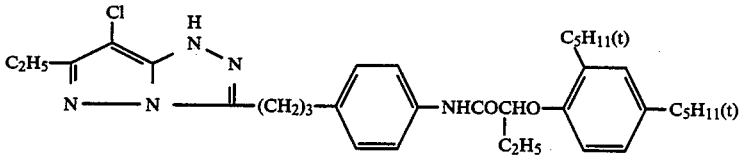
17
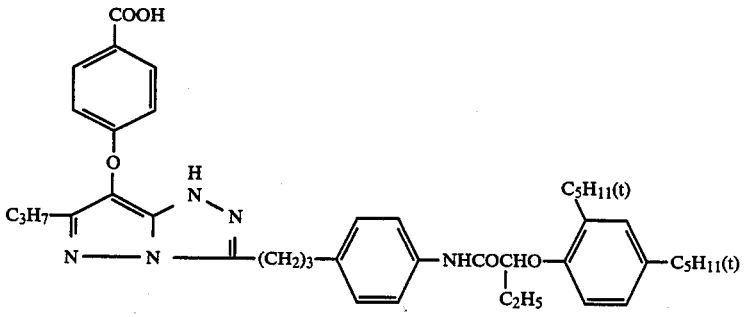
18
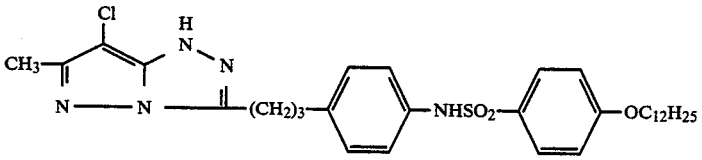
19
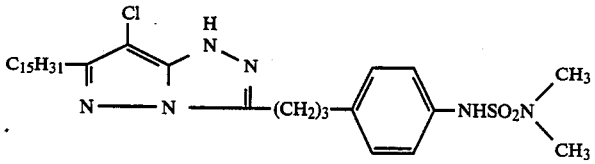
20
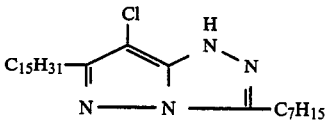
21
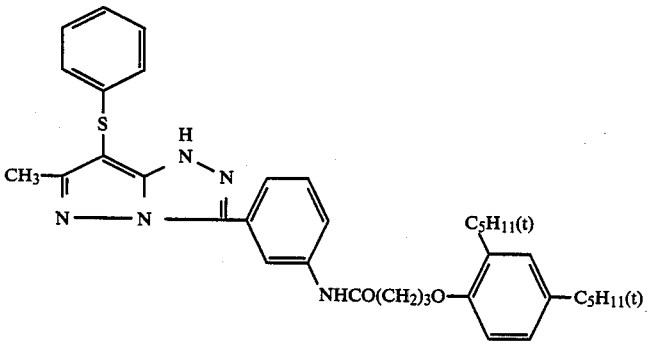
22
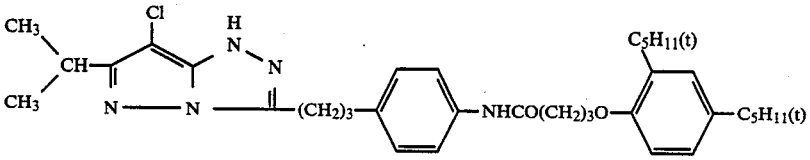

-continued
23
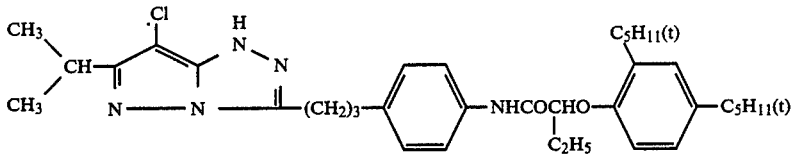
24
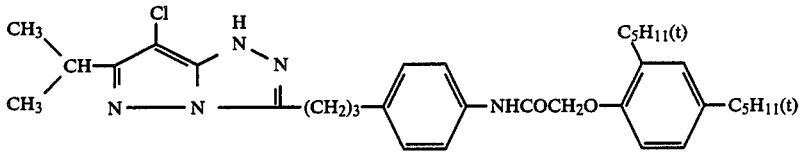
25
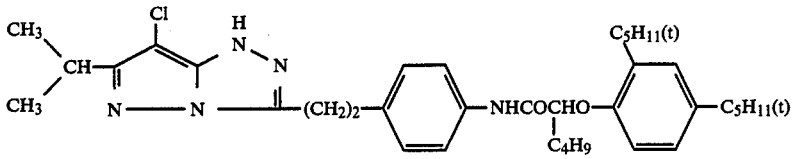
26
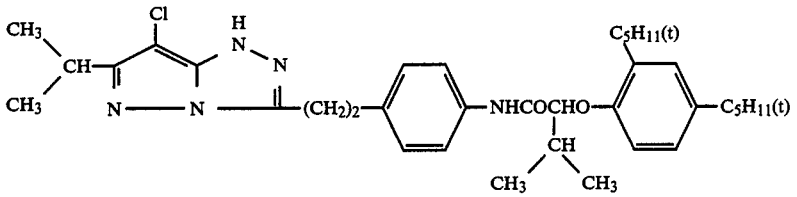
27
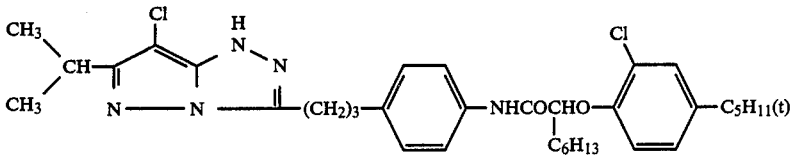
28
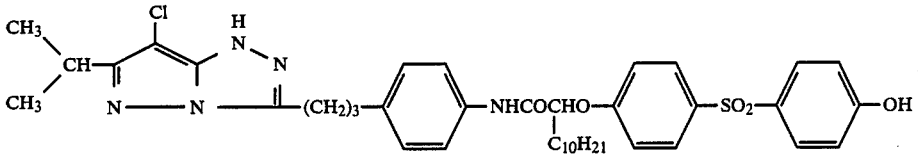
29
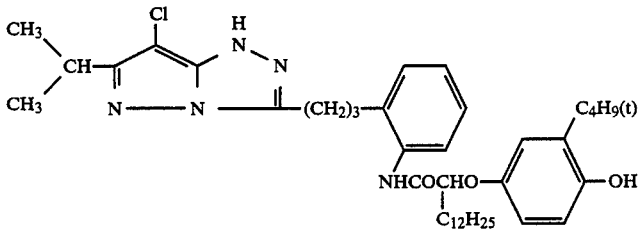
30
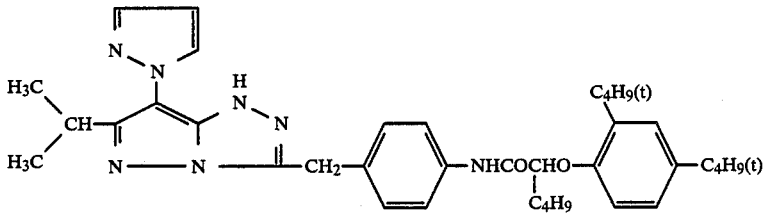
31
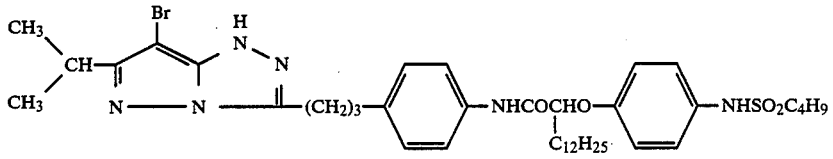

-continued
32
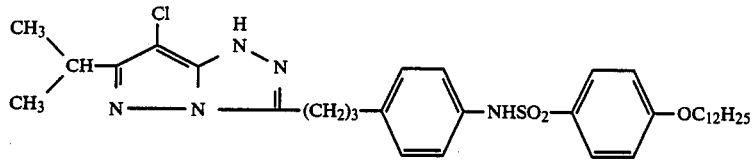
33
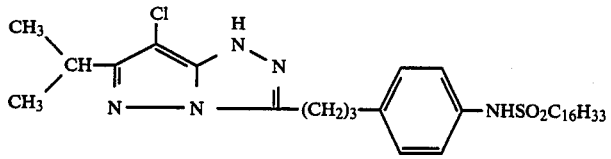
34
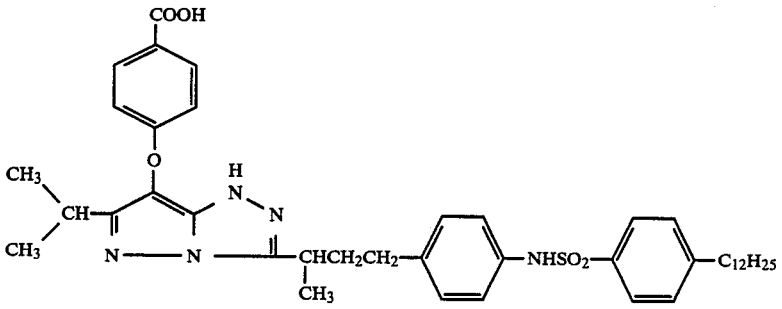
35
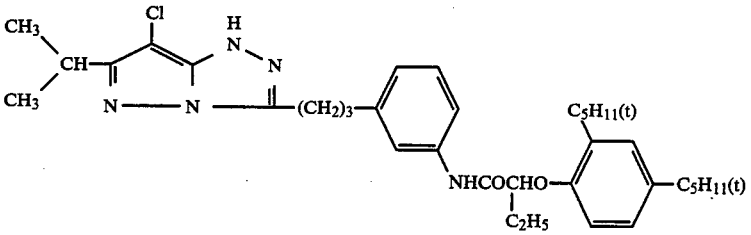
36
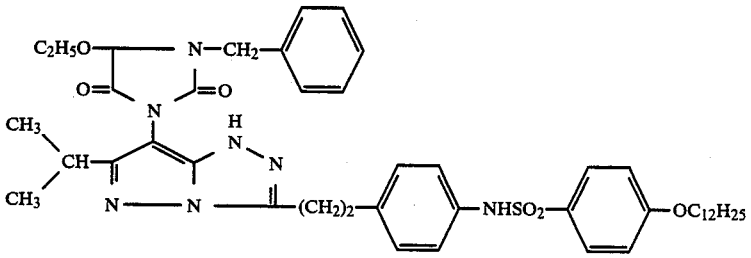
37
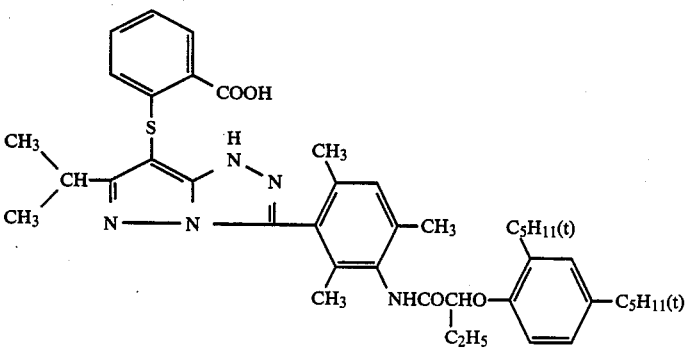

-continued
38
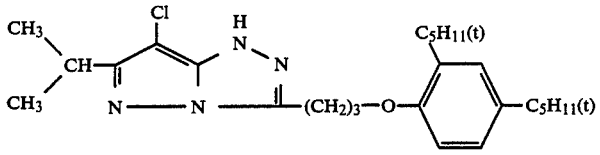
39
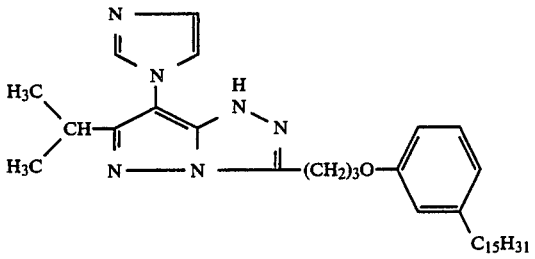
40
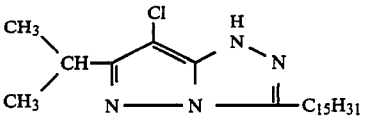
41
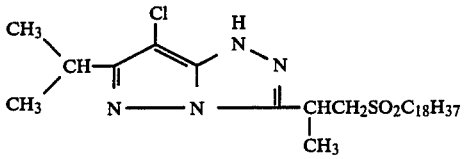
42
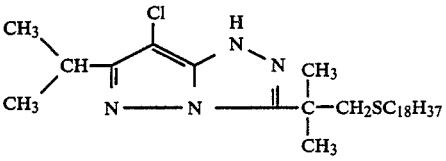
43
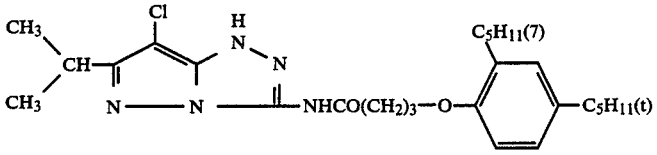
44
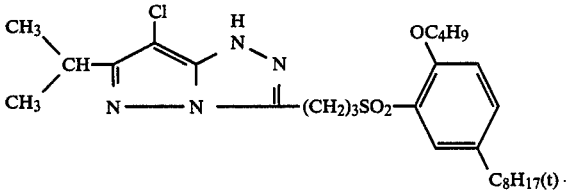
45
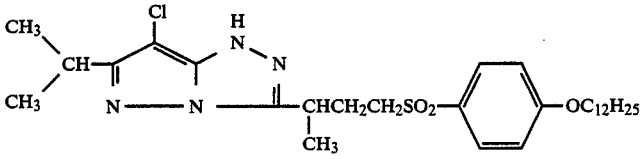
46
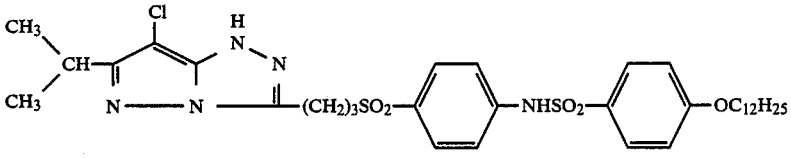
47
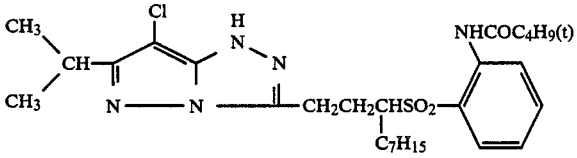
48
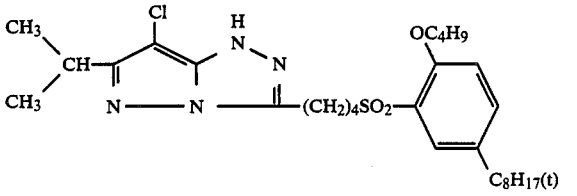

-continued
49
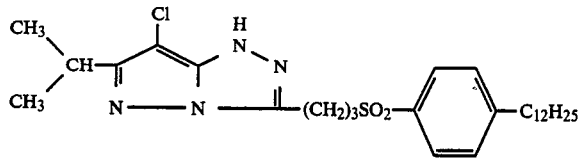
50
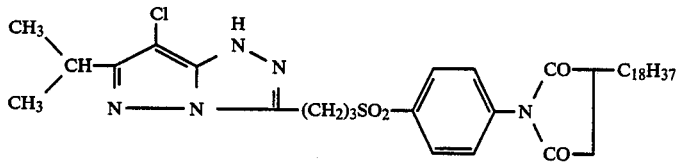
51
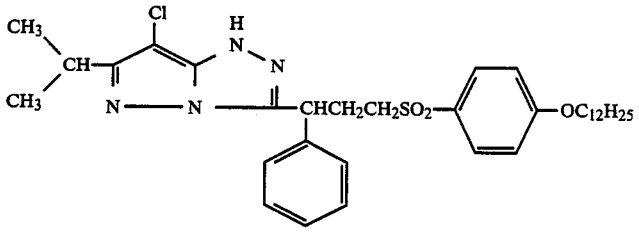
52
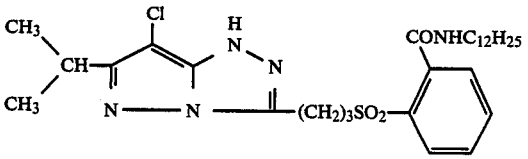
53
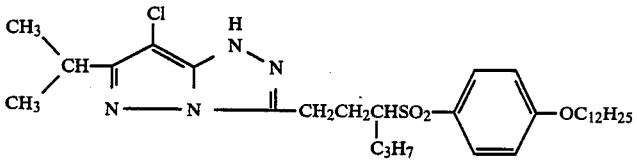
54
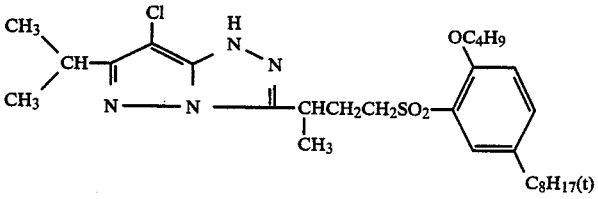
55
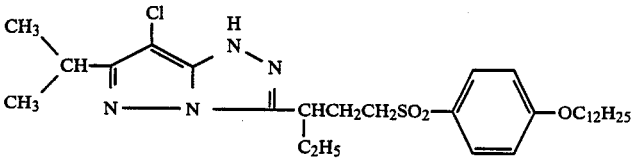
56
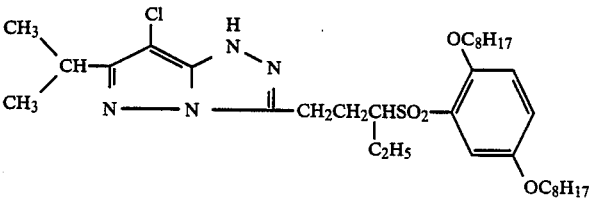

-continued
57
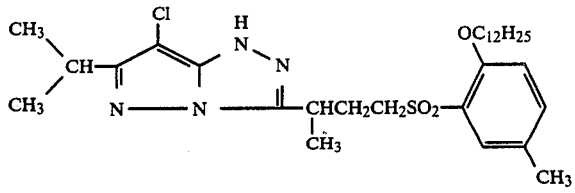
58
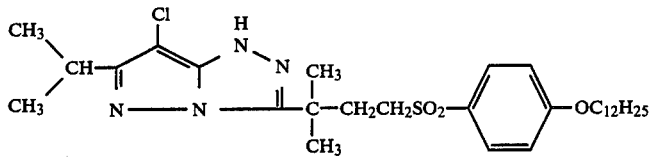
59
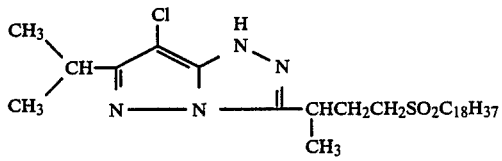
60
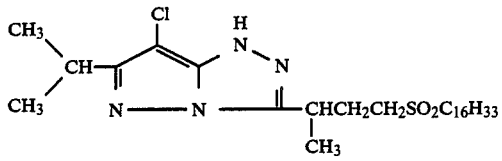
61
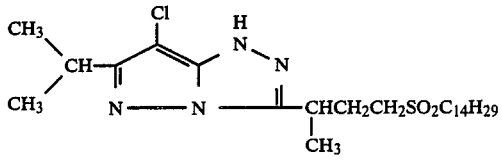
62
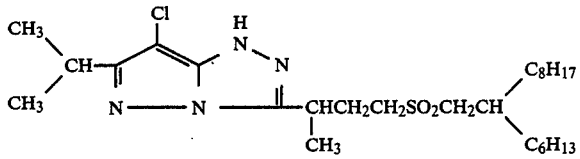
63
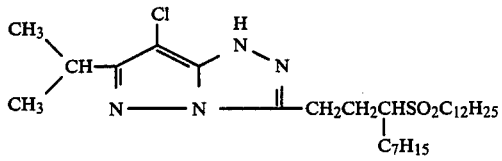
64
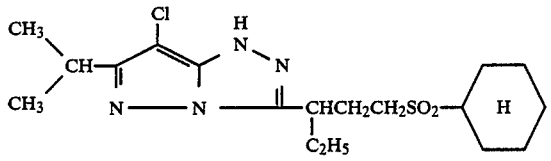
65
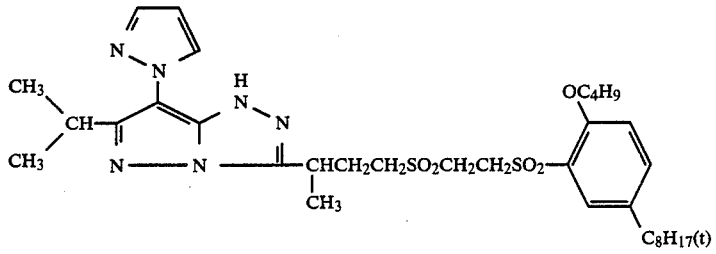

-continued
66
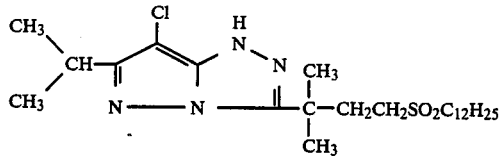
67
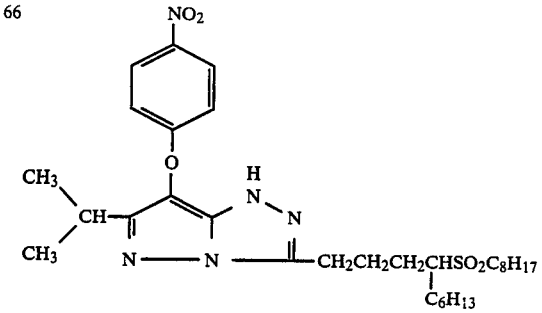
68
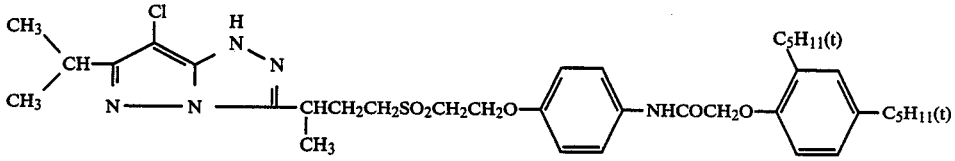
69
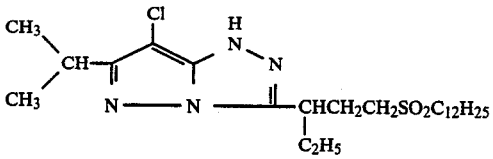
70
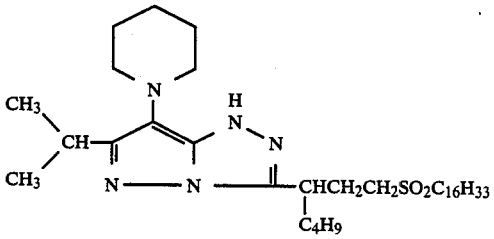
71
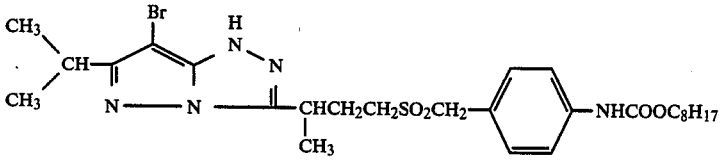
72
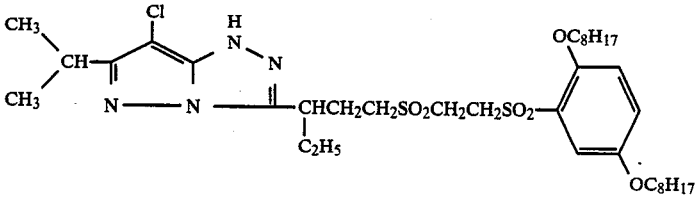
73
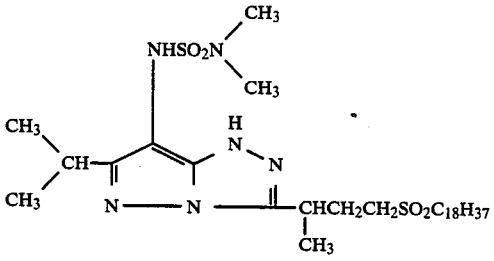
74
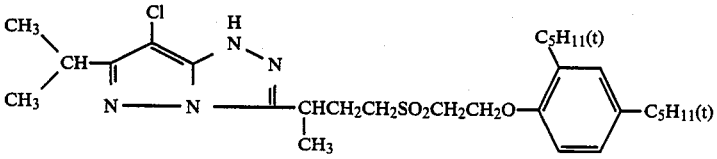

-continued
75
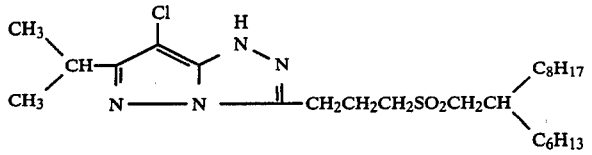
76
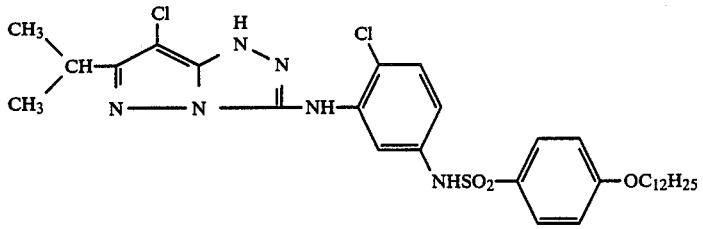
77
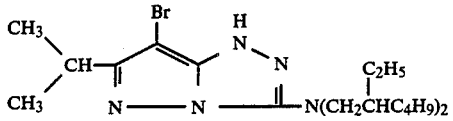
78
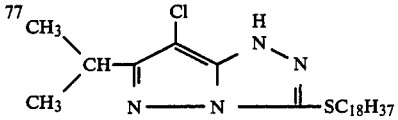
79
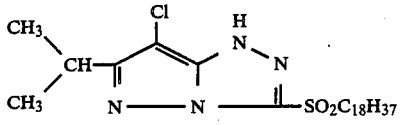
80
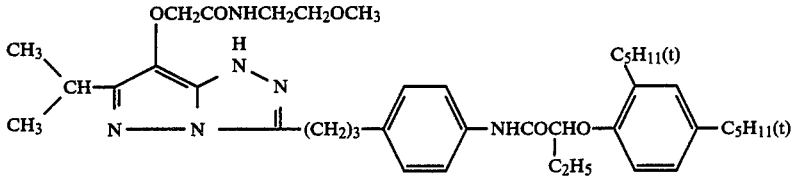
81
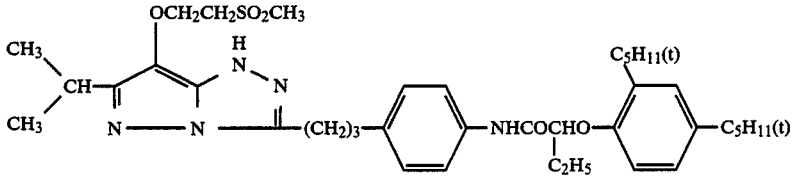
82
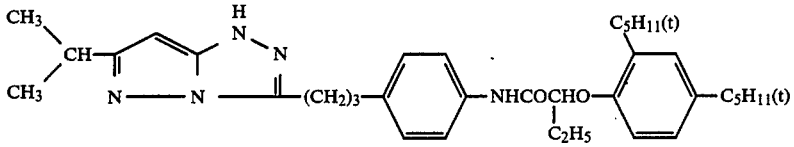
83
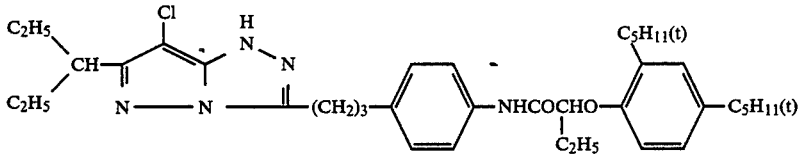
84
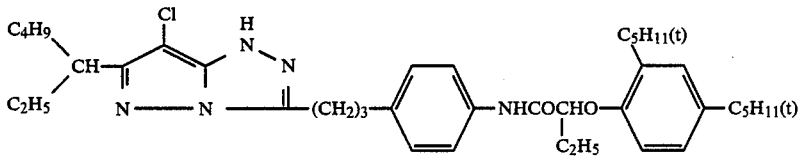

-continued
85
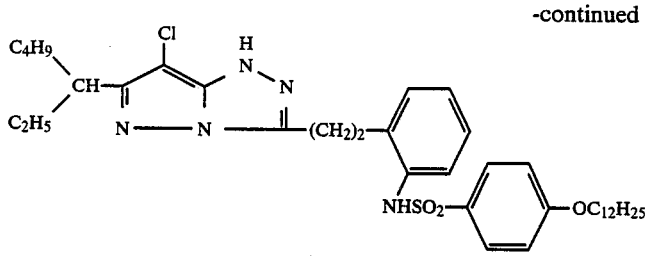
86
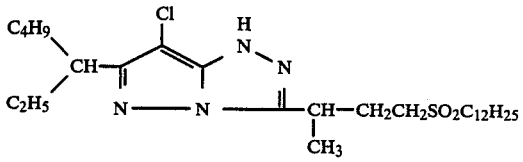
87
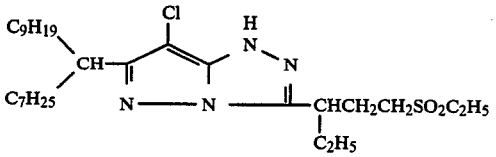
88
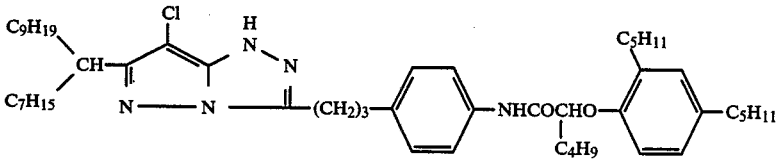
89
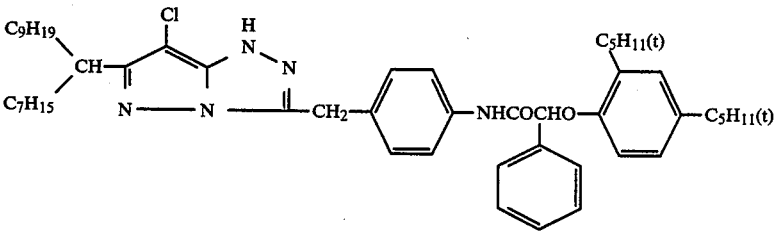
90
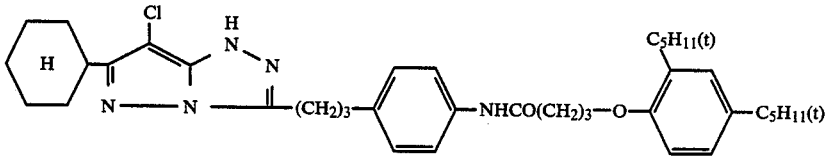
91
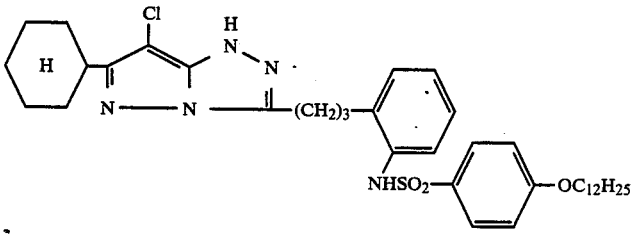
92
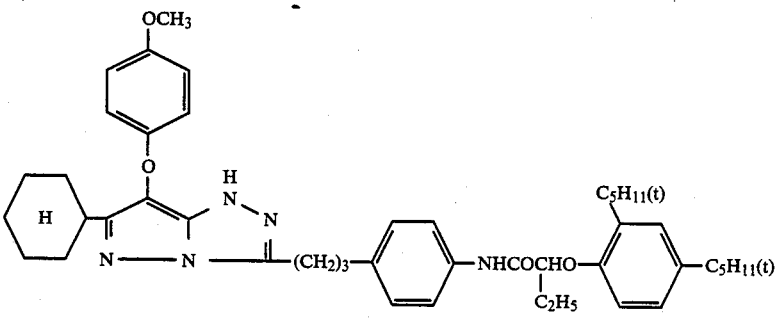

-continued
93
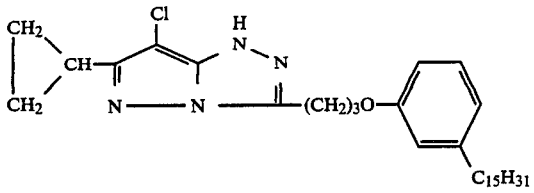
94
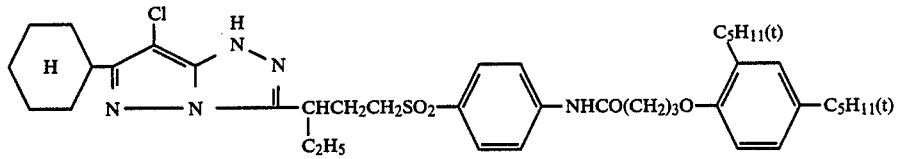
95
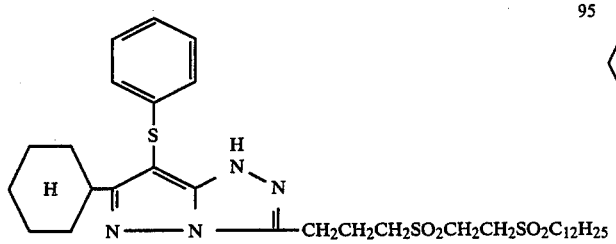
96
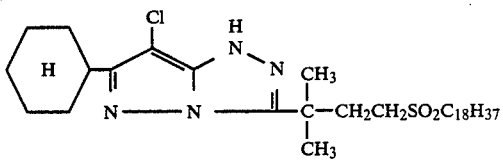
97
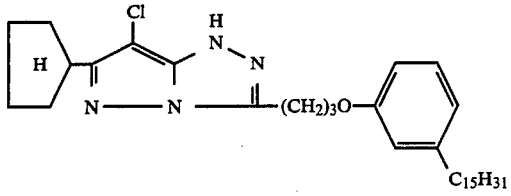
98
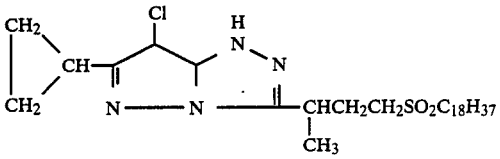
99
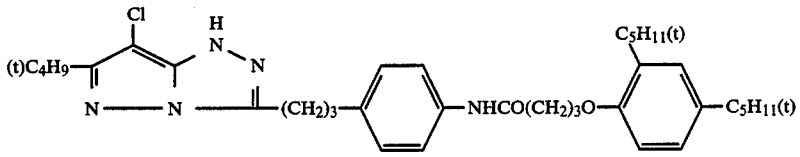
100
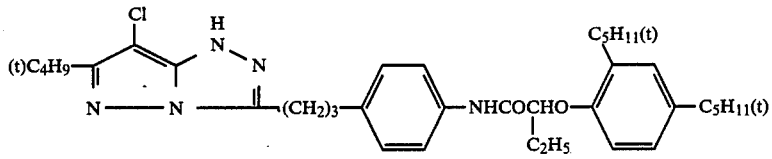
101
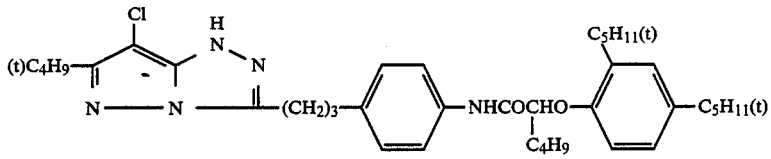
102
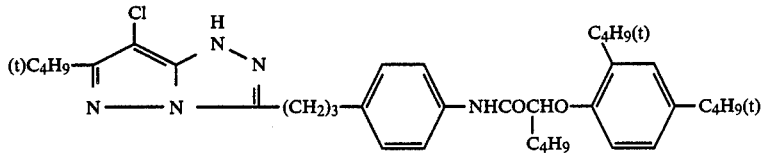

-continued
103
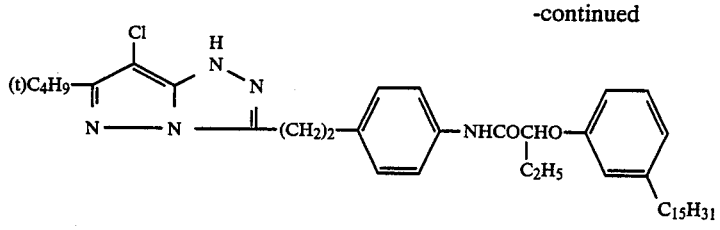
104
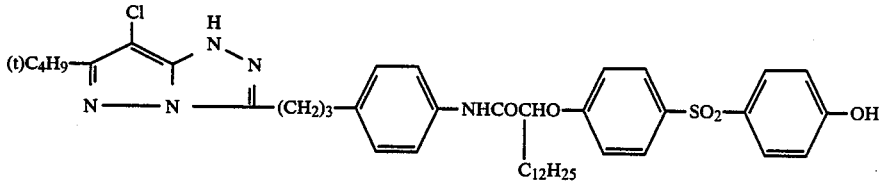
105
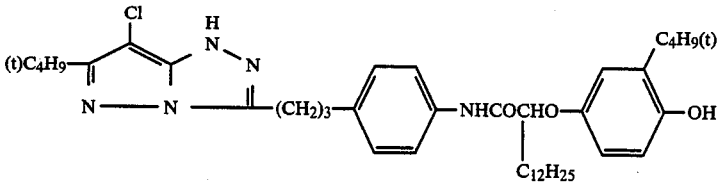
106
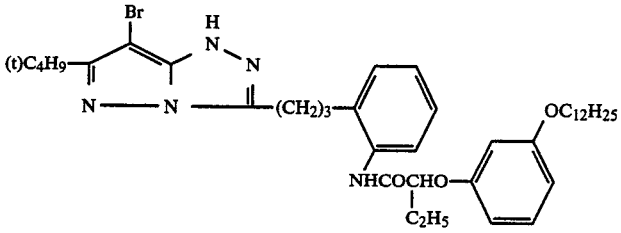
107
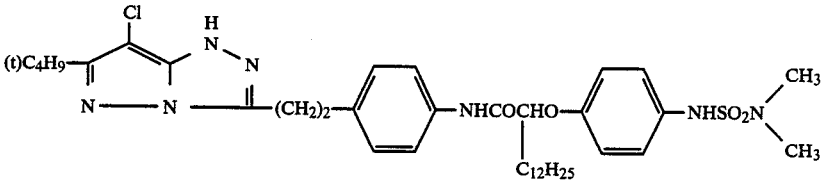
108
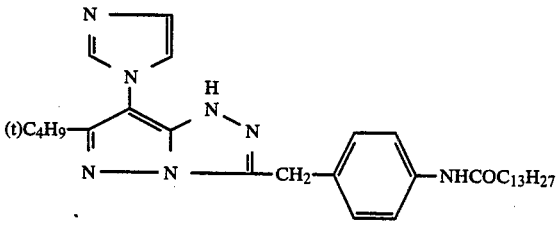
109
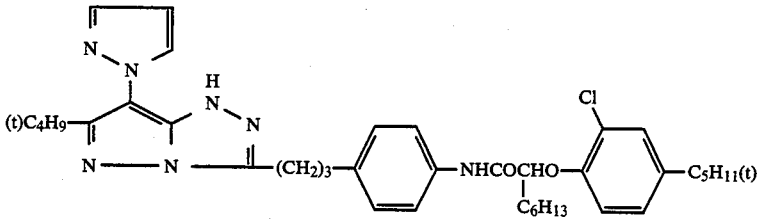
110
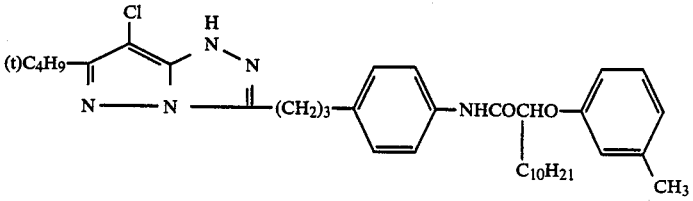

-continued
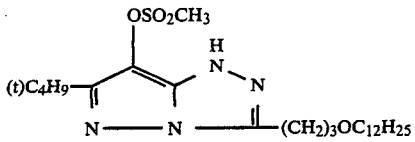
111
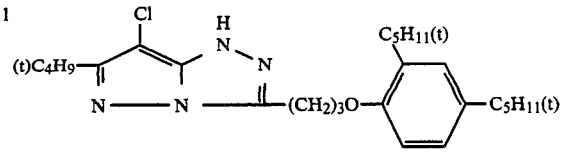
112
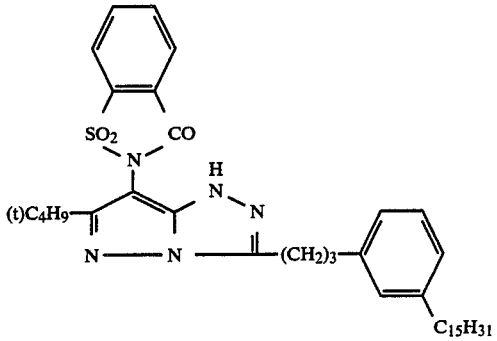
113
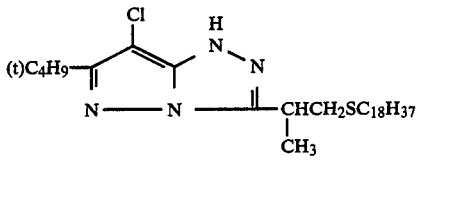
114
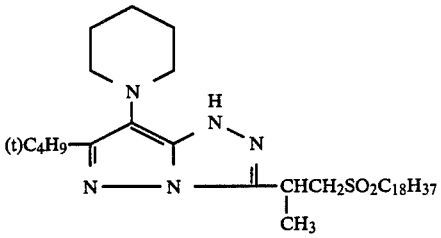
115
116
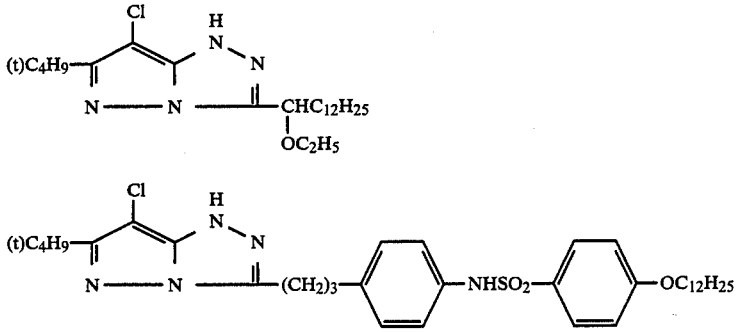
117
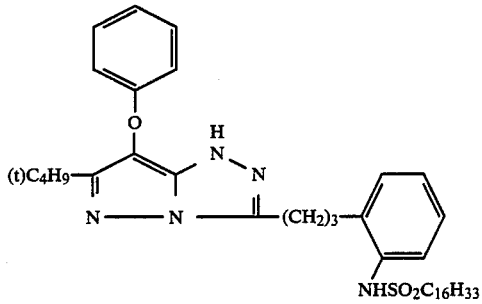
118
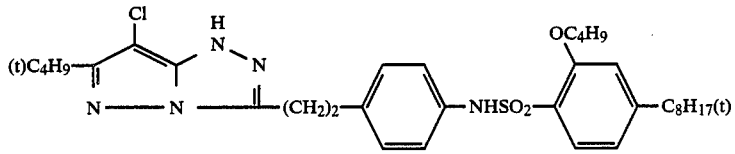
119

-continued
120
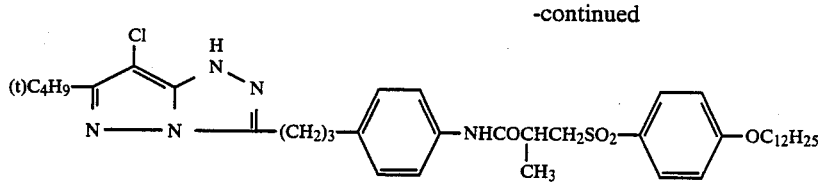
121
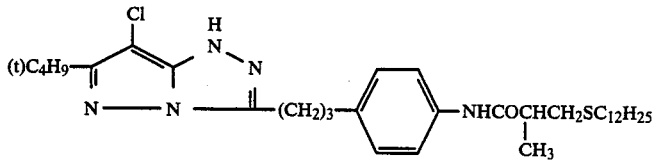
122
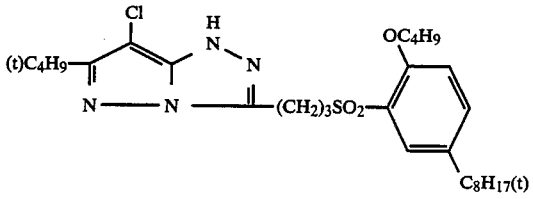
123
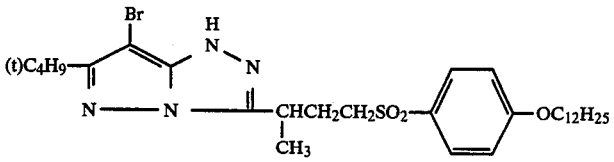
124
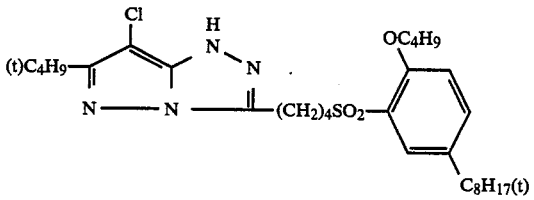
125
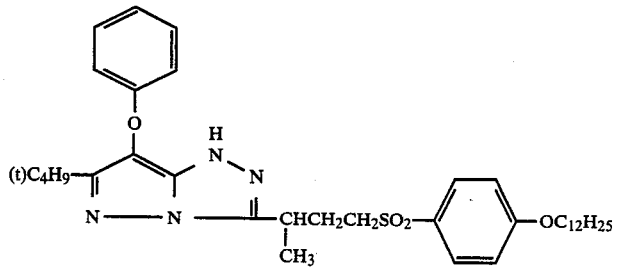
126
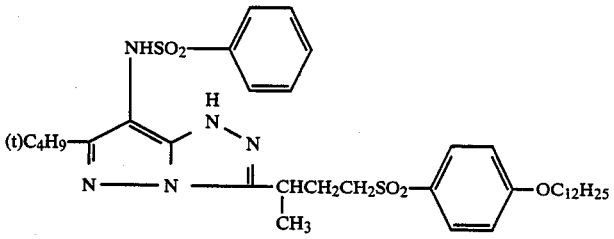
127
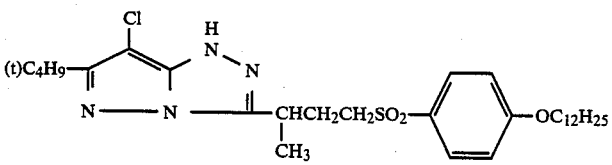

-continued
128
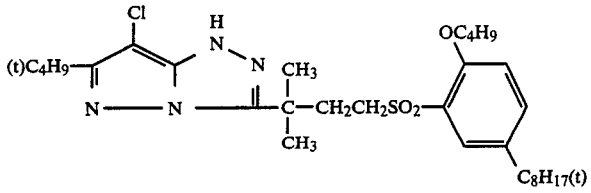
129
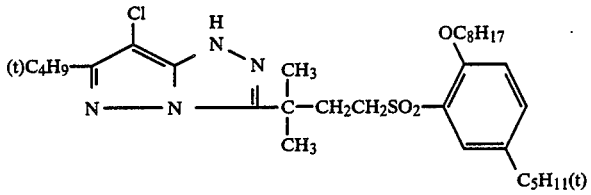
130
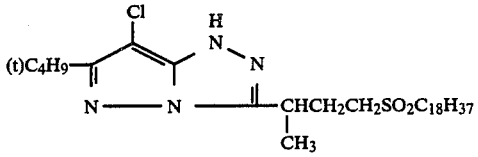
131
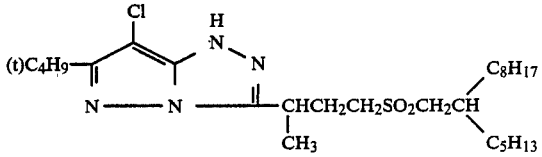
132
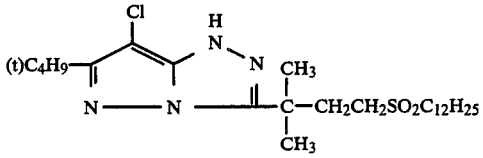
133
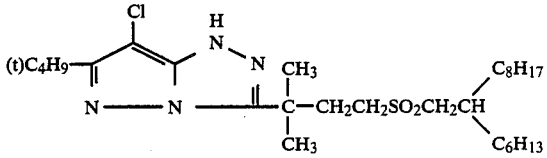
134
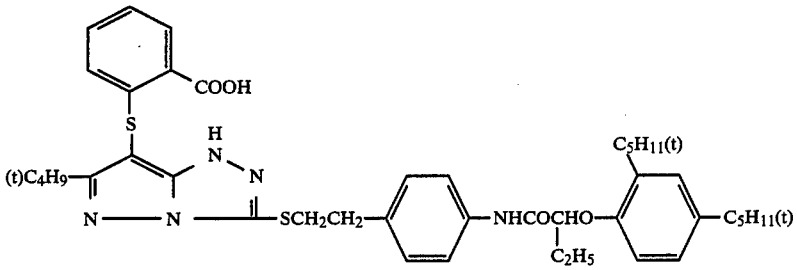
135
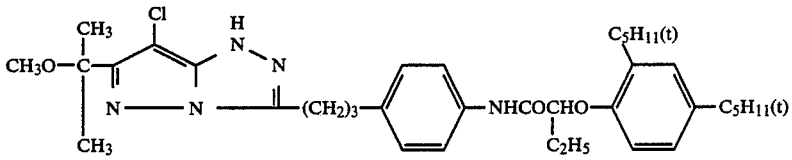
136
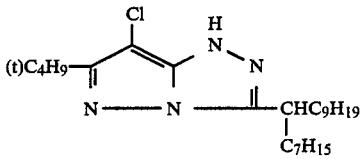
137
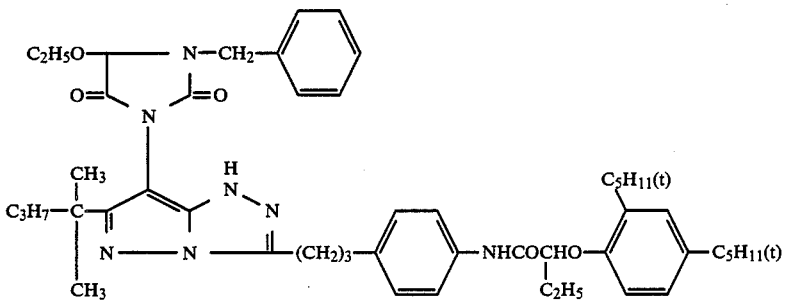

-continued
138
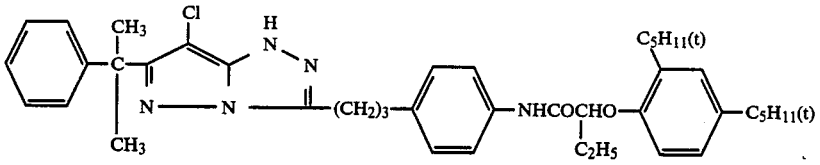
139
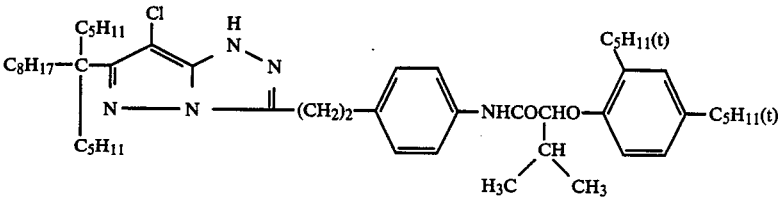
140
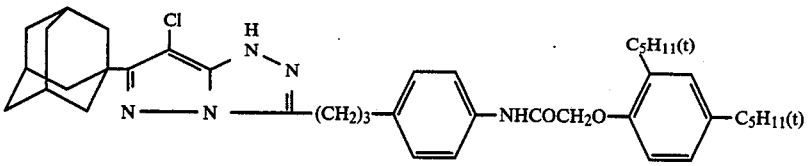
141
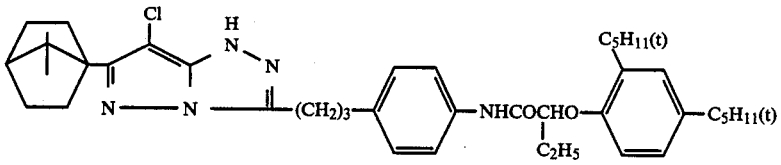
142
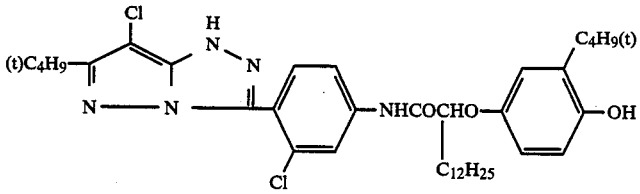
143
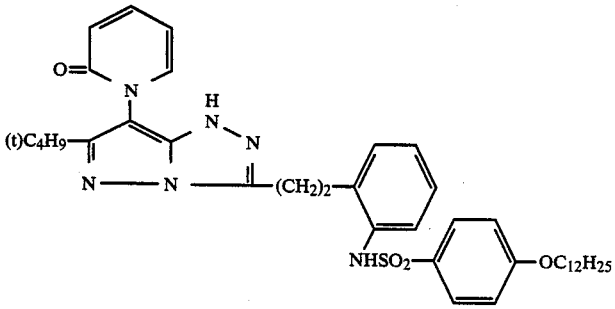
144
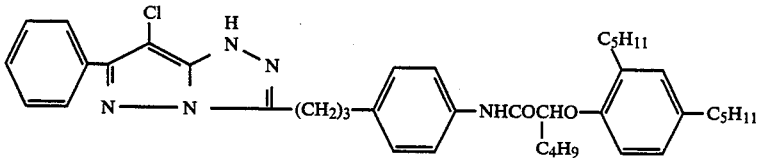
145
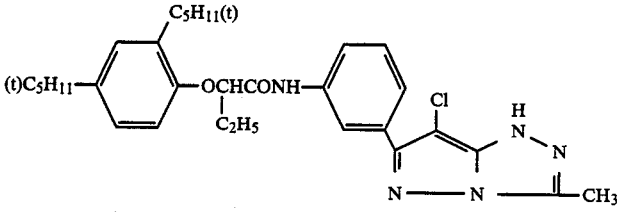

-continued
146
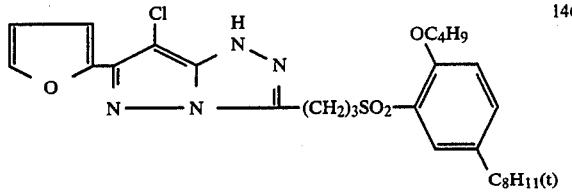
147
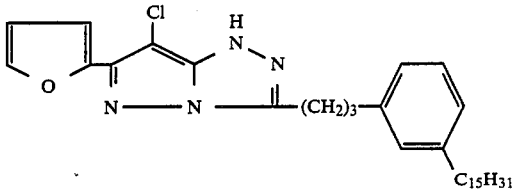
148
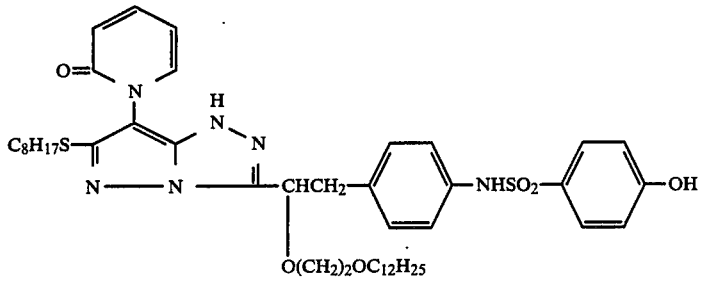
149
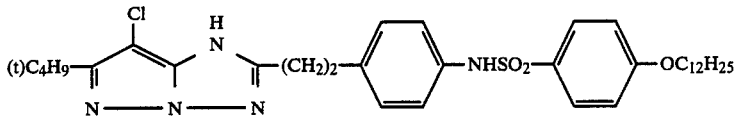
150
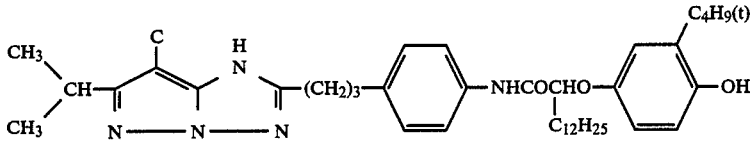
151
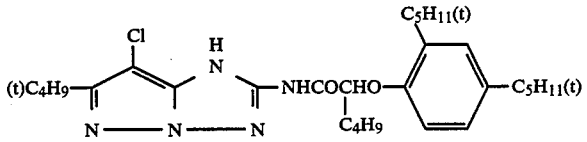
152
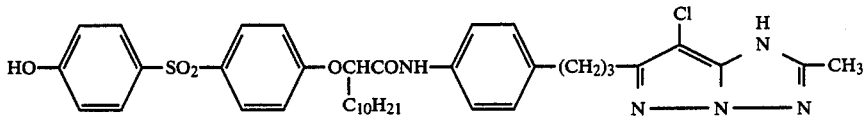
153
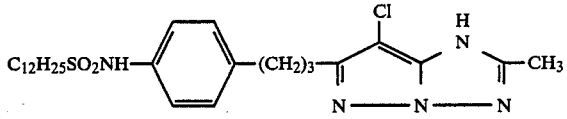
154
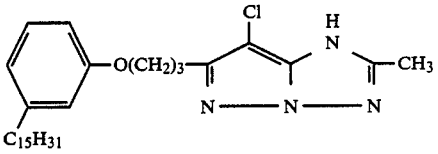
155
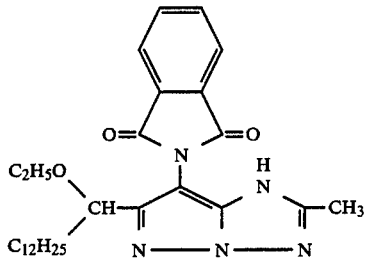
156
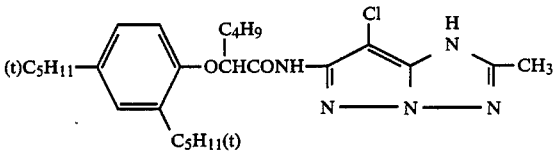
157
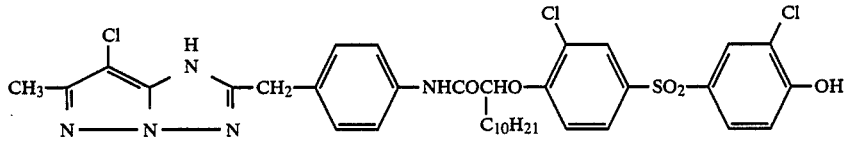

-continued
158
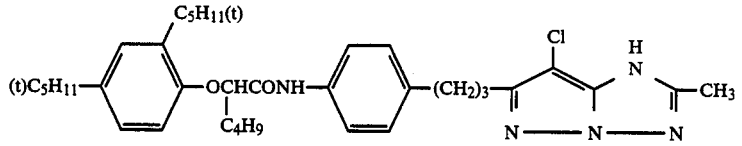
159
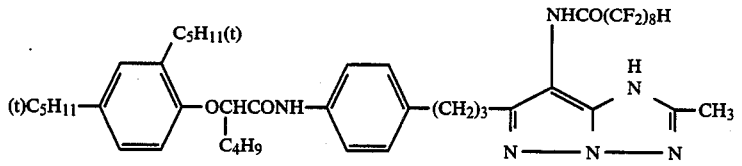
160
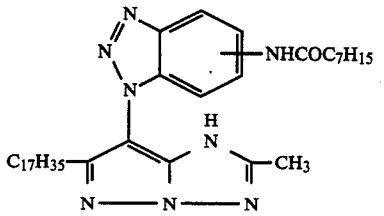
161
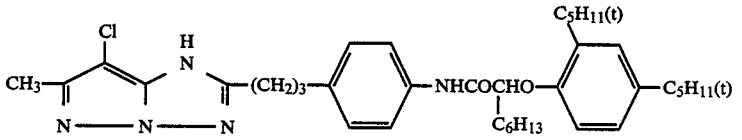
162
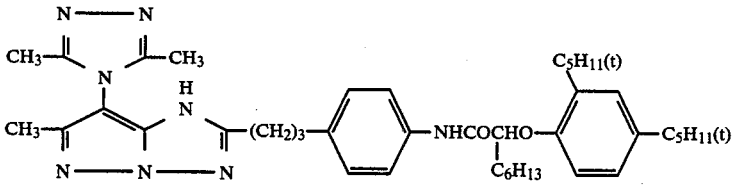
163
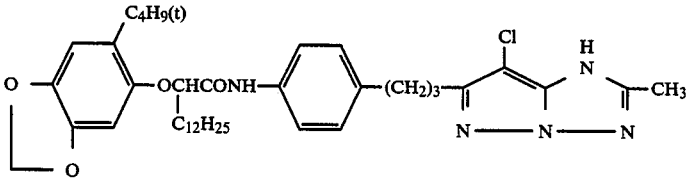
164
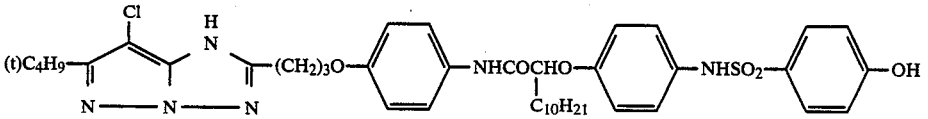
165
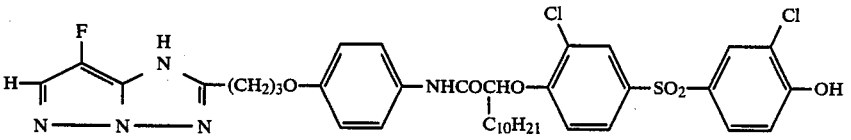
166
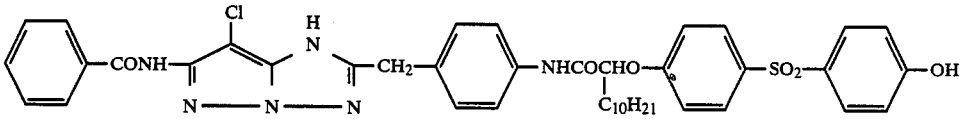

-continued
167
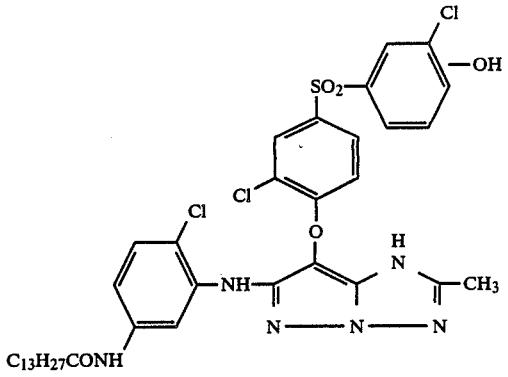
168
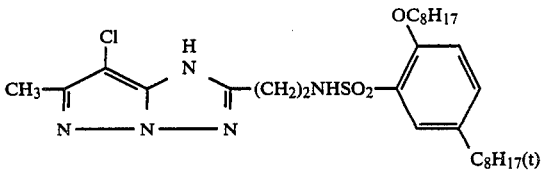
169
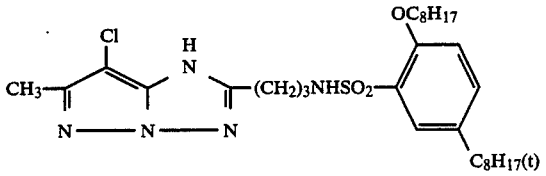
170
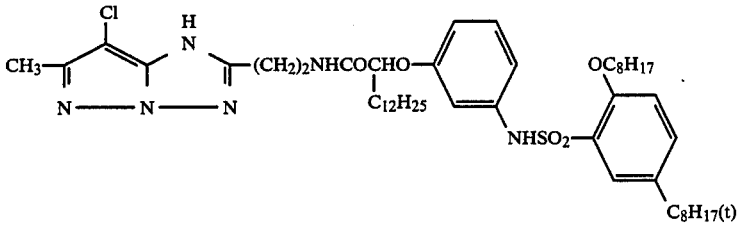
171
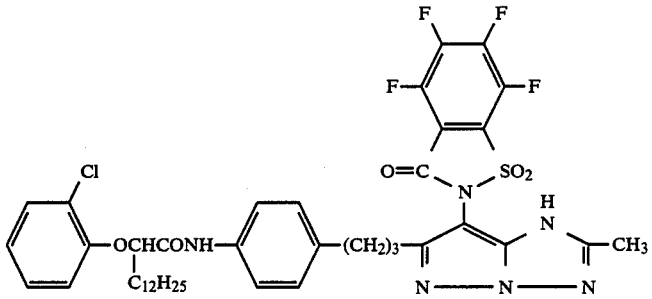
172
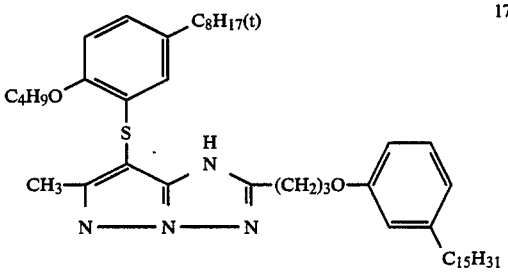
173
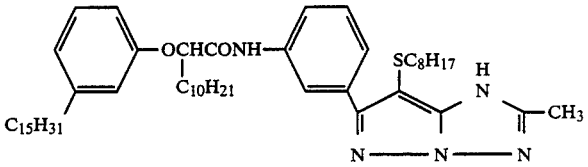
174
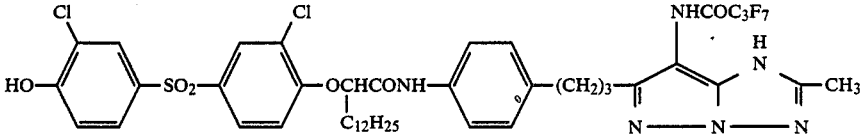

-continued
175
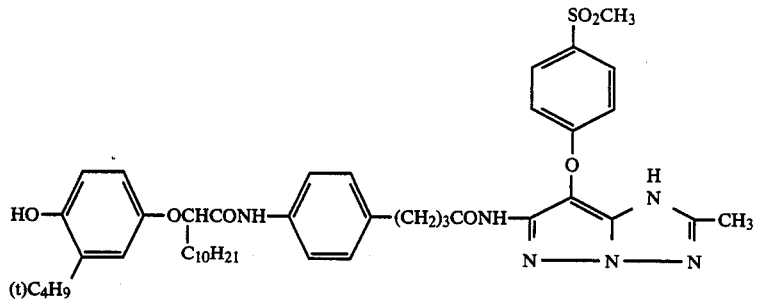
176
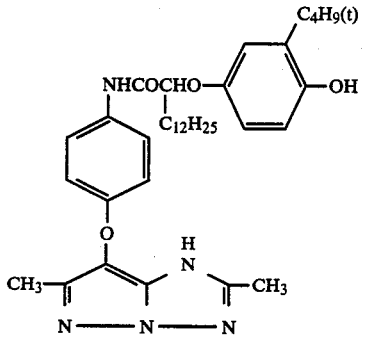
177
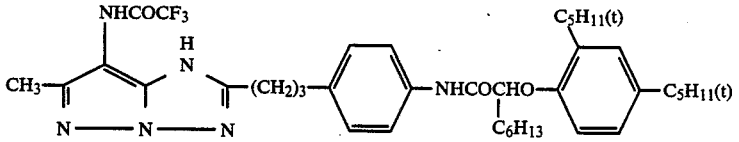
178
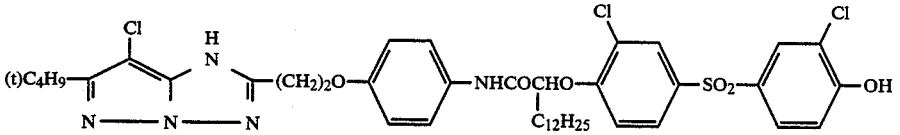
179
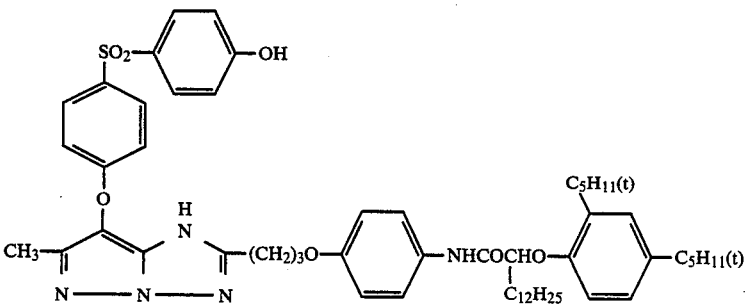
180
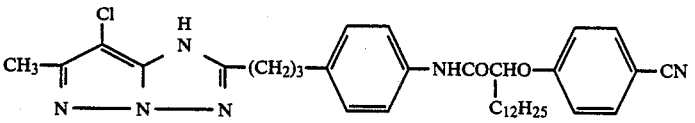
181
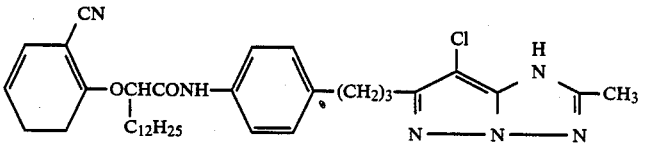

-continued
182
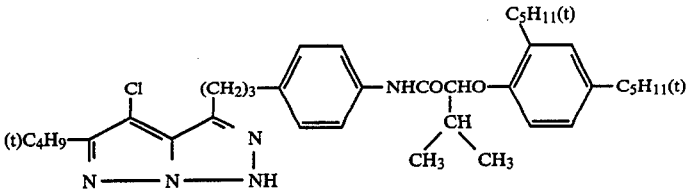
183
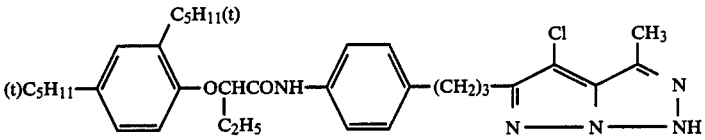
184
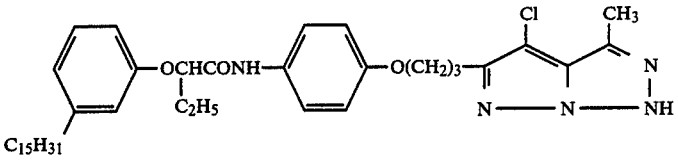
185
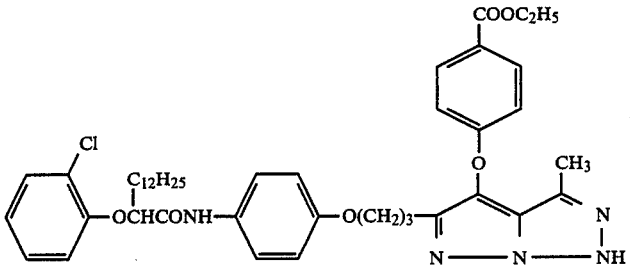
186
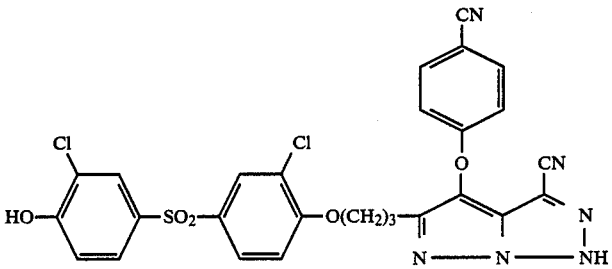
187
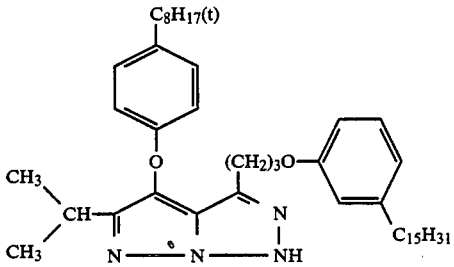

-continued
188
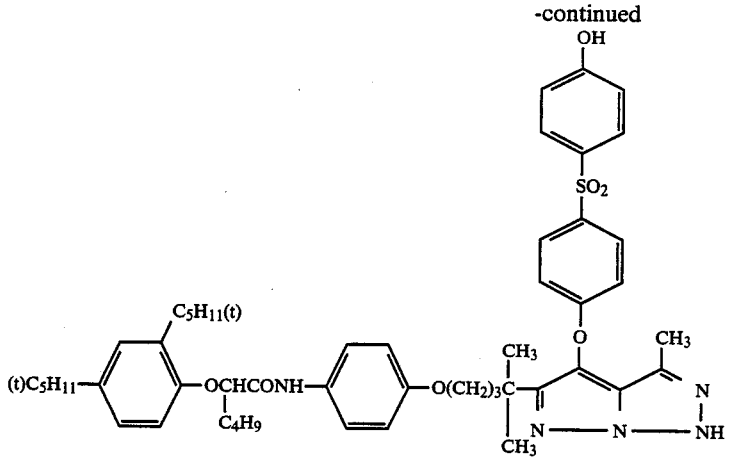
189
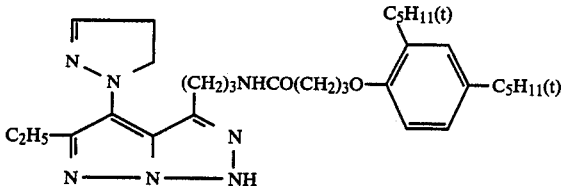
190
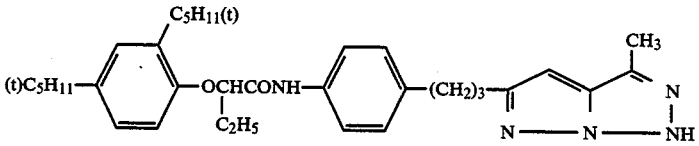
191
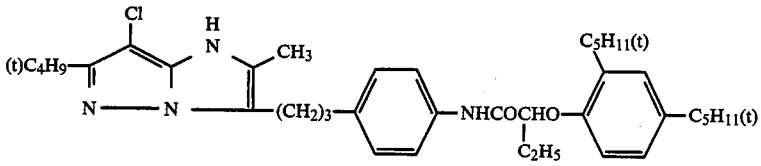
192
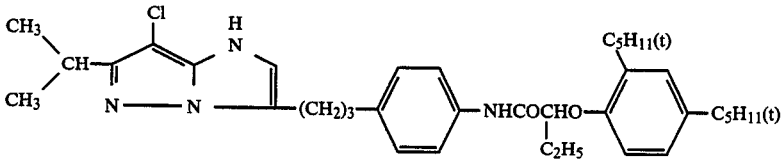
193
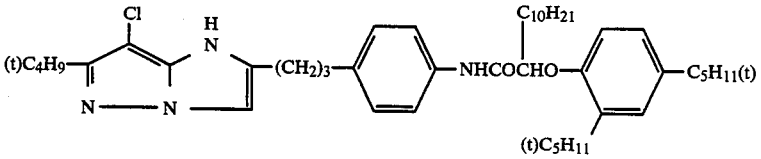
194
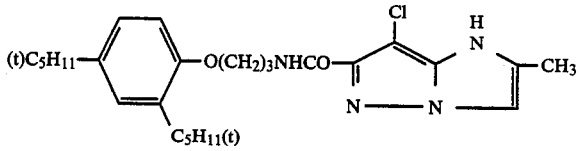
195
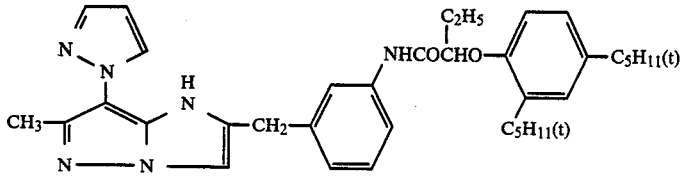

-continued
196
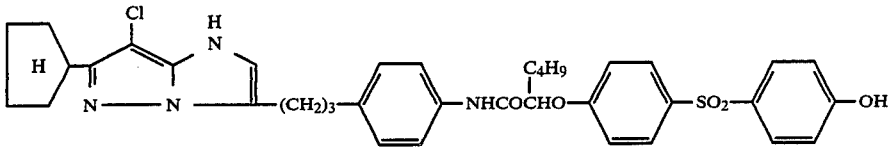
197
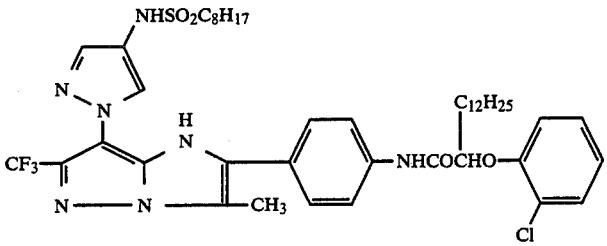
198
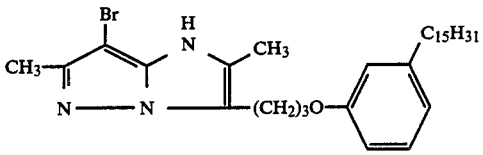
199
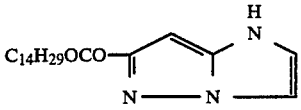
200
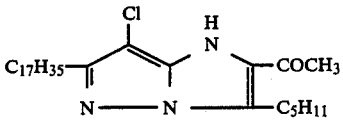
201
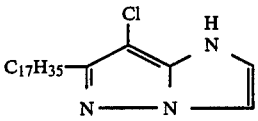
202
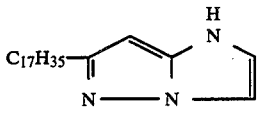
203
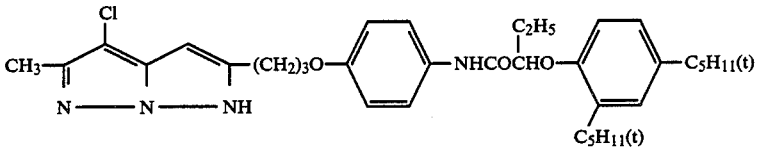
204
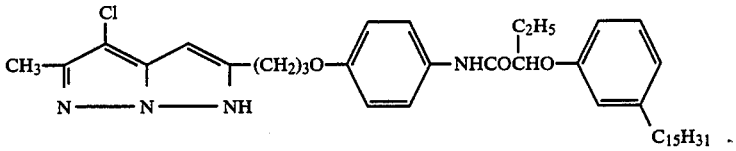
205
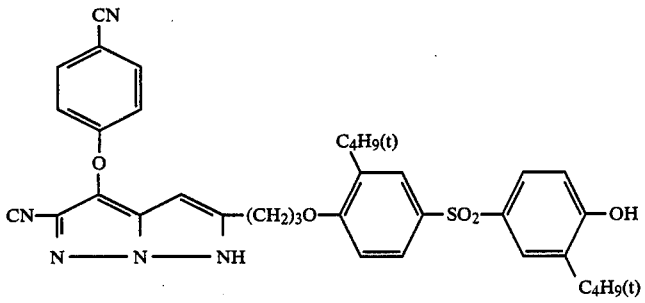
206
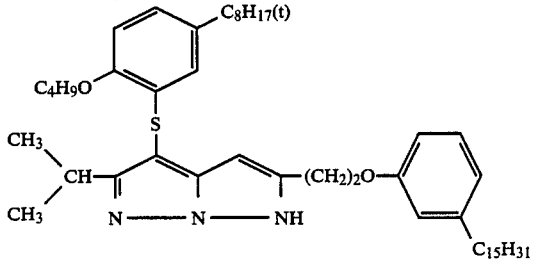

-continued
207
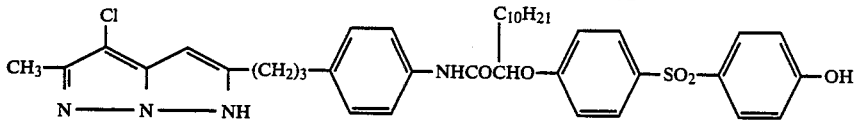
208
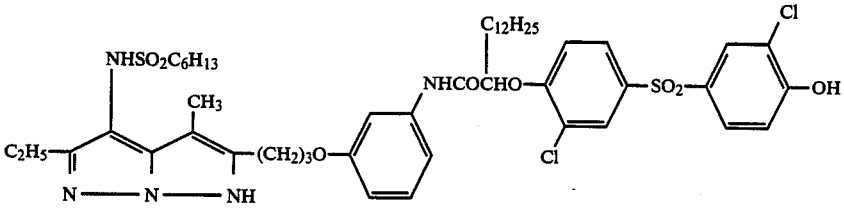
209
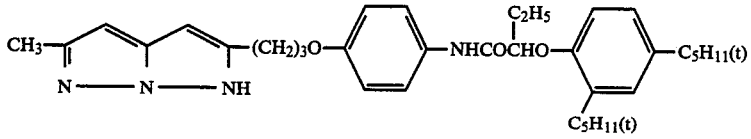
210
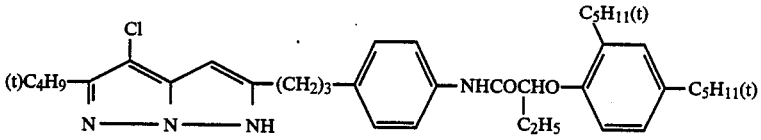
211
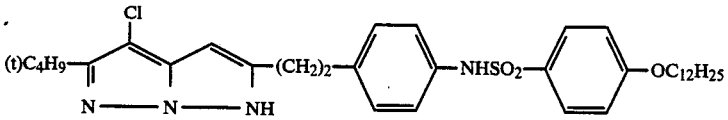
212
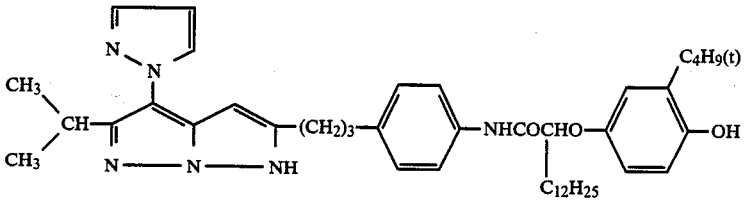
213
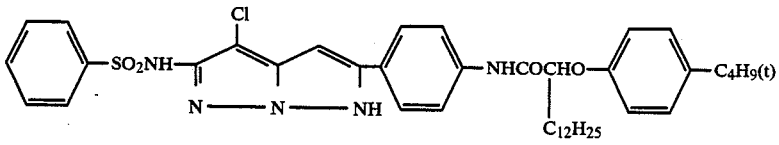
214
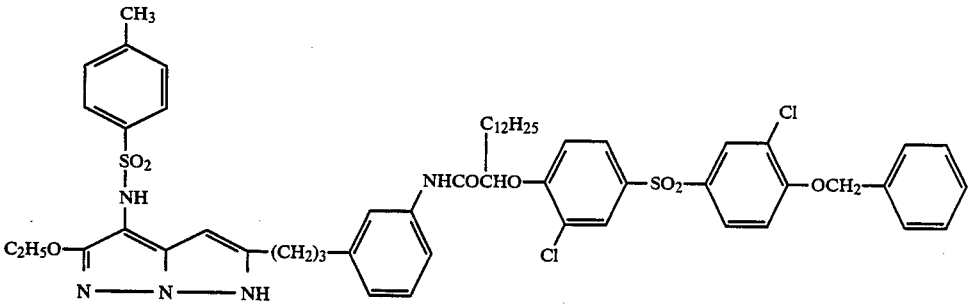
215
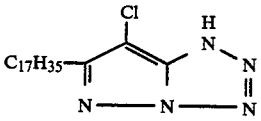
216
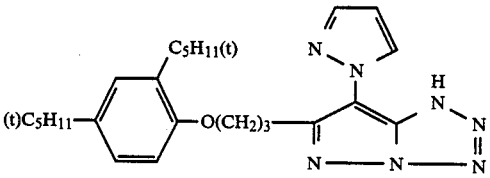

-continued

217

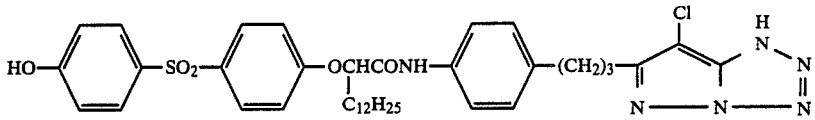

218

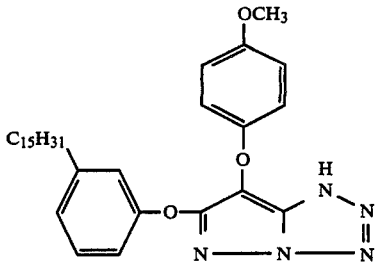

219

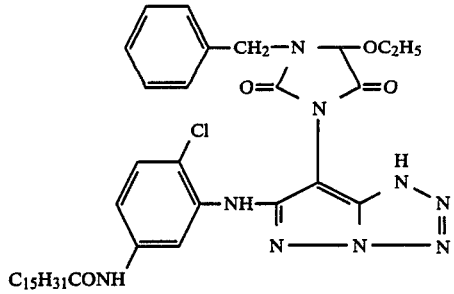

220

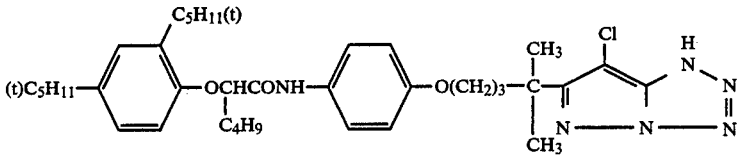

221

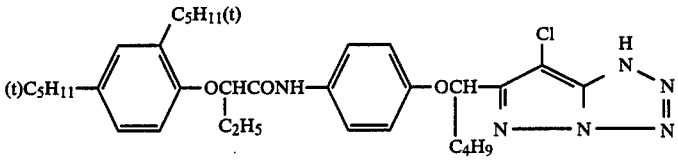

222

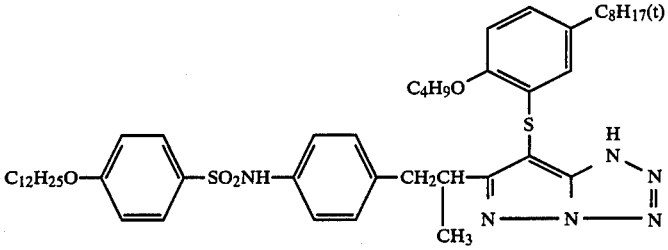

223

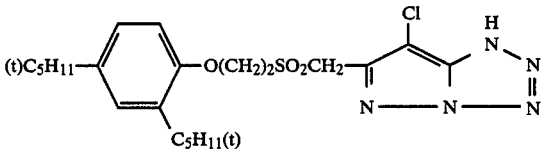

Syntheses of the above couplers can be carried out by making reference to Journal of the Chemical Society, Perkin I, 1977, pp 2047–2052, U.S. Pat. No. 3,725,067 and Japanese Unexamined Patent Publication Nos. 99437/1984, 42045/1983, 162548/1984, 171956/1984, 33552/1985, 43659/1985, 172982/1985 and 190779/1985, etc.

The couplers of this invention can be used usually in the range of $1\times10^{-3}$ mole to 1 mole, preferably $1\times10^{-2}$ to $8\times10^{-1}$ mole, per 1 mole of silver halide.

The couplers of this invention can be also used in combination with magenta couplers of other kinds.

The compound represented by Formula (1) will be described below.

In General Formula (1), the alkyl group represented by $R^1$ may include straight chain or branched one, for example, an ethyl group, a pentyl group, an octyl group, a decyl group, an undecyl group, a dodecyl group, a tetradecyl group, a pentadecyl group, an octadecyl group, a tetracosyl group, a triacontyl group, etc. $R^1$ is particularly preferably an alkyl group having 8 to 30 carbon atoms.

M represents a hydrogen atom or a cation, and the cation may include, for example, alkali metals (such as sodium and potassium), alkaline earth metals (such as magnesium and calcium), ammonium, amines (such as ethylamine and dimethylamine). M is preferably an alkali metal, particularly preferably sodium or potassium, and further preferably sodium.

The symbol n represents 0 or 1, but preferably 1.

Specific examples of the compound represented by General Formula (1) are shown below, but this invention is by no means limited to these. Exemplary compounds:

X-1 (n)$C_8H_{17}OSO_3Na$

X-2 (iso)$C_8H_{17}OSO_3Na$

X-3 (n)$C_{10}H_{21}OSO_3Na$
X-4 (n)$C_{11}H_{23}OSO_3Na$
X-5 (n)$C_{12}H_{25}OSO_3Na$
X-6 (iso)$C_{12}H_{25}OSO_3Na$
X-7 (n)$C_{12}H_{25}OSO_3K$
X-8 (n)$C_{14}H_{29}OSO_3Na$
X-9 $C_{15}H_{31}OSO_3Na$
X-10 (n)$C_{18}H_{37}OSO_3Na$
X-11 (n)$C_{24}H_{49}OSO_3Na$
X-12 (n)$C_{30}H_{61}OSO_3Na$
X-13 (n)$C_8H_{17}SO_3Na$
X-14 (n)$C_{10}H_{21}SO_3Na$
X-15 (n)$C_{12}H_{25}SO_3Na$
X-16 (n)$C_{12}H_{25}SO_3K$
X-17 (iso)$C_{12}H_{25}SO_3Na$
X-18 $C_{15}H_{31}SO_3Na$
X-19 (n)$C_{18}H_{37}SO_3Na$
X-20 (n)$C_{24}H_{49}SO_3Na$
X-21 (n)$C_{12}H_{25}OSO_3HN(CH_2CH_2OH)_3$
X-22 (n)$C_{18}H_{37}OSO_3HN(C_2H_5)_3$
X-23 (n)$C_{12}H_{25}SO_3HN(C_2H_5)_3$ These compounds are disclosed in Handbook of Surface Active Agents (published by Kogaku Tosho K.K.).

The compound represented by Formula (1) (hereinafter called "surface active agent of this invention") may be added, in the case of the emulsification dispersion, preferably in an amount of 0.1 to 50% by weight, more preferably 1 to 20% by weight, based on the magenta coupler of this invention.

Also, in the case when the surface active agent of this invention is used as a coating auxiliary, the amount may vary in a wide rage depending on the methods for the preparation and coating of a coating solution, but preferably it may be in the range of 0.1 to 10 g per 1 liter of the coating solution.

The surface active agent of this invention can also be used in combination of two or more kinds.

The surface active agent of this invention may be added to a hydrophobic solution in which the magenta coupler of this invention and the photographic additives (for example, image stabilizers and antistaining agents) have been dissolved, or may be added to an aqueous medium containing gelatin and so forth.

The surface active agent of this invention may also be added as a coating auxiliary to a coating solution to which silver halide emulsions, coupler dispersions and other photographic additives have been added. In this case, there can be shown effects for the improvements in fastness to light and gradation at the toe portion and also the improvement in M-stain.

As the method of adding the magenta coupler according to this invention to a light sensitive silver halide photographic material, there can be used a variety of methods such as a solid dispersion method, a latex dispersion method and and an oil-in-water emulsification dispersion method, in the same manner as in the method generally carried out for adding hydrophobic compounds. This can be suitably selected depending on the chemical structure of the hydrophobic compounds such as couplers. As the oil-in-water emulsification dispersion method, a conventionally known method for dispersing hydrophobic additives such as couplers can be applied. Usually, the method may be carried out by dissolving the couplers in a high boiling organic solvent having a boiling point of 150° C. or more optionally together with a low boiling and/or water soluble organic solvent, and carrying out emulsification dispersion in a hydrophilic binder such as an aqueous gelatin solution by use of a surface active agent and by use of a dispersing means such as a stirrer, a homogenizer, a colloid mill, a flow jet mixer, an ultrasonic device, followed by adding the dispersion to an intended hydrophilic colloid layer. There may be inserted a step of removing the dispersing solution or, at the same time of the dispersion, the low boiling organic solvent.

The high boiling solvent to be used may include organic solvents having a boiling point of 150° C. or more such as phenol derivatives, phthalates, phosphates, citrates, benzoates, alkyl amides, aliphatic acid esters and trimesic acid esters which do not react with an oxidized product of a developing agent.

In this invention, the high boiling organic solvent which can be preferably used in dispersing the magenta coupler according to this invention is a compound having a dielectric constant of 6.0 or less, including, for example, esters such as phthalates and phosphates, organic amides, ketones, hydrocarbon compounds, etc. having the dielectric constant of 6.0 or less. Preferred are high boiling organic solvents having a dielectric constant of not more than 6.0 and not less than 1.9, and having a vapor pressure of 0.5 mmHg or less at 100° C. More preferred are phthalates or phosphates among the above high boiling organic solvents. The high boiling organic solvent may also be a mixture of two or more kinds.

The dielectric constant mentioned in this invention refers to the dielectric constant at 30° C.

The phthalates that can be advantageously used in this invention may include the compound represented by General Formula (a) shown below:

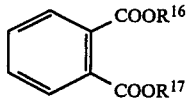

General Formula (a)

In the formula, $R^{16}$ and $R^{17}$ each represent an alkyl group, an alkenyl group or an aryl group, provided however, that the sum of carbon atom numbers of the groups represented by $R^{16}$ and $R^{17}$ is 8 to 32. More preferably, the sum of the carbon atom numbers is 16 to 24.

In this invention, the alkyl group represented by $R^{16}$ and $R^{17}$ in the above General Formula (a) may be straight chain or branched one, including, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, etc. The ary group represented by $R^{16}$ and $R^{17}$ may include, for example, a phenyl group, a naphthyl group, etc.; the alkenyl group may include, for example, a hexenyl group, a heptenyl group, an octadecenyl group. These alkyl group, alkenyl group and aryl group may have a single or plural number of substituent(s), and the substituent for the alkyl group and the alkenyl group may include, for example, a halogen atom, an alkoxy group, an aryl group, an aryloxy group, an alkenyl group, an alkoxycarbonyl group, etc., and the substituent for the aryl group may include, for example, a halogen atom, an alkyl group, an alkoxy group, a an aryl group, an aryloxy group, an alkenyl group, an alkoxycarbonyl group, etc.

The phosphates that can be advantageously used in this invention may include those represented by General Formula (b) shown below:

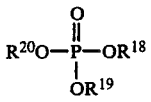

General Formula (b)

In the formula, $R^{18}$, $R^{19}$ and $R^{20}$ each represent an alkyl group, an alkenyl group or an aryl group, provided, however, that the sum of the carbon atom numbers of the groups represented by $R^{18}$, $R^{19}$ and $R^{20}$ is 24 to 54.

The alkyl group represented by $R^{18}$, $R^{19}$ and $R^{20}$ in General Formula (b) may include, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, etc.; the aryl group may include, for example, a phenyl group, a naphthyl group, etc.; and the alkenyl group may include, for example, a hexenyl group, a heptenyl group, an octadecenyl group, etc.

These alkyl group, alkenyl group and aryl group may have a single or plural number of substituent(s). Preferably, $R^{18}$, $R^{19}$ and $R^{20}$ each reresent an alkyl group, including, for example, a 2-ethylhexyl group, a n-octyl groyp, a 3,5,5-trimethylhexyl group, a n-nonyl group, a n-decyl group, a sec-decyl group, a sec-dodecyl group, a t-octyl group, etc.

Typical examples of the organic solvents used in this invention are shown below, but this invention is by no means limited to these.

Exemplary organic solvents:

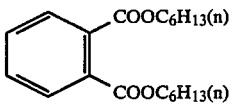

S-1

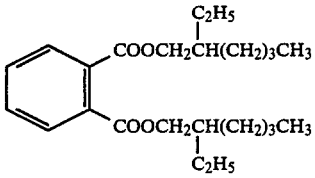

S-2

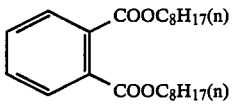

S-3

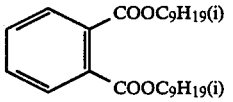

S-4

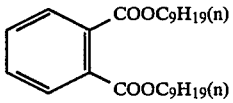

S-5

-continued

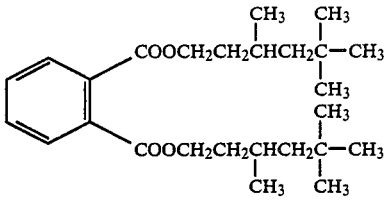

S-6

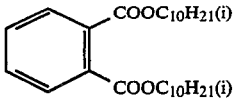

S-7

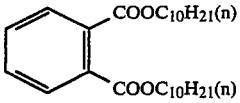

S-8

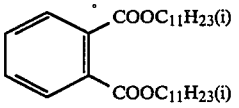

S-9

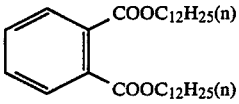

S-10

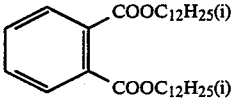

S-11

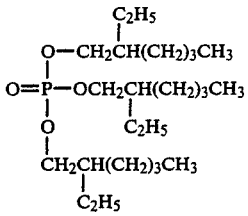

S-12

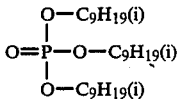

S-13

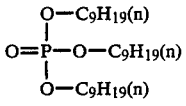

S-14

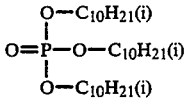

S-15

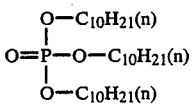

S-16

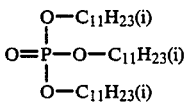

S-17

-continued

S-18

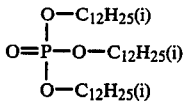

S-19

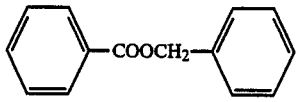

S-20

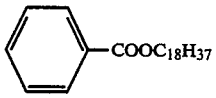

S-21

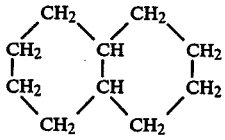

S-22

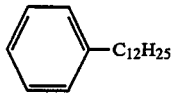

These organic solvents may be used generally in the proportion of 10 to 150% by weight based on the magenta coupler of this invention, and, preferably, 20 to 100% by weight based on the coupler.

The light-sensitive silver halide photographic material of this invention can be, for example, color negative and positive films and color photographic papers, and the effect of this invention can be effectively exhibited when the color photographic papers for direct appreciation are used.

The light-sensitive silver halide photographic material including the color photographic papers may be those for either monocolor or multicolor. In the case of the multicolor light-sensitive silver halide photographic material, wherein the color reproduction is carried out by the subtractive color process, the photographic material usually has the construction comprising silver halide emulsion layers respectively containing magenta, yellow and cyan couplers as couplers for photography, and non-sensitive layers, laminated on a support with an appropriate number and order of layers. The number and order of the layers may be suitably changed depending on what performances are important and what purpose the materials are used for.

In the case where the light-sensitive silver halide photographic material is the multicolor light-sensitive silver halide photographic material, specific layer constitution is particularly preferably such that, from the support side, a yellow dye image forming layer, an intermediate layer, a magenta dye image forming layer, an intermediate layer, a cyan dye image forming layer, an intermediate layer and a protective layer are successively arranged on the support.

In the silver halide emulsion used in the light-sensitive silver halide photographic material of this invention, there can be used any of silver bromide, silver iodobromide, silver iodochloride, silver chlorobromide, silver chloride, etc. which are used in ordinary silver halide emulsions.

Silver halide grains used in the silver halide emulsions may be obtained by any of an acidic method, a neutral method and an ammoniacal method. The grains may be allowed to grow at one time, or grow after seed grains have been formed. The manner to prepare the seed grains and the manner to grow them may be same or different.

The silver halide emulsion may be obtained by simultaneously mixing halide ions and silver ions, or by preparing an aqueous solution in which either one of them is present and then mixing in it the other of them. Alternatively, taking into account the critical growth rate of silver halide crystals, it may be formed by successively simultaneously adding halide ions and silver ions while controlling pH and pAg in a mixing vessel. Halogen formulation in a grain may be varied after growth by employing a conversion method.

During the preparation of the silver halide emulsion of this invention, a silver halide solvent can be optionally used for controlling the grain size, grain shape, grain size distribution and grain growth rate, of the silver halide grains.

In the course of formation and/or growth of the silver halide grains used in the silver halide emulsion of this invention, metal ions may be added to the grains by use of at least one of a cadmium salt, a zinc salt, a lead salt, a thallium salt, an iridium salt or a complex salt thereof, a rhodium salt or a complex salt thereof, and an iron salt or a complex salt thereof to incorporate any of these metal elements into the inside of the grains and/or the surface of the grains, and also a reduction sensitizing nuclei can be imparted to the inside of the grains and/or the surface of the grains by placing the grains in a suitable reductive atmosphere.

The silver halide emulsion may be either one from which unnecessary soluble salts have been removed after completion of the growth of silver halide grains, or one from which they remain unremoved. When the salts are removed, they can be removed according to the method disclosed in Research Disclosure No. 17643.

The silver halide grains used in the silver halide emulsion of this invention may comprise uniform layers in the inside and the surface, or comprise different layers.

The silver halide grains used in the silver halide emulsion of this invention may be grains such that a latent image is formed chiefly on the surface, or grains such that a latent image is formed chiefly in the inside of a grain.

The silver halide grains used in the silver halide emulsion of this invention may be any of those having a regular crystal form, or those having an irregular crystal form such as a sphere and a plate. In these grains, there can be used those having any ratio of {100} face to {111} face. Also, they may have a composite form of these crystal forms, or comprise a mix of grains having various crystal forms.

The silver halide emulsion may be used by mixing tow or more kinds of silver halide emulsions which have been separately formed.

The silver halide emulsion can be chemically sensitized according to conventional methods. Namely, a sulfur sensitization method using a compound containing sulfur capable of reacting with silver ions, and active gelatin, a selenium sensitization method using a selenium compound, a reduction sensitization method using a reducing substance, and a noble metal sensitization method using noble metal compounds such as gold and so forth can be used alone or in combination.

The silver halide emulsion of this invention can be optically sensitized to a desired wavelength region by using a dye known as a sensitizing dye in the field of photography. The sensitizing dye may be used alone, or may be used in combination of two or more of the dye. Together with the sensitizing dye, a dye having itself no action of spectral sensitization, or a supersensitizing agent which is a compound substantially absorbing no visible light and capable of strengthening the sensitizing action of the sensitizing dye, may be contained in the emulsion.

To the silver halide emulsion of this invention, a compound known as an antifoggant or a stabilizer in the field of photography can be added during chemical ripening, and/or after completion of chemical ripening, and/or before coating of a silver halide emulsion after completion of chemical ripening, for the purpose of preventing a light-sensitive material from being fogged during production of light-sensitive materials, during preservation or during photographic processing, or for the purpose of keeping stable the photographic performances.

As a binder (or a protective colloid) for the silver halide emulsion of this invention, it is advantageous to use gelatin, but it is also possible to use hydrophilic colloids such as gelatin derivatives, a graft polymer of gelatin with other macromolecules, proteins, sugar derivatives, cellulose derivatives and synthetic hydrophilic high molecular substances such as homopolymer or copolymer.

Photographic emulsion layers and other hydrophilic colloid layers of the light-sensitive silver halide photographic material of this invention can be hardened by using one or more kinds of hardening agents that can crosslink binder (or protective colloid) molecules to enhance the film strength. The hardening agents can be added in such an amount that a light-sensitive material can be hardened to the extent that no hardening agent is required to be added in a processing solution. It, however, is also possible to add the hardening agent in the processing solution.

A plasticizer can be added to the silver halide emulsion layers and/or other hydrophilic colloid layers of the light-sensitive silver halide photographic material of this invention, for the purpose of enhancing flexibility.

For the purpose of improving dimensional stability and the like, a dispersion (latex) of a water insoluble or hardly soluble synthetic polymer can be contained in the photographic emulsion layers and other hydrophilic colloid layers of the light-sensitive silver halide photographic material of this invention.

In a color development processing, a dye-forming coupler capable of forming a dye through a coupling reaction with an oxidized product of an aromatic primary amine developing agent (for example, p-phenylenediamine derivatives, aminophenol derivatives, etc.) is used in the emulsion layers of the light-sensitive silver halide photographic material of this invention. In a usual case, the dye forming coupler is selected in the manner that there can be formed a dye capable of absorbing light-sensitive spectral light in an emulsion layer with respect to the respective emulsion layers, and thus a yellow dye-forming coupler is used in a blue-sensitive emulsion layer; a magenta dye-forming coupler, in a green-sensitive emulsion layer; and a cyan dye-forming coupler, in a red-sensitive emulsion layer. However, the light-sensitive silver halide color photographic material may be prepared by using the couplers in the manner different from the above combination, depending on the purpose.

The cyan dye-forming coupler used in this invention may typically include four equivalent type or two equivalent type phenol or naphthol cyan dye-forming couplers, and Specific examples are disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,722,162, 2,895,826, 2.976,146, 3,002,836, 3,419,390, 3,446,622, 3,476,563, 3,737,316, 3,758,308, and 3,839,044; British Pat. Nos. 478,991, 945,542, 1,084,480, 1,377,237, 1,388,024 and 1,543,040; Japanese Unexamined Patent Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979 and 32071/1980; etc.

Cyan couplers used in this invention may preferably further include those represented by General Formula (CC-1) and (CC-2) shown below:

General Formula (CC-1)

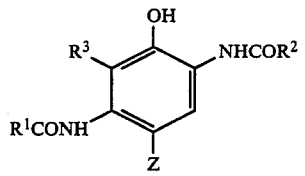

In the formula, $R^1$ represents an alkyl group or an aryl group. $R^2$ represents an alkyl group, a cycloalkyl group, an aryl group or a heterocyclic group. $R^3$ represents a hydrogen atom, a halogen atom, an alkyl group or an alkoxy group. $R^3$ may be linked with $R^1$ to form a ring. Z represents a hydrogen atom or a group eliminable through the reaction with an oxidized product of an aromatic primary amine type color developing agent.

General Formula (CC-2)

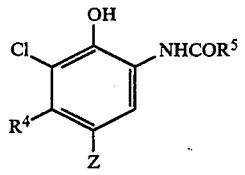

In the formula, $R^4$ represents a straight chain or branched alkyl group having 1 to 4 carbon atoms, and $R^5$ represents a ballast group. Z has the same meaning as defined for Z in General Formula (CC-1). Particularly preferably $R^4$ represents a straight chain or branched alkyl group having 2 to 4 carbon atoms.

In this invention, the alkyl group represented by $R^1$ in General Formula (CC-1) is straight chain or branched one, including, for example, a methyl group, an ethyl group, an iso-propyl group, a butyl group, a pentyl group, an octyl group, a nonyl group, a tridecyl group, etc., and the aryl group include, for example, a phenyl group, a naphthyl group, etc. These groups represented by $R^1$ may include those having a single or plural number of substituent(s), and the substituent(s) introduced, for example, in the phenyl group may typically include halogen atoms (for example, atoms of fluorine, chlorine, bromine, etc.), alkyl groups (for example, a methyl group, an ethyl group, a propyl group, a butyl group, a dodecyl group, etc.), hydroxyl groups, cyano groups, nitro groups, alkoxy groups (for example, a methoxy group and an ethoxy group), alkylsulfonamide groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), aminosulfonamide groups (for example, N,N-dimethylaminosulfonamide group, etc.), acylamino groups, carbamoyl groups, sulfonyl groups, sulfinyl groups, sulfoxy group, sulfo groups, aryloxy groups, alkoxy groups, carboxyl groups, alkylcarbonyl groups, arylcarbonyl groups, etc.

Two or more of these substituents may be introduced in the phenyl group.

The halogen atom represented by $R^3$ may include, for example, a fluorine atom, a chlorine atom, a bromine atom, etc.; the alkyl group may include, for example, a methyl group, an ethyl group, a propyl group, a butyl group, a dodecyl group, etc.; and the alkoxy group may include, for example, a methoxy group, an ethoxy group, a propyloxy group, a butoxy group, etc. $R^3$ may be linked with $R^1$ to form a ring.

In this invention, the alkyl group represented by $R^2$ in General Formula (CC-1) includes, for example, a methyl group, an ethyl group, a butyl group, a hexyl group, tridecyl group, a pentadecyl group, a heptadecyl group, a so called polyfluoroalkyl group which is a group substituted with a fluorine atom, etc.

The aryl group represented by $R^2$ includes, for example, a phenyl group and naphthyl group and preferably includes a phenyl group. The heterocyclic group represented by $R^2$ includes, for example, a pyridyl group, a furan group, etc. The cycloalkyl group represented by $R^2$ includes, for example, a cyclopropyl group, a cyclohexyl group, etc. These groups represented by $R^2$ may include those having a single or plural number of substituent(s), and the substituent(s) introduced, for example, in the phenyl group may typically include halogen atoms (for example, atoms of fluorine, chlorine, bromine, etc.), alkyl groups (for example, a methyl group, an ethyl group, a propyl group, a butyl group, a dodecyl group, etc.), hydroxyl groups, cyano groups, nitro groups, alkoxy groups (for example, a methoxy group and an ethoxy group), alkylsulfonamide groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), aminosulfonamide groups (for example, N,N-dimethylaminosulfonamide group, etc.), acylamino groups, carbamoyl groups, sulfonyl groups, sulfinyl groups, sulfoxy group, sulfo groups, aryloxy groups, alkoxy groups, carboxyl groups, alkylcarbonyl groups, arylcarbonyl groups, etc. Two or more of these substituents may be introduced in the phenyl group.

The group represented by $R^9$ may preferably include a polyfluoroalkyl group, a phenyl group, or a phenyl group having as a substituent one or more of a halogen atom, an alkyl group, an alkoxy group, an alkylsulfonamide group, an arylsulfonamide group, an alkylsulfamoyl group, an arylsulfamoyl group, an alkylsulfonyl group, an arylsulfonyl group, an alkylcarbonyl group, an arylcarbonyl group and a cyano group.

The cyan couplers represented by the above General Formula (CC-1) and preferably used in this invention, may further preferably include those represented by General Formula (CC-3) shown below.

General Formula (CC-3)

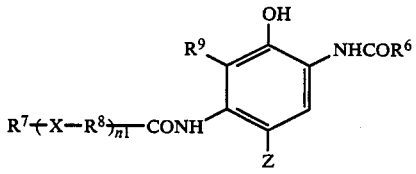

In General Formula (CC-3), $R^6$ represents a phenyl group. This phenyl group may include one having a single or plural number of substituent(s), and the substituent(s) introduced therein may typically include halogen atoms (for example, atoms of fluorine, chlorine, bromine, etc.), alkyl groups (for example, a methyl group, an ethyl group, a propyl group, a butyl group, a dodecyl group, etc.), hydroxyl groups, cyano groups, nitro groups, alkoxy groups (for example, a methoxy group and an ethoxy group), alkylsulfonaminde groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), etc. Two or more of these substituents may be introduced in the phenyl group.

The group represented by $R^6$ may preferably include a phenyl group, or a phenyl group having as a substituent one or more of a halogen atom (preferably fluorine, chlorine or bromine), an alkylsulfonamide group (preferably an o-methylsulfonamide group, a p-octylsulfonamide group or an o-dodecylsulfonamide group), an arylsulfonamide group (preferably a phenylsulfonamide group), an alkylsulfamoyl group (preferably a butylsulfamoyl group), an arylsulfamoyl group (preferably a phenylsulfamoyl group), an alkyl group (preferably a methyl group or trifluoromethyl group) and an alkoxy group (preferably a methoxy group or an ethoxy group).

$R^7$ is an alkyl group or an aryl group. The alkyl group or the aryl group may include those having a single or plural number of substituent(s), and the substituent(s) therefor may typically include halogen atoms (for example, fluorine, chlorine, bromine, etc.), hydroxyl groups, carboxyl groups, alkyl groups (for example, a methyl group, an ethyl group, a propyl group, a butyl group, a dodecyl group, etc.), aralkyl groups, cyano groups, nitro groups, alkoxy groups (for example, a methoxy group and an ethoxy group), aryloxy group, alkylsulfonamide groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), aminosulfonamide groups (for example, dimethylaminosulfonamide group, etc.), alkylsulfonyl groups, arylsulfonyl groups, alkylcarbonyl groups, arylcarbonyl groups, aminocarbonylamide groups, carbamoyl groups, sulfinyl groups, etc. Two or more of these substituents may be introduced.

The group represented by $R^7$ may preferably include an alkyl group when $n^1=0$, or an aryl group when $n^1=1$ or more. The group represented by $R^7$ may further preferably include an alkyl group having 1 to 22 carbon atoms when $n^1=0$ (preferably a methyl group, an ethyl group, a propyl group, a butyl group, an octyl group or a dodecyl group), or, when $n^1=1$ or more, an unsubstituted phenyl group or a phenyl group having as a substituent one or more of an alkyl group (preferably a t-butyl group, a t-amyl group or an octyl group), an alkylsulfonamide group (preferably a butylsulfonamide group, an octylsulfonamide group or a dodecylsulfonamide group), an arylsulfonamide group (preferably a phenylsulfonamide group), an aminosulfonamide group (preferably a dimethylaminosulfonamide group) and an alkyloxycarbonyl group (preferably a methyloxycarbonyl group or a butyloxycarbonyl group).

$R^8$ represents an alkylene group, preferably a straight chain or branched alkylene group having 1 to 20 carbon atoms, more preferably 1 to 12 carbon atoms.

$R^9$ represents a hydrogen atom or a halogen atom (fluorine, chlorine, bromine or iodine). Preferably, it is a hydrogen atom.

$n^1$ is 0 or a positive integer, preferably 0 or 1.

X represents a divalent group of a group of —O—, —CO—, —COO—, —OCO—, —$SO_2$NR—, —NR'$SO_2$NR"—, —S—, —SO— or —$SO_2$— (herein, R' and R" each represent an alkyl group and include those having a substituent). Preferably, X is a group of —O—, —S—, —SO— or —$SO_2$.

Z has the same meaning as defined for Z in General Formula (CC-1).

In this invention, the straight chain or branched alkyl group having 1 to 4 carbon atoms, represented by the above General Formula (CC-2) is, for example, an ethyl group, a propyl group, a butyl group, an iso-propyl group, an iso-butyl group, a sec-butyl group or a tert-butyl group, and may include those having a substituent. The substituent may include an acylamino group (for example, an acetylamino group), an alkoxy group (for example a methoxy group), etc.

Preferably, $R^4$ is an alkyl group having 2 to 4 carbon atoms.

The ballast group represented by $R^5$ is an organic group having the size and shape that can give to a coupler molecule the bulk sufficient for making it substantially impossible for the coupler to be diffused to other layer from a layer to which the coupler is applied.

Typical ballast group may include an alkyl group having 8 to 32 carbon atoms in total, or an aryl group.

These alkyl group and aryl group may include those having a substituent. The substituent for the aryl group may include, for example, an alkyl group, an aryl group, an alkoxy group, an aryloxy group, a carboxyl group, an acyl group, an ester group, a hydroxyl group, a cyano group, a nitro group, a carbamoyl group, a carbonamide group, an alkylthio group, an arylthio group, a sulfonyl group, a sulfonamide group, a sulfamoyl group and a halogen atom. Also, the substituent for the alkyl group may include the substituents set forth for the above aryl group, except an alkyl group.

Particularly preferable ballast group may include the compound represented by General Formula (CC-4) shown below.

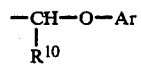

General Formula (CC-4)

$R^{10}$ represents a hydrogen atom or an alkyl group having 1 to 12 carbon atoms, Ar represents an aryl group such as a phenyl group, and the aryl group may include one having a substituent. The substituent may include an alkyl group, a hydroxyl group, an alkylsulfonamide group, etc., and most preferable one includes a branched alkyl group such as t-butyl group.

In General Formulas (CC-1), (CC-2) and (CC-3), the groups eliminable through the reaction with an oxidized product of an aromatic primary amine type color developing agent, each represented by Z, may include those known to a person skilled in the art, and also those which may advantageously act as modifying the reactivity of a coupler, or being eliminated from a coupler to achieve functions such as development restraint, bleach restraint and color correction in the coated layers containing the coupler or other layers in a light-sensitive silver halide color photographic material. Typically, they may include, for example, a halogen atom typified by chlorine and fluorine, an alkoxy group, an aryloxy group, an arylthio group, a carbamoyloxy group, an acyloxy group, a sulfonyloxy group, a sulfonamide group, or a heteroylthio group, a hetroyloxy group, etc. Z is particularly preferably a hydrogen atom or a chlorine atom.

More specifically, they are disclosed in Japanese Unexamined Patent Publication Nos. 10135/1975, 120334/1975, 130441/1975, 48237/1979, 146828/1976, 14736/1979, 37425/1972, 123341/1975 and 95346/1983; Japanese Patent Publication No. 36894/1973; U.S. Pat. Nos. 3,476,563, 3,737,316 and 3,227,551.

Typical examples of the cyan couplers represented by General Formula (CC-1) are shown below, but by no means limited to these.

C-1

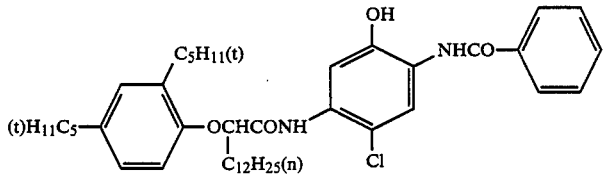

-continued
C-2
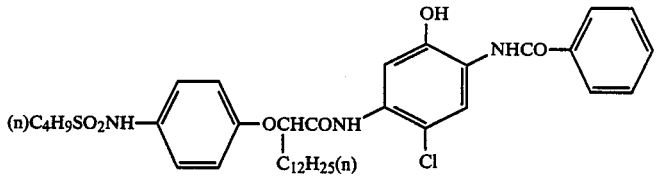
C-3
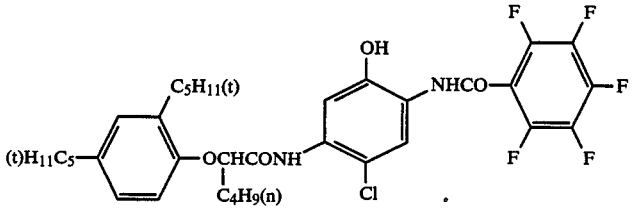
C-4
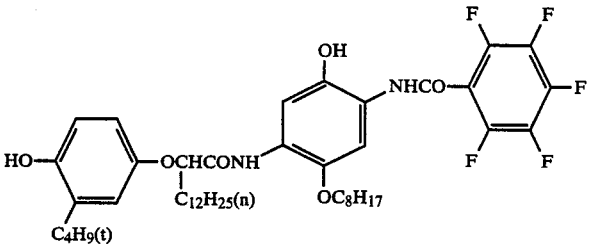
C-5
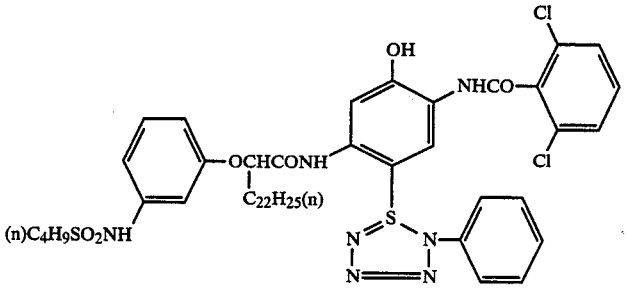
C-6
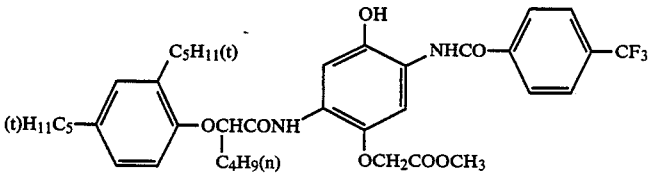
C-7
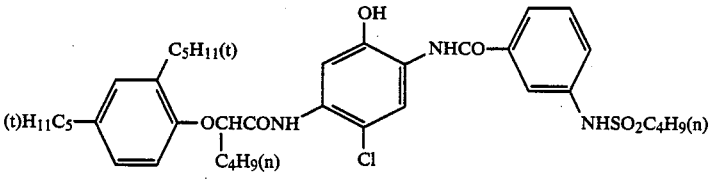
C-8
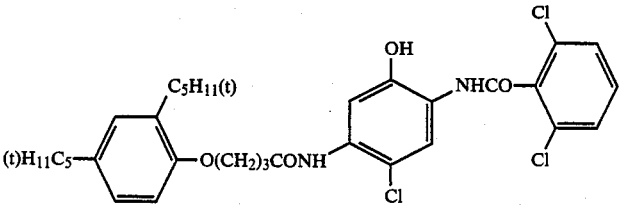

-continued
C-9
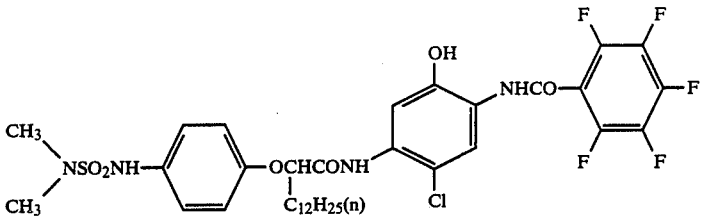
C-10
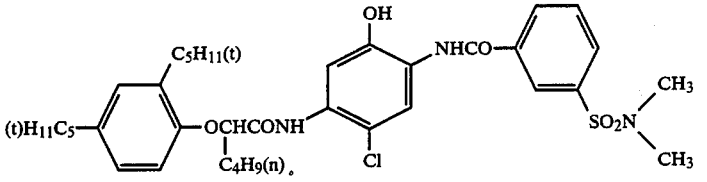
C-11
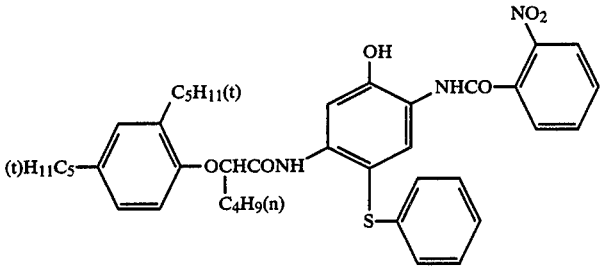
C-12
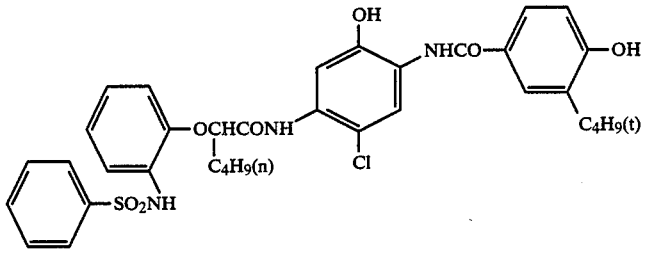
C-13
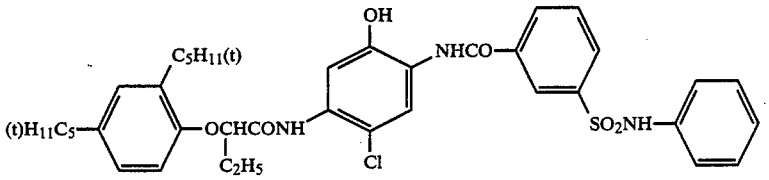
C-14
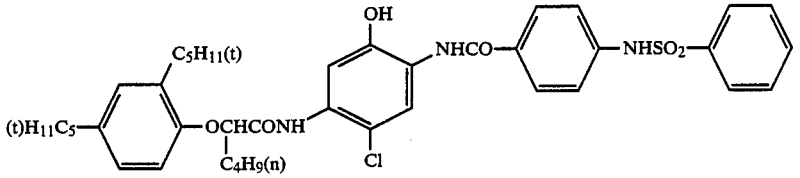
C-15
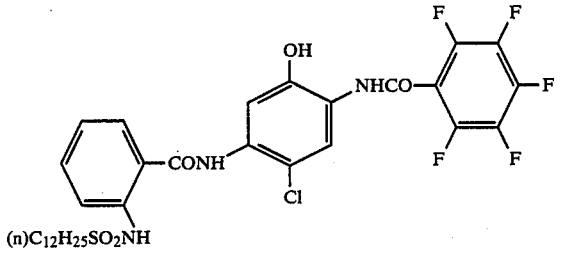

-continued
C-16
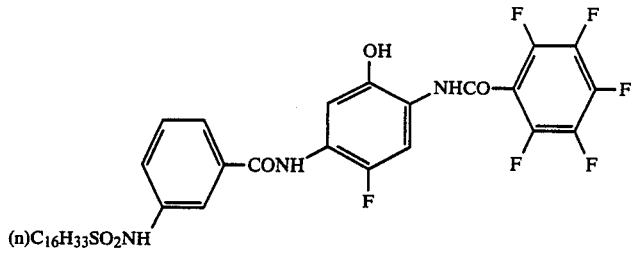
C-17
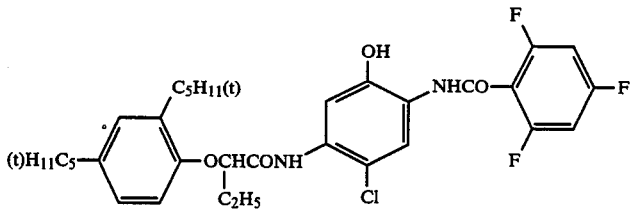
C-18
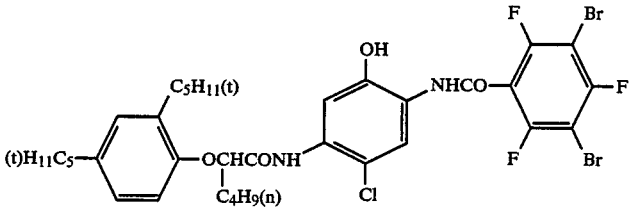
C-19
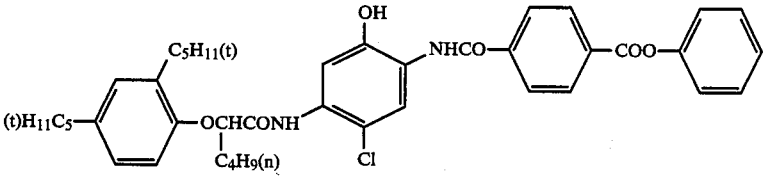
C-20
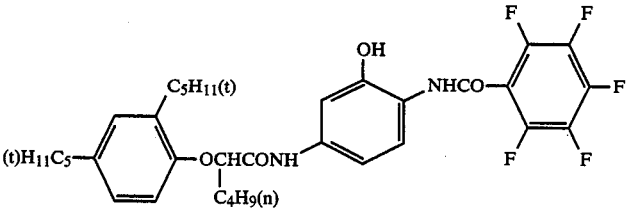
C-21
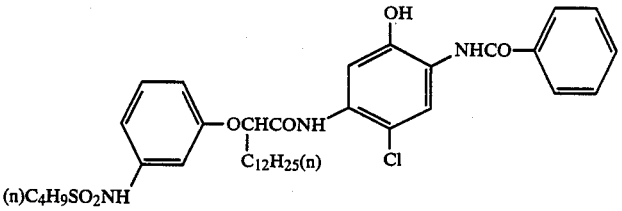
C-22
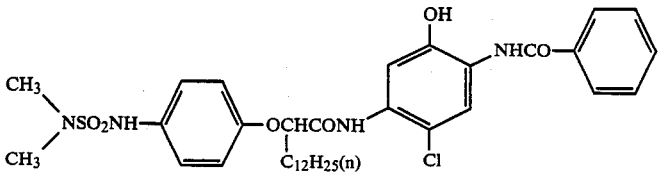

-continued
C-23
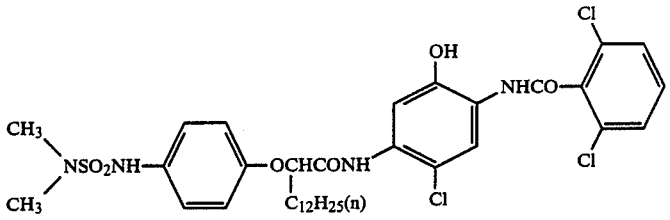
C-24
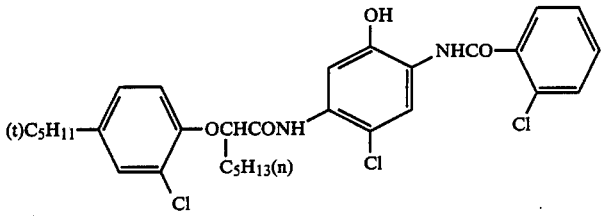
C-25
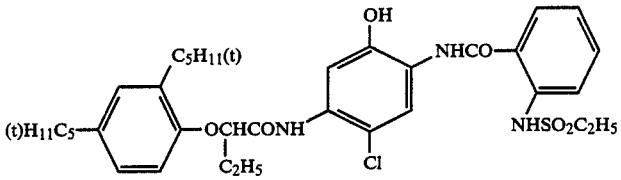
C-26
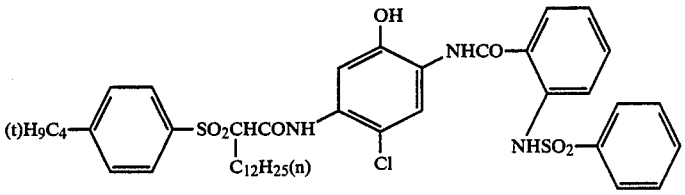
C-27
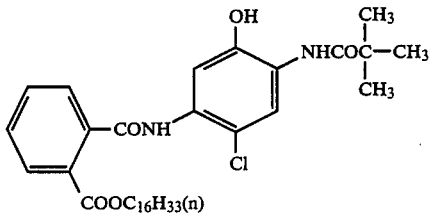
C-28
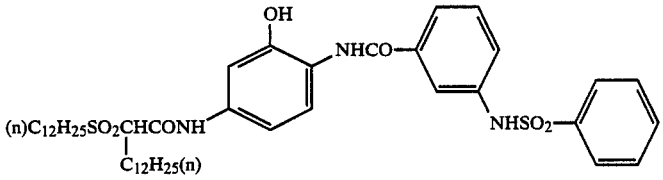
C-29
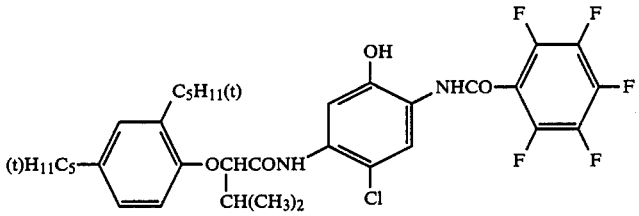

-continued
C-30
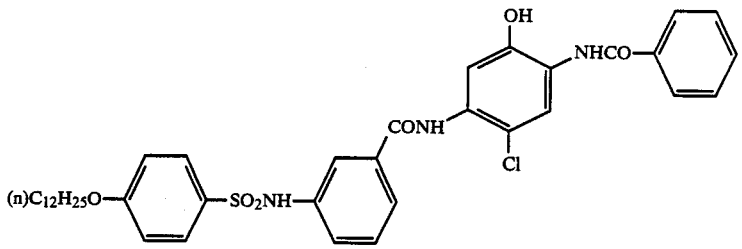
C-31
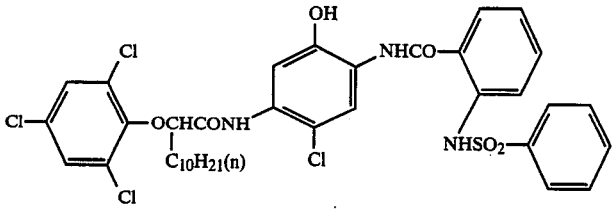
C-32
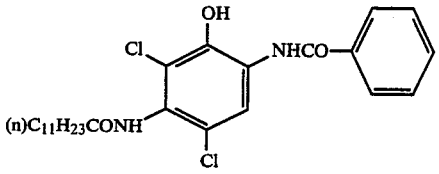
Typical examples of the cyan couplers represented by General Formula (CC-2) are shown below, but by no means limited to these.
General Formula (CC-2)
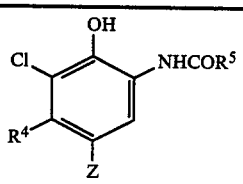
| Coupler No. | $R^4$ | Z | $R^5$ |
|---|---|---|---|
| C-33 | $-C_2H_5$ | $-Cl$ | 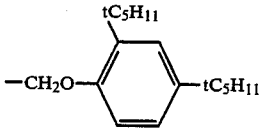 |
| C-34 | $-C_2H_5$ | 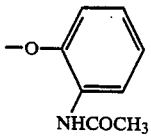 | 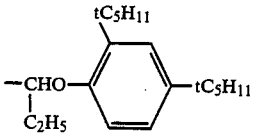 |
| C-35 | 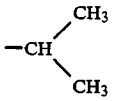 | $-Cl$ | 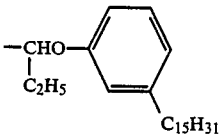 |
| C-36 | $-C_2H_5$ | $-Cl$ | 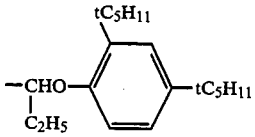 |

-continued
General Formula (CC-2)
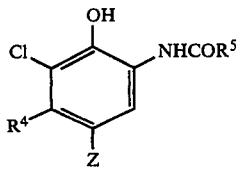
| Coupler No. | $R^4$ | Z | $R^5$ |
|---|---|---|---|
| C-37 | $-C_2H_5$ | $-Cl$ | 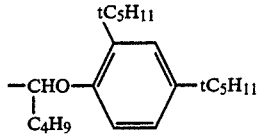 |
| C-38 | $-C_4H_9$ | $-F$ | 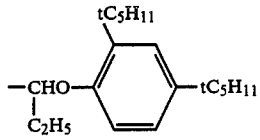 |
| C-39 | $-C_2H_5$ | $-F$ | 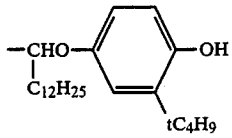 |
| C-40 | $-C_2H_5$ | $-Cl$ | 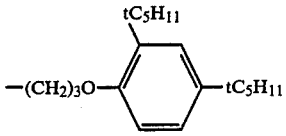 |
| C-41 | $-C_2H_5$ | $-F$ | 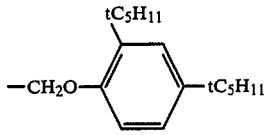 |
| C-42 | $-CH_3$ | $-Cl$ | 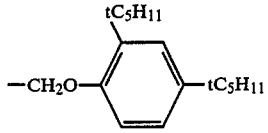 |
| C-43 | $-C_2H_5$ | $-Cl$ | 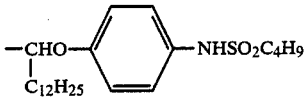 |
| C-44 | $-C_2H_5$ | $-Cl$ | 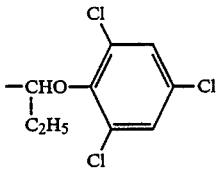 |
| C-45 | $-CH(CH_3)_2$ | $-Cl$ | $-C_{18}H_{37}$ |
| C-46 | $-C_2H_5$ | $-F$ | 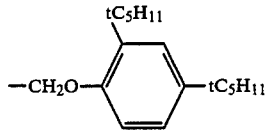 |

-continued
General Formula (CC-2)
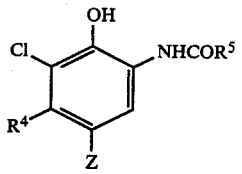
| Coupler No. | $R^4$ | Z | $R^5$ |
|---|---|---|---|
| C-47 | $-CH_3$ | $-Cl$ | 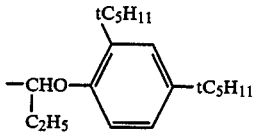 |
| C-48 | $-C_2H_5$ | $-Cl$ | 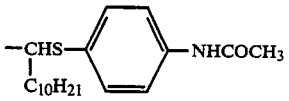 |
| C-49 | $-C_3H_7$ | $-Cl$ | 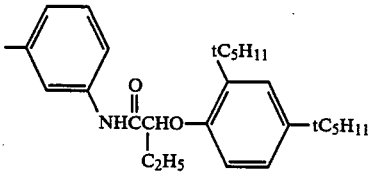 |
| C-50 | $-C_3H_7$ | $-Cl$ | 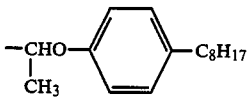 |
| C-51 | $-C_2H_4NHCCH_3$ ‖ O | $-Cl$ | 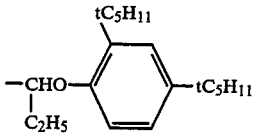 |
| C-52 | $-C_3H_6OCH_3$ | $-Cl$ | 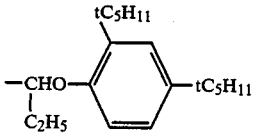 |
| C-53 | $-C_2H_5$ | $-Cl$ | 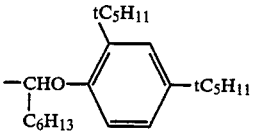 |
| C-54 | $-C_2H_5$ | $-Cl$ | 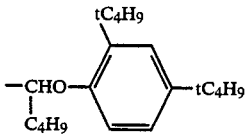 |
| C-55 | $-CH(CH_3)_2$ | $-Cl$ | 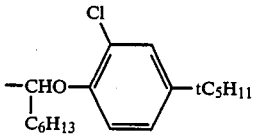 |

-continued
General Formula (CC-2)
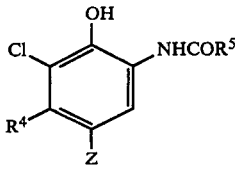
| Coupler No. | $R^4$ | Z | $R^5$ |
|---|---|---|---|
| C-56 | $-C_2H_5$ | $-Cl$ | 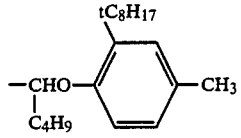 |
| C-57 | $-C_2H_5$ | $-Cl$ | 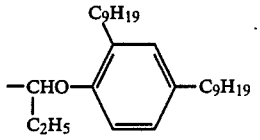 |
| C-58 | $-C_4H_9$ | $-OCH_2CH_2SO_2CH_3$ | 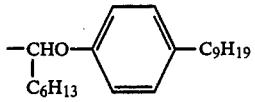 |
| C-59 | $-C_2H_5$ | $-Cl$ | 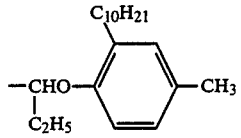 |
| C-60 | $-C_4H_9$ | 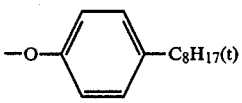 | 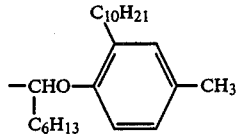 |
| C-61 | $-C_2H_5$ | $-Cl$ | 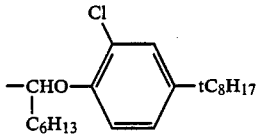 |
| C-62 | $-C_2H_5$ | $-OCH_2CH_2SCHCOOH$ $\vert$ $C_2H_5$ | 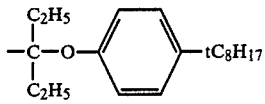 |
| C-63 | $-C_2H_5$ | $-Cl$ | 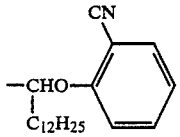 |
| C-64 | $-C_2H_5$ | $-Cl$ | 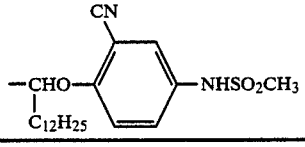 |
The yellow dye-forming couplers used in this invention may preferably include the compounds represented by General Formula (Y) shown below.
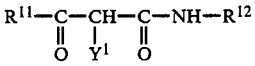
General Formula (Y)

In the formula, $R^{11}$ represents an alkyl group (for example, a methyl group, an ethyl group, a propyl group, a butyl group, etc.) or an aryl group (for example, a phenyl group, a p-methoxyphenyl group, etc.); $R^{12}$ represents an aryl group; and $Y^1$ represents a hydrogen atom or a group eliminable through the course of the color development reaction.

Further, particularly preferable dye-forming yellow couplers according may include the compounds represented by General Formula (Y') shown below.

General Formula (Y')

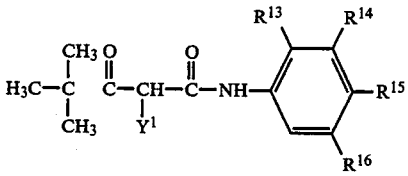

In the formula, $R^{13}$ represents a halogen atom, an alkoxy group or an aryloxy group; $R^{14}$, $R^{15}$ and $R^{16}$ each represents a hydrogen atom, a halogen atom, an alkyl group, an alkenyl group, an alkoxy group, an aryl group, an aryloxy group, a carbonyl group, a sulfonyl group, a carboxyl group, an alkoxycarbonyl group, a carbamyl group, a sulfone group, a sulfamyl group, a sulfonamide group, an acylamide group, an ureido group or an amino group; and $Y^1$ has the same meaning as defined before.

These compounds are disclosed in U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072, and 3,894,875; German Unexamined Patent Publication Nos. 15 47 868, 20 57 941, 21 62 899, 21 63 812, 22 13 461, 22 19 917, 22 61 361 and 22 63 875; Japanese Patent Publication No. 13576/1974; Japanese Unexamined Patent Publication Nos. 29432/1973, 66834/1973, 10736/1974, 122335/1974, 28834/1975 and 132926/1975; etc.

Specific examples of the yellow couplers represented by General Formula (Y) are shown below, but this invention is by no means limited to these.

Y-1

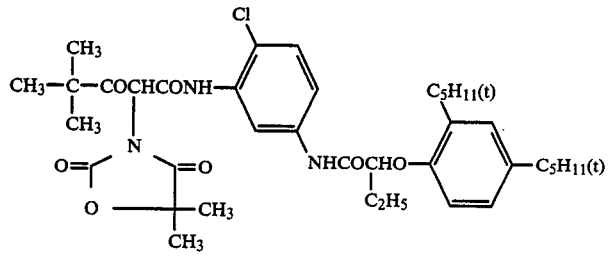

Y-2

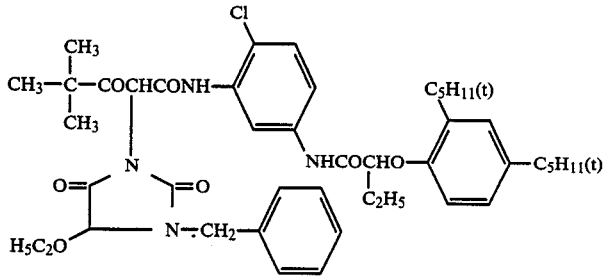

Y-3

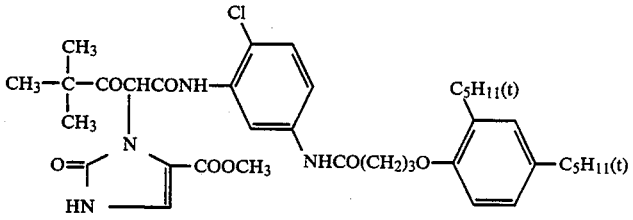

Y-4

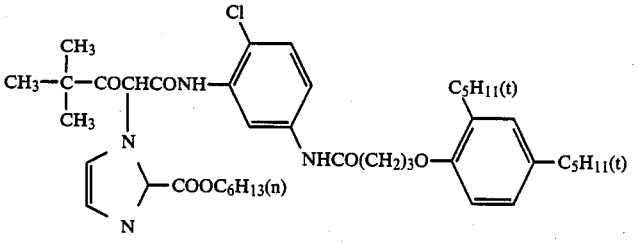

-continued
Y-5
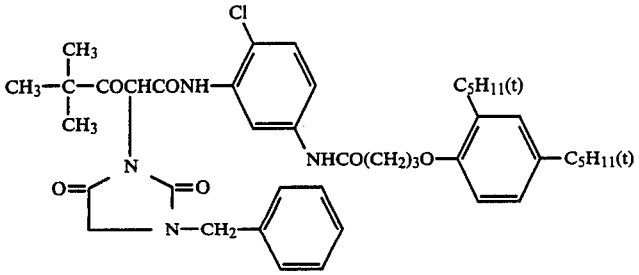
Y-6
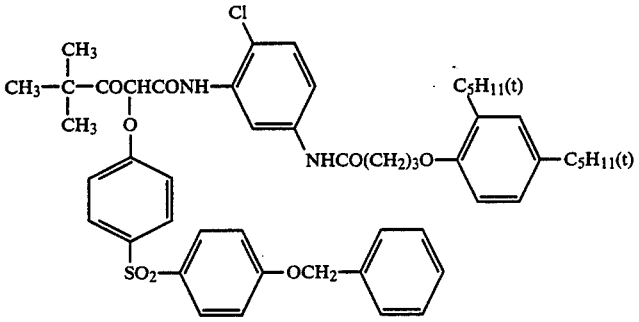
Y-7
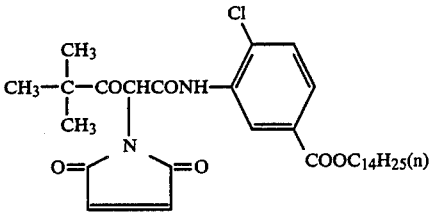
Y-8
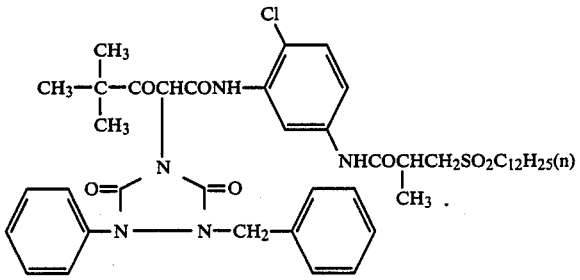
Y-9
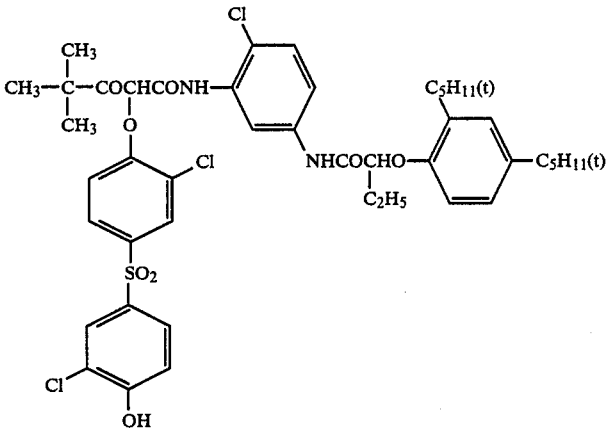

-continued

Y-10

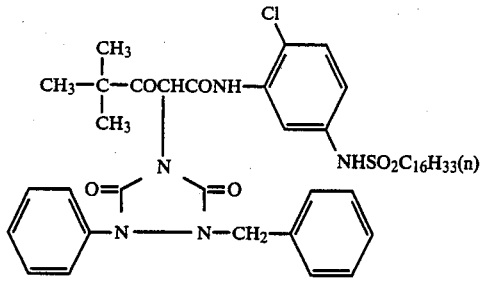

A color fog preventive agent can be used in order to prevent color turbidity from being caused by the migration of an oxidized product or an electron migrator of a developing agent between emulsion layers (between the same color sensitive layers and/or different color sensitive layers) of the light-sensitive material, or prevent the deterioration of sharpness or prevent overly conspicuous graininess.

The color fog preventive agent may be contained in the emulsion layers per se, or may be contained in an intermediate layer by providing the intermediate layer between adjacent emulsion layers.

The color fog preventive agent used in this invention may preferably include the compound represented by General Formula (HQ) shown below:

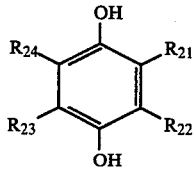

General Formula (HQ)

In the formula, $R^{21}$, $R^{22}$, $R^{23}$ and $R^{24}$ each represent a hydrogen atom, a halogen atom, an alkyl group, an alkenyl groups, an aryl group, a cycloalkyl group, an alkoxy group, an aryloxy group, an alkylthio group, an arylthio group, an acyl group, an alkylacylamino group, an arylacylamino group, an alkylcarbamoyl group, an arylcarbamoyl group, an alkylsulfonamide group, an arylsulfonamide group, an alkylsulfamoyl group, an arylsulfamoyl group, an alkylsulfonyl group, an aryl sulfonyl group, a nitro group, a cyano group, an alkylcarbonyl group, an aryloxycarbonyl group, an alkylacyloxy group or an arylacyloxy group. In the atoms or groups represented by $R^{21}$, $R^{22}$, $R^{23}$ and $R^{24}$, the halogen atom may include, for example, a fluorine atom, a chlorine atom and a bromine atom; and the alkyl group may include, for example, a methyl group, an ethyl group, a n-propyl group, an i-propyl group, a n-butyl group, a t-butyl group, a n-amyl group, an i-amyl group, a n-octyl group, a n-dodecyl, a n-octadecyl group, etc., and particularly preferably an alkyl group having 1 to 32 carbon atoms.

The alkenyl group may include group, for example, an aryl group, an octenyl, an oleyl group, etc., and particularly preferably an alkenyl group having 2 to 32 carbon atoms.

The aryl group may include, for example, a phenyl group, a naphthyl group, etc.

The acyl group may include, for example, an acetyl group, an octanoyl group, an lauroyl group, etc.

The cycloalkyl group may include, for example, a cyclohexyl group, a cyclopentyl group, etc.

The alkoxy group may include, for example, a methoxy group, an ethoxy group, a dodecyloxy group, etc.; the aryloxy group may include, for example, a phenoxy group, etc.; the alkylthio group may include, for example, a methylthio group, a n-butylthio group, a n-dodecylthio group, etc.; the arylthio group may include, for example, a phenylthio group, etc.; the alkylacylamino group may include, for example, an acetylamino group, etc.; the arylacylamino group may include, for example, a benzoylamino group, etc.; the alkyl carbamoyl group may include, for example, a methylcarbamoyl group, etc.; the arylcarbamoyl group may include, for example, a phenylcarbamoyl group, etc.; the alkylsulfonamide group may include, for example, a methylsulfonamide group, etc.; the arylsulfonamide group may include, for example, a phenylsulfonamide group, etc.; the alkylsulfamoyl group may include, for example, a methylsulfamoyl group, etc.; the arylsulfamoyl group may include, for example, a phenylsulfamoyl group, etc.; the alkylsulfonyl group may include, for example, a methylsulfonyl group, etc.; the arylsulfonyl group may include, for example, a phenylsulfonyl group, etc.; the alkyloxycarbonyl group may include, for example, a methyloxycarbonyl group, etc.; the aryloxycarbonyl group may include, for example, a phenyloxycarbonyl group, etc.; the alkylacyloxy group may include, for example, an acetyloxy group, etc.; and the arylacyloxy group may include, for example, a benzoyloxy group, etc.

These groups may include those having a substituent, and such substituent may include, for example, an alkyl group, an aryl group, an aryloxy group, an alkylthio group, a cyano group, an acyloxy group, an alkoxycarbonyl group, an acyl group, a sulfamoyl group, a hydroxyl group, a nitro group, an amino group and a heterocyclic group.

At least one of the groups represented by $R^{21}$ and $R^{23}$ is a group wherein the sum of the carbon atom number of the groups including those set forth above is 6 or more.

Of the compound represented by General Formula (HQ), the compound represented by General Formula (HQ') shown below can be particularly preferably used.

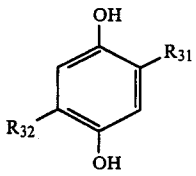

General Formula (HQ')

In the formula, $R^{31}$ and $R^{32}$ each represent a hydrogen atom, an alkyl group, an alkenyl group, an aryl group, an acyl group, a cycloalkyl group or a heterocyclic group, provided, however, that at least one of $R^{31}$ and $R^{32}$ is a group wherein the sum of the carbon atom number is 6 or more.

In the above General Formula (HQ'), the alkyl group represented by $R^{31}$ and $R^{32}$ may include, for example, a methyl group, an ethyl group, a n-propyl group, an i-propyl group, a n-butyl group, a t-butyl group, a n-amyl group, an i-amyl group, a n-octyl group, a n-dodecyl group, a n-octadecyl group, etc., and particularly preferably includes an alkyl group having 1 to 32 carbon atoms.

The alkenyl group may include, for example, an allyl group, an octenyl group, an oleyl group, etc., and particularly preferably includes an alkenyl group having 2 to 32 carbon atoms.

The aryl group may include, for example, a phenyl group, a naphthyl group, etc.

The acyl group may include, for example, an acetyl group, an octanoyl group, a lauroyl group, etc. The cycloalkyl group may include, for example, a cyclohexyl group, a cyclopentyl group, etc.

The heterocyclic group may include, for example, an imidazolyl group, a furyl group, a pyridyl group, a triazinyl group, a thiazolyl group, etc.

In the above General Formula (HQ'), at least one of the groups represented by $R^{31}$ and $R^{32}$ is a group wherein the sum of the carbon atom number is 8 or more, preferably both of $R^{31}$ and $R^{32}$ are each a group wherein the sum of the carbon atom number is 8 to 18, and most preferably both of $R^{31}$ and $R^{32}$ are commonly an alkyl group wherein the sum of the a carbon atom number is 8 to 18.

Specific examples of the compound represented by the above General Formula (HQ) used in this invention are set forth below, but, of course, by no means limited to these.

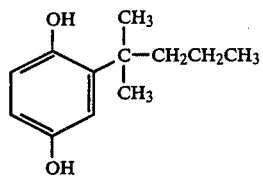
(HQ-1)

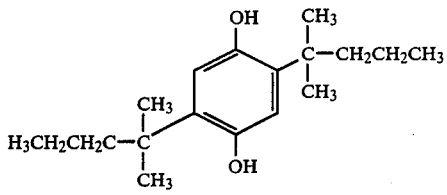
(HQ-2)

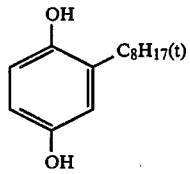
(HQ-3)

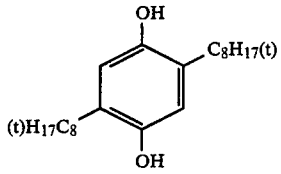
(HQ-4)

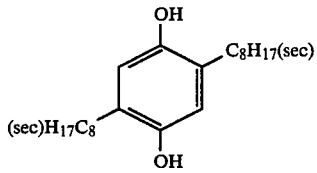
(HQ-5)

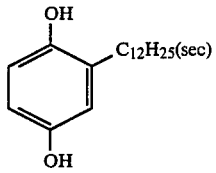
(HQ-6)

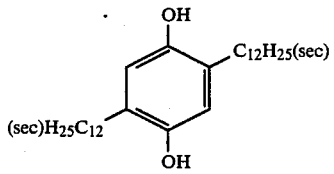
(HQ-7)

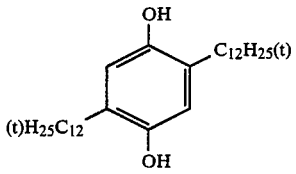
(HQ-8)

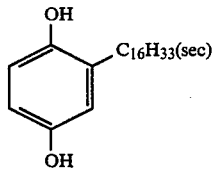
(HQ-9)

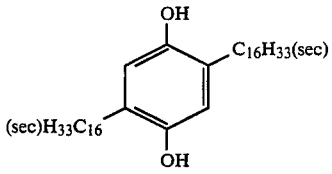
(HQ-10)

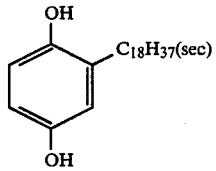
(HQ-11)

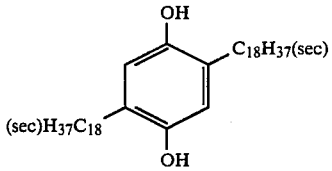
(HQ-12)

-continued
(HQ-13)
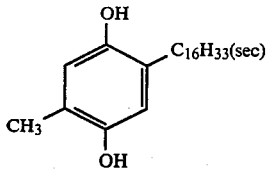
(HQ-14)
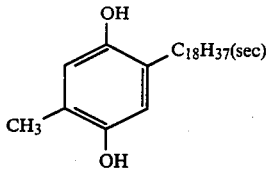
(HQ-15)
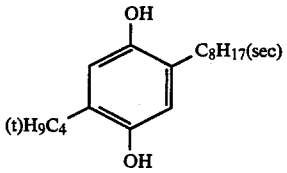
(HQ-16)
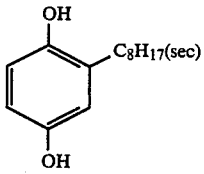
(HQ-17)
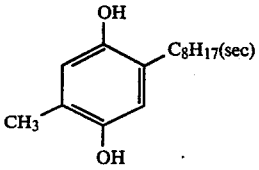
(HQ-18)
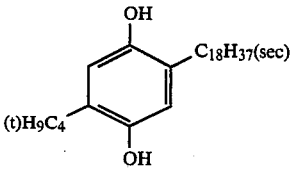
(HQ-19)
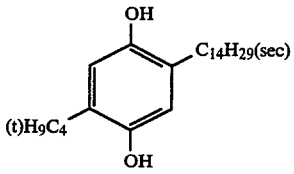
(HQ-20)
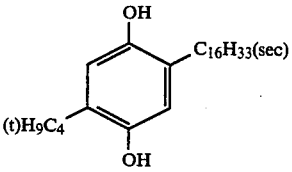
(HQ-21)
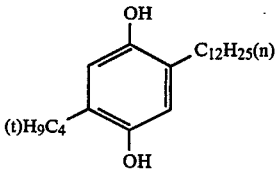
(HQ-22)
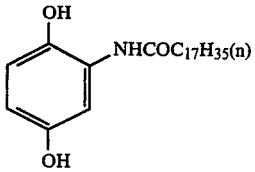
(HQ-23)
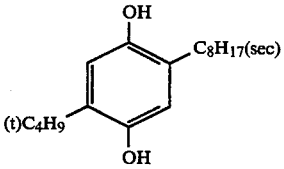
(HQ-24)
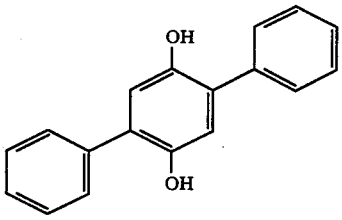
(HQ-25)
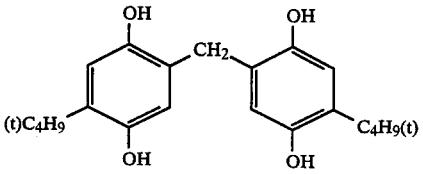
(HQ-26)
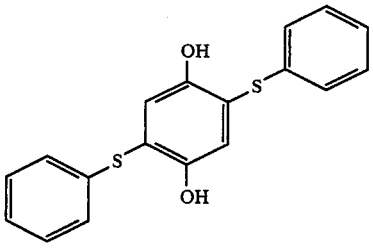
(HQ-27)
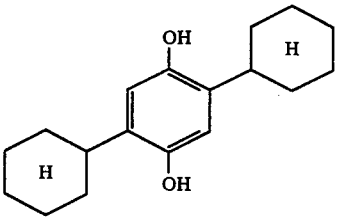
(HQ-28)
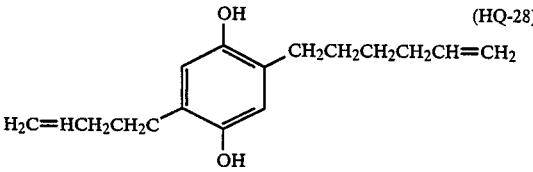

-continued (HQ-29)

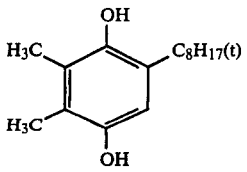

(HQ-30)

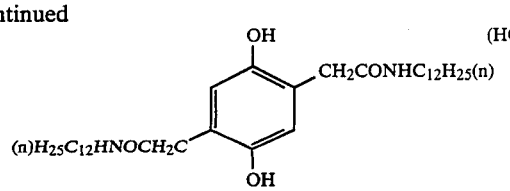

(HQ-31)

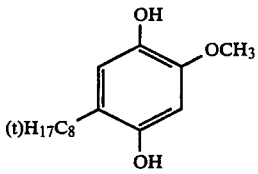

(HQ-32)

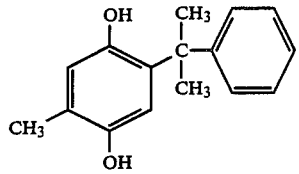

(HQ-33)

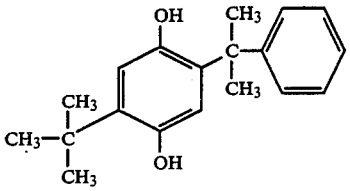

(HQ-34)

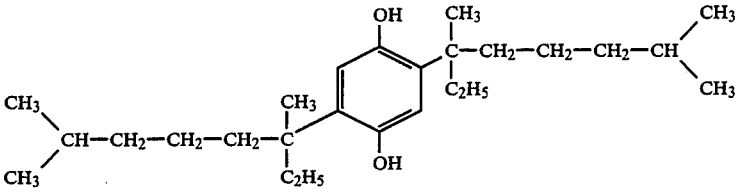

(HQ-35)

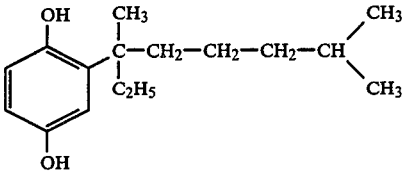

(HQ-36)

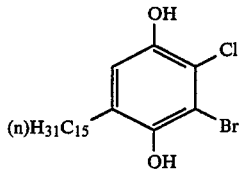

These compounds are disclosed, for example, in Research Disclosure No. 176 (1978), Paragraph 17643, VIII.

The compound represented by the above General Formula (HQ) may be added preferably in an amount of $1\times10^{-8}$ mole to $1\times10^{-4}$ mole/dm$^2$, more preferably $1\times10^{-7}$ mole to $1\times10^{-5}$ mole/dm$^2$.

In the light-sensitive silver halide photographic material of this invention, an image stabilizing agent can be used for the purpose of preventing dye images from being deteriorated.

The image stabilizing agent preferably used in this invention may include the compound represented by General Formula (A) on page 101 in Japanese Patent Application No. 117493/1960 (specifically, exemplary compounds A-1 to A-32 shown on pages 109 to 116 of the same), the compound represented by General Formula (B) on page 117 in Japanese Patent Application No. 117493/1960 (specifically, exemplary compounds B-1 to B-55 shown on pages 123 to 127 of the same), the compound represented by General Formula (C) on page 128 in Japanese Patent Application No. 117493/1960 (specifically, exemplary compounds C-1 to C-17 shown on pages 133 to 134 of the same), the compound represented by General Formula (D) on page 128 in Japanese Patent Application No. 117493/1960 (specifically, exemplary compounds D-1 to D-11 shown on pages 135 to 136 of the same), the compound represented by General Formula (E) on page 137 in Japanese Patent Application No. 117493/1960 (specifically, exemplary compounds E-1 to E-42 shown on pages 143 to 147 of the same), the compound represented by General Formula (F) on page 148 in Japanese Patent Application No. 117493/1960 (specifically, exemplary compounds F-1 to F-47 shown on pages 155 to 159 of the same), the compound represented by General Formula (G) on page 160 in Japanese Patent Application No. 117493/1960 (specifically, exemplary compounds G-1 to G-45 shown on pages 164 to 166 of the same), the compound represented by General Formula (H) on page 167 in Japanese Patent Application No. 117493/1960 (specifically, exemplary compounds H-1 to H-36 shown on pages 171 to 174 of the same), the compound represented by General Formula (J) on page 175 in Japanese Patent Application No. 117493/1960 (specifically, exemplary compounds J-1 to J-74 shown on pages 178 to 183 of the same), the compound represented by General Formula (K) on page 188 in Japanese Patent Application No. 117493/1960 (specifically, exemplary compounds K-1 to K-74 shown on pages 193 to 197 of the same), the compounds represented by General Formulas (L) and (M), respectively, on page 198 in Japanese Patent Application No. 117493/1960 (specifically, exemplary compounds L-1 to L-74 shown on pages 204 to 210 of the same and exemplary compounds M-1 to M-3 shown on page 211 of the same), the compound represented by General Formula (N) on page 212 in Japanese Patent Application No. 117493/1960 (specifically, exemplary ccompounds N-1 to N-74 shown on pages 223 to 249 of the same).

Hydrophilic colloid layers such as protective layers and intermediate layers of the light-sensitive material of this invention may contain an ultraviolet absorbent in order to prevent the fog due to the discharge caused by static charge by friction or the like of light-sensitive materials and prevent the deterioration due to ultraviolet light.

The light-sensitive silver halide material of this invention can be provided with auxiliary layer such as a filter layer, an anti-halation layer and an anti-irradiation layer. These layers and/or the emulsion layers may contain a dye that may be flowed out of the light-sensitive material, or bleached, during the development processing.

To the silver halide emulsion layers and/or other hydrophilic colloid layers of the light-sensitive material of this invention, a matte agent can be added for the purposes of decreasing the gloss of the light-sensitive material, improving the writing performance, and preventing mutual sticking of light-sensitive materials.

A lubricant can be added to the light-sensitive material of this invention, in order to decrease sliding friction.

An antistatic agent aiming at preventing static charge can be added to the light-sensitive material of this invention. The antistatic agent may be used in an antistatic layer provided on the side of a support at which no emulsion layer is laminated, or may be used in an emulsion layer and/or a protective colloid layer other than the emulsion layers provided on the side of a support on which emulsion layers are laminated.

In the photographic emulsion layers and/or other hydrophilic colloid layers of the light-sensitive material of this invention, a variety of surface active agents can be used for the purpose of improving coating performance, preventing static charge, improving slidability, emulsification dispersion, preventing adhesion, and improving photographic performances (such as development acceleration, hardening and sensitization).

The support used in the light-sensitive material of this invention can be applied on flexible reflective supports made of baryta paper, paper laminated with $\alpha$-olefin polymers or synthetic paper; films comprising semisynthetic or synthetic high molecular compounds such as cellulose acetate, cellulose nitrate, polystyrene, polyvinyl chloride, polyethylene terephthalate, polycarbonate and polyamide; rigid bodies such as glass, metals and ceramics; etc.

The light-sensitive material of this invention may be applied, as occasion calls, after having been subjected to corona discharging, ultraviolet irradiation, flame treatment and so forth, directly on the surface of the support or through interposition of one or more subbing layers for improving adhesion, antistatic performance, dimensional stability, abrasion resistance, hardness, anti-halation performance, friction characteristics and/or other characteristics of the surface of the support.

In the coating of the light-sensitive material of this invention, a thickening agent may be used in order to improve the coating performance. Particularly useful coating method may include extrusion coating and curtain coating by which two or more layers can be simultaneously coated.

The light-sensitive material of this invention can be exposed by use of electromagnetic wave having the spectral region to which the emulsion layers constituting the light-sensitive material of this invention have the sensitivity. As a light source, there can be used any known light sources including natural light (sunlight), a tungsten lamp, a fluorescent lamp, a mercury lamp, a xenon arc lamp, a carbon arc lamp, a xenon flash lamp, a cathode ray tube flying spot, every kind of laser beams, light from a light-emitting diode, light emitted from a fluorescent substance energized by electron rays, X-rays, gamma-rays, alpha-rays, etc.

As for the exposure time, it is possible to make exposure, not to speak of exposure of 1 millisecond to 1 second usually used in cameras, of not more than 1 microsecond, for example, 100 microseconds to 1 microsecond by use of a cathode ray tube or a xenon arc lamp, and it is also possible to make exposure longer than 1 second. Such exposure may be carried out continuously or may be carried out intermittently.

The light-sensitive silver halide material of this invention can form images by carrying out color development known in the art.

The aromatic primary amine type color developing agent used for a color developing solution in this invention includes known ones widely used in the various color photographic processes. These developing agents include aminophenol type and p-phenylenediamine type derivatives. These compounds, which are more stable than in a free state, are used generally in the form of a salt, for example, in the form of a hydrochloride or a sulfate. Also, these compounds are used generally in concentration of about 0.1 to 30 g per 1 liter of a color developing solution, preferably in concentration of about 1 to 15 g per 1 liter of a color developing solution.

The aminophenol type developing agent may include, for example, o-aminophenol, p-aminophenol, 5-amino-2-oxytoluene, 2-amino-3-oxy-toluene, 2-oxy-3-amino-1,4-dimethyl-benzene, etc.

Most useful primary aromatic amine type color developing agent includes N,N'-dialkyl-p-phenylenediamine compound, wherein the alkyl group and the phenyl group may be substituted with any substituent. Of these, examples of particularly useful compounds may include N-N'-dimethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, 4-amino-N-(2-methoxyethyl)-N-ethyl-3-methylaniline-p-toluene sulfonate, etc.

In addition to the above primary aromatic amine type color developing agent, the color developing agent used in the processing according to this invention may also optionally contain various components usually added to a color developing agent, for example, alkali agents such as sodium hydroxide, sodium carbonate and potassium carbonate, alkali metal sulfites, alkali metal bisulfites, alkali metal thiocyanates, alkali metal halides, benzyl alcohol, water softeners, thickening agents, etc. This color developing solution may have usually the pH of 7 or more, most usually about 10 to 13.

In this invention, after color developing processing, processing by use of a processing solution having fixing ability is carried out. When the processing solution having fixing ability is a fixing solution, a bleaching is carried out beforehand. As a bleaching agent used in the bleaching step, there may be used a metal complex salt of an organic acid. The metal complex salt has an action to oxidize a metal silver formed by development to allow it to revert to silver halide, and, at the same time, color-develop a non-image portion of a coupler. It has the structure in which an ion of a metal such as iron, cobalt, cupper, etc. is coordinated with an organic acid such as an aminopolycarboxylic acid or oxalic acid, citric acid, etc. The organic acid must preferably used for the formation of the metal complex salt of such an organic acid may include polycarboxylic acid or aminopolycarboxylic acid. The polycarboxylic acid or aminopolycarboxylic acid may be in the form of an alkali metal salt, an ammonium salt or a water soluble amine salt.

Typical examples of these may include the following:

(1) Ethylenediaminetetraacetic acid
(2) Nitrilotriacetic acid
(3) Iminodiacetic acid
(4) Disodium ethylenediaminetetraacetate
(5) Tetra(trimethylammonium) ethylenediaminetetraacetate
(6) Tetrasodium ethylenediaminetetraacetate
(7) Sodium nitrilotriacetate A bleaching solution to be used may contain as the bleaching agent the above metal complex salt of the organic acid, and also contain various additives. Preferably, the additives to be contained may include, in particular, re-halogenating agents such as an alkali halide and an ammonium halide, for example, potassium bromide, sodium bromide, sodium chloride, ammonium bromide, etc., a metal salt and a chelating agent. Also, there may be optionally added those which are known to be usually added to a bleaching solution, including pH buffering agents such as borate, oxalate, acetate, carbonate and phosphate, alkylamines, polyethyleneoxides, etc.

Further, the fixing solution and bleach-fixing solution may contain a pH buffering agent including sulfites such as ammonium sulfite, potassium sulfite, ammonium bisulfite, potassium bisulfite, sodium bisulfite, ammonium metabisulfite, potassium metabisulfite and sodium metabisulfite, and boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide, etc., which may be added singularly or in combination of two or more.

When the processing of this invention is carried out while replenishing a bleach-fixing replenishing agent in a bleach-fixing solution (or bath), the bleach-fixing solution (or bath) may contain a thiosulfate, a thiocyanate or a sulfite, etc., or these salts may be contained in a bleach-fixing replenishing solution which is replenished to the processing bath.

In this invention, if desired, blowing of air or blowing of oxygen may be carried out in the bleach-fixing bath and in a storage tank for the bleach-fixing replenishing solution in order to enhance the activity in the bleach-fixing solution, or a suitable oxidizing agent including, for example, hydrogen peroxide, bromate, persulfate, etc. may be added.

The light-sensitive silver halide photographic material of this invention has good dispersion stability of magenta couplers, excellent color reproducibility, and remarkably improved fastness to light of magenta dye images, and moreover has solved the problem of the softness in the gradation at the toe portion, which is a defect of an azole type magenta coupler, in particular, the pyrazolotriazole type magenta coupler. It also prevents the generation of M-stain at a non-image portion.

This invention will be described further specifically by the following examples.

EXAMPLE 1

Forty grams (40 g) each of the magenta coupler according to this invention as shown in Table 1 and the comparative magenta coupler M-1 as shown below and 20 g of the image stabilizing agent as shown in Table 1 were dissolved in a mixed solvent comprising 30 ml of dioctyl phthalate and 100 ml of ethyl acetate, and the solution obtained was added to 600 ml of a 5% gelatin solution containing 3 g of the surface active agent of this invention as shown in Table 1 or the comparative surface active agent as shown below, followed by emulsification dispersion by means of an ultrasonic homogenizer for 30 minutes to obtain dispersions, and the turbidity thereof was measured immediately after the dispersion and after allowing them to stand at 40° C. for 5 hours, with use of a tubidimeter produced by Nihon Seimitsu Kogaku K.K. (SEP-PT-501D Type). The dispersion state of dispersions can be indicated by measuring the turbidity of the dispersions. The lower the turbidity is, the finer the dispersion state of grains is.

Results obtained are shown in Table 1.

Comparative magenta couplers

M-1

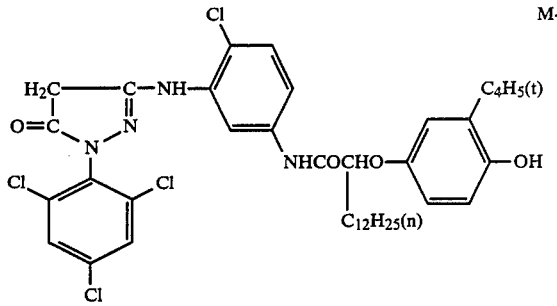

B-35

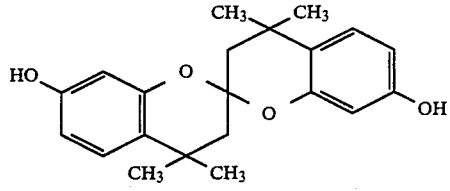

Comparative surface active agent T-1
Sodium triisopropylnaphthalene sulfonate
Comparative surface active agent T-2
Sodium dodecylbenzene sulfonate

TABLE 1

| No. | Magenta coupler | Image stabilizing agent | Surface active agent | Turbidity (ppm) IAD* | Turbidity (ppm) 40° C. After 5 hrs. | Remarks |
|---|---|---|---|---|---|---|
| 1 | M-1 | — | T-1 | 11 | 15 | X |
| 2 | 44 | — | T-1 | 13 | 42 | X |
| 3 | M-1 | — | T-2 | 12 | 22 | X |
| 4 | 44 | — | T-2 | 15 | 39 | X |
| 5 | 44 | — | X-5 | 10 | 27 | Y |
| 6 | 44 | — | X-8 | 11 | 29 | Y |
| 7 | 44 | — | X-15 | 11 | 29 | Y |
| 8 | 5 | — | X-5 | 10 | 24 | Y |
| 9 | 58 | — | X-5 | 11 | 22 | Y |

TABLE 1-continued

| No. | Magenta coupler | Image stabilizing agent | Surface active agent | Turbidity (ppm) IAD* | Turbidity (ppm) 40° C. After 5 hrs. | Remarks |
|---|---|---|---|---|---|---|
| 10 | 127 | — | X-5 | 11 | 23 | Y |
| 11 | 157 | — | X-15 | 11 | 22 | Y |
| 12 | M-1 | B-35 | T-1 | 24 | 33 | X |
| 13 | 44 | B-35 | T-1 | 31 | 77 | X |
| 14 | M-1 | B-35 | T-2 | 23 | 31 | X |
| 15 | 44 | B-35 | T-2 | 30 | 74 | X |
| 16 | 44 | B-35 | X-5 | 20 | 29 | Y |
| 17 | 44 | B-35 | X-8 | 21 | 30 | Y |
| 18 | 44 | B-35 | X-15 | 23 | 32 | Y |
| 19 | 5 | B-35 | X-5 | 20 | 29 | Y |
| 20 | 59 | B-35 | X-5 | 23 | 31 | Y |
| 21 | 127 | B-35 | X-5 | 22 | 30 | Y |
| 22 | 157 | B-35 | X-5 | 24 | 31 | Y |

IAD*: Immediately after dispersion
X: Comparative example
Y: Present invention

As will be clear from Table 1, it is seen that samples No. 2, No. 4, No. 13 and No. 15 in which the magenta couplers of this invention were subjected to emulsification dispersion by use of the comparative surface active agents show high turbidity immediately after the emulsification dispersion carried out for a prescribed time, and also show high increase in the turbidity after allowing them to stand at 40° C. for 5 hours. However, samples Nos. 5 to 11 and 16 to 22 in which the magenta couplers of this invention were subjected to emulsification dispersion by use of the surface active agents of this invention show low turbidity immediately after the dispersion, and also show small increase in the turbidity after allowing them to stand at 40° C. for 5 hours.

EXAMPLE 2

Coating solutions for the respective layers were prepared so as to have the constitution as shown in Tables 2 and 3, and were applied successively from the support side to produce multi-layer light-sensitive silver halide color photographic materials.

Samples thus produced were exposed according to tests, and then processed according to the processing steps shown below.

Standard processing steps (Processing temperature and processing time):

| | | | |
|---|---|---|---|
| [1] | Color developing | 38° C. | 3 min. 30 sec. |
| [2] | Bleach-fixing | 33° C. | 1 min. 30 sec. |
| [3] | Washing with water | 25–30° C. | 3 min. |
| [4] | Drying | 75–80° C. | about 2 min. |

Composition of processing solutions used in each step is as follows:

| (Color developing solution) | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphorous acid (TPPS) | 2.5 g |
| 3-Methyl-4-amino-N—ethyl-N—(ethyl β-methanesulfonamide)-aniline sulfate | 5.5 g |
| Brightening agent (a 4,4'-diaminostylbenzsulfonic acid derivative) | 1.0 g |
| Potassium hydroxide | 2.0 g |
| Made up to one liter in total amount by adding water, and adjusted to pH 10.20. | |

-continued

| (Bleach-fixing tank solution) | |
|---|---|
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |

Adjusted to pH 7.1 by use of potassium carbonate or glacial acetic acid, and made up to one liter in total amount by adding water.

TABLE 2

| Layer | Constitution |
|---|---|
| Seventh layer (Protective layer) | Gelatin (1.9 g/m$^2$) |
| Sixth layer (Third intermediate layer) | Gelatin (1.0 g/m$^2$)<br>Ultraviolet absorbents<br>UV-1 (0.2 g/m$^2$)<br>UV-2 (0.1 g/m$^2$)<br>Antistain agent HQ-4 (0.02 g/m$^2$)<br>High boiling solvent, dinonyl phthalate (0.2 g/m$^2$)<br>Gelatin (1.2 g/m$^2$) |
| Fifth layer (Red-sensitive layer) | Gelatin (1.2 g/m$^2$)<br>Silver chlorobromide emulsion [containing 70 mole % of AgBr] (silver weight: 0.25 g/m$^2$)<br>Cyan coupler [C-29/C-47] (0.4 mole per 1 mole of silver halide)<br>Antistain agent HQ-4 (0.01 g/m$^2$)<br>High boiling solvent, dioctyl phthalate (0.2 g/m$^2$) |
| Fourth layer (Third intermediate layer) | Gelatin (1.5 g/m$^2$)<br>Ultraviolet absorbent<br>UV-1 (0.5 g/m$^2$)<br>UV-2 (0.2 g/m$^2$)<br>Antistain agent HQ-4 (0.03 g/m$^2$)<br>High boiling solvent, dinonyl phthalate (0.3 g/m$^2$) |
| Third layer (Green-sensitive layer) | Gelatin (1.5 g/m$^2$)<br>Chlorobromide emulsion [containing 70 mole % of AgBr]<br>( Comparative M-1 0.3 g/m$^2$<br>Magenta coupler of this invention 0.15 g/m$^2$ )<br>Magenta coupler [Table 3] (0.4 g/m$^2$)<br>Antistain agent HQ-4 (0.01 g/m$^2$)<br>High boiling solvent [Table 3] (0.03 g/m$^2$)<br>Image stabilizing agent [B-35/J-1] (0.4 g/m$^2$)<br>Surface active agent for emulsification dispersion [Table 3] (0.06 g/m$^2$) |
| Second layer (First intermediate layer) | Gelatin (1.0 g/m$^2$)<br>Antistain agent HQ-4 (0.07 g/m$^2$)<br>High boiling solvent, diisodecyl phthalate (0.04 g/m$^2$) |
| First layer (Blue-sensitive layer) | Gelatin (2.0 g/m$^2$)<br>Silver chlorobromide layer (silver weight: 0.3 g/m$^2$)<br>Yellow coupler Y-5 (0.8 g/m$^2$)<br>Antistain agent HQ-4 (0.02 g/m$^2$)<br>High boiling solvent, dinonyl phthalate (0.3 g/m$^2$) |

TABLE 2-continued

| Layer | Constitution |
|---|---|
| Support | Polyethylene-coated paper |

Numeral in parenthesis indicates the coating weight or the amount of addition.

Ultraviolet absorbent (UV-1)

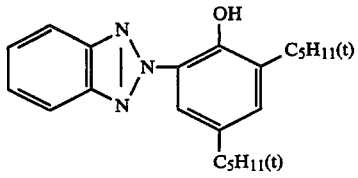

Ultraviolet absorbent (UV-2)

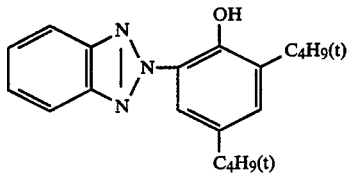

J-1

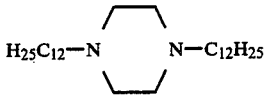

Test and evaluation methods:

(Fastness-to-light test on magenta dye image)

The fastness to light is indicated in terms of the retension of the density after 20 day irradiation based on the initial density $D_0=1.0$ when the magenta dye images obtained by processing were irradiated with sunlight for 20 days using an underglass weathering stand.

$$\text{Retension}=D/D_0\times 100(\%)$$

(Balance of fastness to light)

Gray color developed dye images obtained by processing were tested in the same manner as in the fastness-to-light test on the above magenta dye images, and the density of Y, M and C dyes before and after tests on the gray color developed dye images were measured by the respectively corresponding B, G and R light to find the balance of fastness to light.

$$C/M=\frac{\text{Cyan dye retension}}{\text{Magenta dye retension}}\times 100\ (\%)$$

$$Y/M=\frac{\text{Yellow dye retension}}{\text{Magenta dye retension}}\times 100\ (\%)$$

On the samples obtained by processing, the density of magenta color developed dye images was measured by using a photodensitometer (PDA-65 Type, produced by Konishiroku Photo Industry Co., Ltd.) to find the gamma value (assumed as $\gamma_2G$) at the density of 0.3 to 0.8 as the toe portion gradation.

(Gradation balance in three layers)

Gray color developed dye images were measured by blue (B) light, green (G) light and red (R) light to indicate the values in terms of $\gamma_2B$, $\gamma_2G$ and $\gamma_2R$, respectively, and the balance was evaluated as follows with $\gamma_2G$ as the center.

$$\gamma_2B/G=\gamma_2B/\gamma_2G$$

$$\gamma_2R/G=\gamma_2R/\gamma_2G$$

When appreciating as a print image, preferred are;

$$\gamma_2B/G\approx 100$$

$$\gamma_2R/G\approx 105$$

(M-stain)

Green density $D_G$ at non-image portions of the samples having been processed was measured to indicate the values as relative values to the value of Sample No. 26 assumed as 100.

If the values are on the level of Sample No. 26, they are in the range involving no problem.

Results obtained are shown in Table 3.

TABLE 3

| No. | Magenta coupler | Surface active agent | High bioling solvent | Fastness to light of magenta dye image (%) | Balance of fastness to light C/M | Balance of fastness to light Y/M | Toe portion gradation $\gamma_2G$ | Balance of toe portion gradation $\gamma_2B/G$ | Balance of toe portion gradation $\gamma_2R/G$ | M-stain | |
|---|---|---|---|---|---|---|---|---|---|---|---|
| 23 | M-1 | X-5 | DOP | 69 | 97 | 98 | 1.88 | 101 | 106 | 103 | X |
| 24 | M-1 | T-1 | DOP | 69 | 97 | 98 | 1.89 | 101 | 106 | 111 | X |
| 25 | 44 | T-1 | DOP | 65 | 92 | 93 | 1.81 | 105 | 110 | 110 | X |
| 26 | 44 | X-5 | DOP | 71 | 100 | 101 | 1.92 | 99 | 104 | 100 | Y |
| 27 | 44 | X-8 | DOP | 70 | 99 | 101 | 1.92 | 99 | 104 | 99 | Y |
| 28 | 44 | X-15 | DOP | 69 | 97 | 98 | 1.90 | 100 | 105 | 101 | Y |
| 29 | 5 | X-5 | DOP | 68 | 96 | 97 | 1.93 | 98 | 104 | 100 | Y |
| 30 | 59 | X-5 | DOP | 70 | 99 | 100 | 1.92 | 99 | 104 | 101 | Y |
| 31 | 127 | X-5 | DOP | 71 | 100 | 101 | 1.92 | 99 | 104 | 100 | Y |
| 32 | 159 | X-5 | DOP | 70 | 99 | 100 | 1.91 | 99 | 105 | 99 | Y |
| 33 | 44 | X-5 | DBP | 68 | 96 | 97 | 1.89 | 101 | 106 | 103 | Y |
| 34 | 44 | T-2 | DBP | 63 | 89 | 90 | 1.97 | 106 | 112 | 114 | X |
| 35 | M-1 | T-2 | DBP | 68 | 96 | 97 | 1.88 | 101 | 106 | 109 | X |

DOP: Dioctylphthalate
DBP: Dibutylphthalate
X: Comparative example
Y: Present invention As will be clear from Table 3, it is seen that Samples No. 26 to No. 33 show good fastness to light, balance of fastness to light, gradation at the toe portion, balance of gradation at the toe portion, and M-stain of the magenta dye images, as compared with Samples No. 25 and No. 34 in which the magenta couplers of this invention were subjected to emulsification dispersion by use of the comparative surface active agents and Samples No. 23, No. 24 and No. 35 in which the comparative magenta couplers were subjected to emulsification dispersion by use of the comparative surface active agents or the surface active agents of this invention.

EXAMPLE 3

Monolayer samples were produced by carrying out the dispersion same as in Example 1, preparing coating solutions same as the third layer in Example 2, and adding, as coating auxiliaries, surface active agents of this invention and comparative surface active agents to the coating solutions in an amount of 1 g per 1 liter of coating solution, so as to give the constitution shown in Table 4.

Tests were carried out in the same manner as in Example 2.

Results obtained are shown in Table 4.

TABLE 4

| No. | M-coupler | Image stabilizing agent | Image stabilizing agent at dispersion | Coating auxiliary | Fastness to light of magenta dye image | Toe portion gradation $\gamma_2G$ | M-stain | |
|---|---|---|---|---|---|---|---|---|
| 29 | 44 | B-35 | T-1 | T-1 | 57 | 1.78 | 110 | X |
| 30 | 44 | B-35 | X-5 | T-1 | 63 | 1.85 | 100 | Y |
| 31 | 44 | B-35 | T-1 | X-5 | 61 | 1.83 | 103 | Y |
| 32 | 44 | B-35 | X-5 | X-5 | 65 | 1.88 | 100 | Y |

X: Comparative example
Y: Present invention

As will be clear from Table 4, it is seen that there can be shown certain effects in the fastness to light, gradation at the toe portion and M-stain of the magenta dye images by using the surface active agent of this invention as a coating auxiliary even if the surface active agent of this invention is not used at the time of the emulsification dispersion, and there are obtained more desirable results when the surface active agent of this invention is used at the time of the emulsification dispersion and also as a coating auxiliary.

What is claimed is:

1. A light-sensitive silver halide photographic material comprising a support and provided thereon at least one silver halide emulsion layer, wherein at least one layer of said silver halide emulsion layer contains a compound represented by general formula [I],

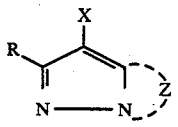

[I]

(wherein Z represents a group of non-metallic atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent); and a compound represented by general formula [1],

[1]

$$R^1(O)_nSO_3M$$

(wherein $R^1$ represents an alkyl group; M represents a hydrogen atom or a cation and n is 0 or 1).

2. The light-sensitive silver halide photographic material of claim 1, wherein said substituent for R in formula [I] is selected from the group consisting of a halogen atom, an alkyl group, a cycloalkyl group, an alkenyl group, an cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

3. The light-sensitive silver halide photographic material of claim 1, wherein X in formula [I] is selected from the group consisting of a hydrogen atom, a halogen atom and an organic group having a carbon atom, an oxygen atom, a sulfur atom, a nitrogen atom or phosphorus atom through which said organic group is connected with the remainder of the compound.

4. The light-sensitive silver halide photographic material of claim 1, wherein X in formula [I] is selected from the group consisting of a halogen atom, an alkoxy group, an aryloxy group, a heterocyclic oxy group, an acyloxy group, a sulfonyloxy group, an alkoxycabonyloxy group, an aryloxycarbonyloxy group, an alkyloxalyloxy group, an alkoxyoxalyloxy group, an alkylthio group, an arylthio group, a heterocyclicthio group, an alkyloxythiocarbonylthio group, a group represented by the formula

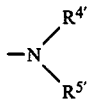

(wherein $R^{4'}$ and $R^{5'}$ independently represent a hydrogen atom, an alkyl group, an aryl gorup, a heterocyclic group, a sulfamoyl group, a carbamoyl group, an acyl group, a sulfonyl group, an aryloxycarbonyl group and an alkoxycarbonyl group provided that $R^{4'}$ and $R^{5'}$ are not simultaneously hydrogen atoms and $R^{4'}$ and $R^{5'}$ may combine with each other to form a nitrogen-containing heterocyclic group), a carboxyl group, a hydroxymethyl group, a triphenylmethyl group and a group represented by the following formula,

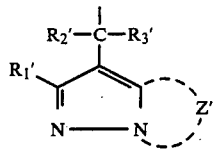

(wherein $R^{1'}$ is defined to be the same as R, Z' is the same as defined for as Z, and $R^{2'}$ and $R^{3'}$ are independently selected from the group consisting of a hydrogen atom, an aryl group, an alkyl group and a heterocyclic group.).

5. The light-sensitive silver halide photographic material of claim 1, wherein said nitrogen-containing heterocyclic ring in formula [I] is selected from the group consisting of a pyrazole ring, an imidazole ring, a triazole ring and a tetrazole ring provided that the above groups may have the same substituent as defined for R.

6. The light-sensitive silver halide photographic material of claim 1, wherein $R^1$ in formula [1] is an alkyl group having 8 to 30 carbon atoms.

7. The light-sensitive silver halide photographic material of claim 1, wherein M in formula [1] is selected from the group consisting of a hydrogen atom, an alkali metal atom, an alkaline earth metal atom, an ammonium and an amine.

8. The light-sensitive silver halide photographic material of claim 7, wherein M is an alkali metal atom.

9. The light-sensitive silver halide photographic material of claim 8, wherein M is a sodium ion or a potassium ion.

10. The light-sensitive silver halide photographic material of claim 8, wherein M is a sodium ion.

11. The light-sensitive silver halide photographic material of claim 7, wherein n is 1.

12. The light-sensitive silver halide photographic material of claim 1, wherein said compound represented by formula [I] is a magenta dye-forming coupler.

13. The light-sensitive silver halide photographic material of claim 12, wherein said magenta dye-forming coupler is incorporated into said silver halide emulsion layer in a quantity of $1\times10^{-3}$ mole to 1 mole per 1 mole of silver halide.

14. The light-sensitive silver halide photographic material of claim 13, wherein said magenta dye-forming coupler is incorporated into said silver halide emulsion layer in a quantity of $1\times10^{-2}$ mole to $8\times10^{-1}$ mole per 1 mole of silver halide.

* * * * *